United States Patent [19]

Naya et al.

[11] Patent Number: 4,927,989

[45] Date of Patent: May 22, 1990

[54] CONTACT MATERIAL FOR VACUUM CIRCUIT BREAKER

[75] Inventors: Eizo Naya; Mitsuhiro Okumura, both of Amagasaki; Seiichi Miyamoto, Marugame, all of Japan

[73] Assignee: Mitsubishi Denki Kabushiki Kaisha, Tokyo, Japan

[21] Appl. No.: 336,517

[22] Filed: Apr. 11, 1989

Related U.S. Application Data

[63] Continuation of Ser. No. 2,239, Jan. 12, 1987, abandoned.

[30] Foreign Application Priority Data

Jan. 10, 1986 [JP] Japan ..... 61-3763
May 9, 1986 [JP] Japan ..... 61-107208

[51] Int. Cl.[5] ..... H01H 1/02
[52] U.S. Cl. ..... 200/265
[58] Field of Search ..... 200/265, 266

[56] References Cited

U.S. PATENT DOCUMENTS

| | | | |
|---|---|---|---|
| 3,502,465 | 3/1970 | Nakijima | 200/266 |
| 4,325,734 | 4/1982 | Burrage et al. | 75/225 |
| 4,468,631 | 12/1984 | Naya et al. | 200/266 |
| 4,540,861 | 9/1985 | Okumura et al. | 200/266 |
| 4,575,451 | 3/1986 | Naya et al. | 200/266 |
| 4,626,282 | 12/1986 | Naya et al. | 200/265 |

FOREIGN PATENT DOCUMENTS

| | | | |
|---|---|---|---|
| 0109088 | 5/1984 | European Pat. Off. . | |
| 0110176 | 6/1984 | European Pat. Off. . | |
| 0155322 | 9/1985 | European Pat. Off. . | |
| 0181149 | 5/1986 | European Pat. Off. | 200/266 |
| 643567 | 4/1987 | Fed. Rep. of Germany . | |
| 2298609 | 8/1976 | France . | |

*Primary Examiner*—Renee S. Luebke
*Attorney, Agent, or Firm*—Oblon, Spivak, McClelland, Maier & Neustadt

[57] ABSTRACT

A contact material for a vacuum circuit breaker having excellent properties, which consists essentially of copper, molybdenum, one member selected from the group consisting of niobium and tantalum, and one or more kinds of low melting point materials.

12 Claims, 42 Drawing Sheets

CONTACT MATERIAL FOR VACUUM CIRCUIT BREAKER

This application is a continuation of application Ser. No. 002,239, filed on Jan. 12, 1987, now abandoned.

This present invention relates to a contact material for a vacuum circuit breaker, which is excellent in its large current breaking property.

The vacuum circuit breaker has various advantages such that it is free from maintenance, does not bring about public pollution, is excellent in its current breaking property, and so forth, on account of which the extent of its application has become broadened very rapidly. With this expansion in its utility, demands for higher voltage withstand property and large current breaking capability of the vacuum circuit breaker have become increasingly stringent. On the other hand, the performance of the vacuum circuit breaker depends, to a large extent, on those factors to be determined by the contact material placed within a vacuum container for the vacuum circuit breaker.

For the characteristics of the contact material for the vacuum circuit breaker to satisfy, there may be enumerated: (1) large current breaking capacity; (2) high voltage withstand; (3) small contact resistance; (4) small melt-adhesive force; (5) low chopping current value; (6) good workability; (7) sufficient mechanical strength; and so forth.

In the actual contact material, it is fairly difficult to satisfy all of these characteristics, and general circumstances at the present time are such that use is made of a material which meets particularly important characteristic depending on its use at the sacrifice of other characteristics to some extent. For instance, the contact material of copper-tungsten alloy as disclosed in Japanese Unexamined Patent Publication No. 78429/1980 is excellent in its voltage withstand capability, owing to which it is frequently employed for a load-break switch, a contactor, and so forth, although it has a disadvantage such that its current breaking property is inferior.

On the other hand, the contact material of copper-chromium alloy as disclosed, for example, in Japanese Unexamined Patent Publication No. 71375/1979 has been widely used for a circuit breaker or the like owing to its excellent current breaking property, but its voltage withstand capability is inferior to that of the above-mentioned contact material of copper-tungsten alloy.

Further, the contact material of copper-chromium-bismuth alloy as disclosed, for example, in Japanese Unexamined Patent Publication No. 147481/1979 has a low melt-adhesion and peeling force, which makes it possible to reduce the operating force of the vacuum circuit breaker with the consequent advantages such that the circuit breaker can be designed in a compact size, and the chopping current value can be made low. On the other hand, however, its voltage withstand capability and current breaking property are inferior to those of the above-mentioned contact material of copper-chromium alloy.

Furthermore, the contact material of copper-molybdenum-niobium alloy as disclosed, for example, in Japanese Patent Application No. 230619/1984 is very excellent in its current breaking property and voltage withstand capability, owing to which it appears to be useful in wide range in future, although the contact material indicates its property of somewhat higher chopping current value and melt-adhesion and peeling force than those of the above-mentioned contact material of copper-chromium-bismuth alloy.

As described in the foregoing, the conventional contact materials for the vacuum circuit breaker have so far been used in taking advantage of various properties they possess. In recent years, however, demands for large current breaking property and high voltage withstand capability of the vacuum circuit breaker have become more and more stringent with the result that such conventional contact materials tend to be difficult to satisfy the required performance. There has also been a demand for the contact material having more excellent performance against size-reduction in the vacuum circuit breaker.

The present invention has been made with a view to improving the conventional contact material as mentioned in the foregoing, and aims at providing an improved contact material for the vacuum circuit breaker being excellent in its current breaking property; having higher voltage withstand capability; having low melt-adhesion and peeling force; and being small in its chopping current value and its power consumption at the contact points.

The present inventors produced various alloy materials, on the experimental basis, by addition of various metals, alloys, and intermetallic compounds to copper base, and by assembly of these alloy materials in the vacuum circuit breaker, with which to conduct various tests. As the result of these tests, it was found out that the contact materials containing one or more kinds of low melting point metals such as bismuth, tellurium, antimony, thallium, lead, selenium, cerium and calcium in the alloy base of copper-molybdenum-niobium, and the contact materials containing one or more kinds of low melting point metals such as bismuth, tellurium, antimony, thallium and lead in the alloy base of copper-molybdenum-tantalum were excellent in their current breaking property and voltage withstand capability, and had low melt-adhesion and peeling force, low chopping current value, and low power consumption at the contact.

The contact material for the vacuum circuit breaker according to the present invention is characterized in that it contains, in the copper-molybdenum-niobium alloy base, one or more kinds of low melting point metals such as bismuth, tellurium, antimony, thallium, lead, selenium, cerium and calcium.

Further, the contact material for the vacuum circuit breaker according to the present invention is characterized in that it contains, in the copper-molybdenum-tantalum alloy base, one or more kinds of low melting point metals such as bismuth, tellurium, antimony, thallium and lead.

Various ways of carrying out the present invention will be described in detail hereinbelow with reference to several preferred examples thereof in reference to the accompanying drawing, in which.

Figure 11:
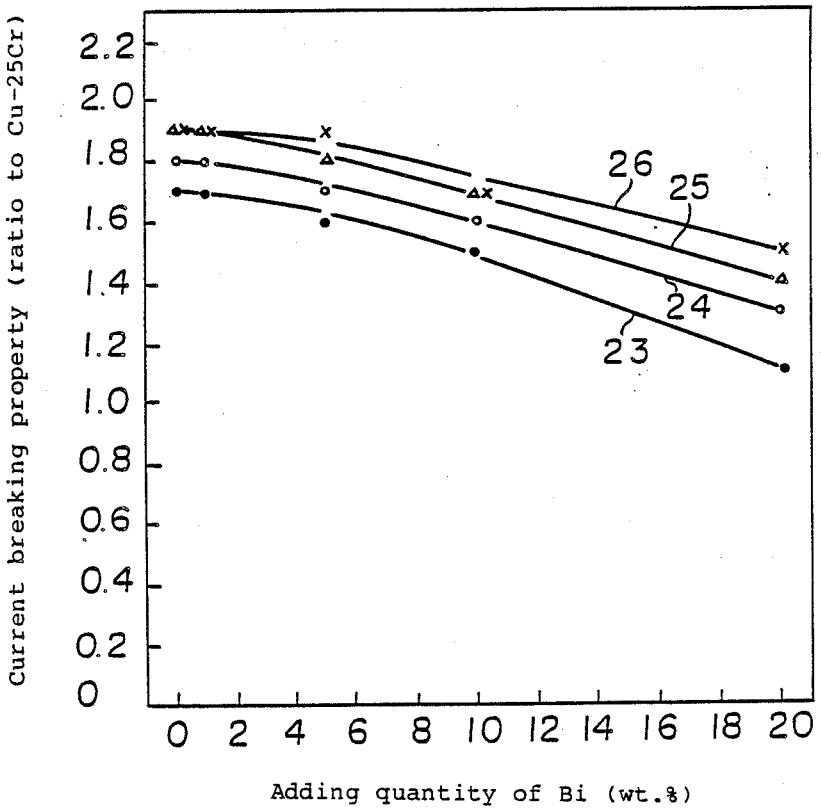
Figure 12:
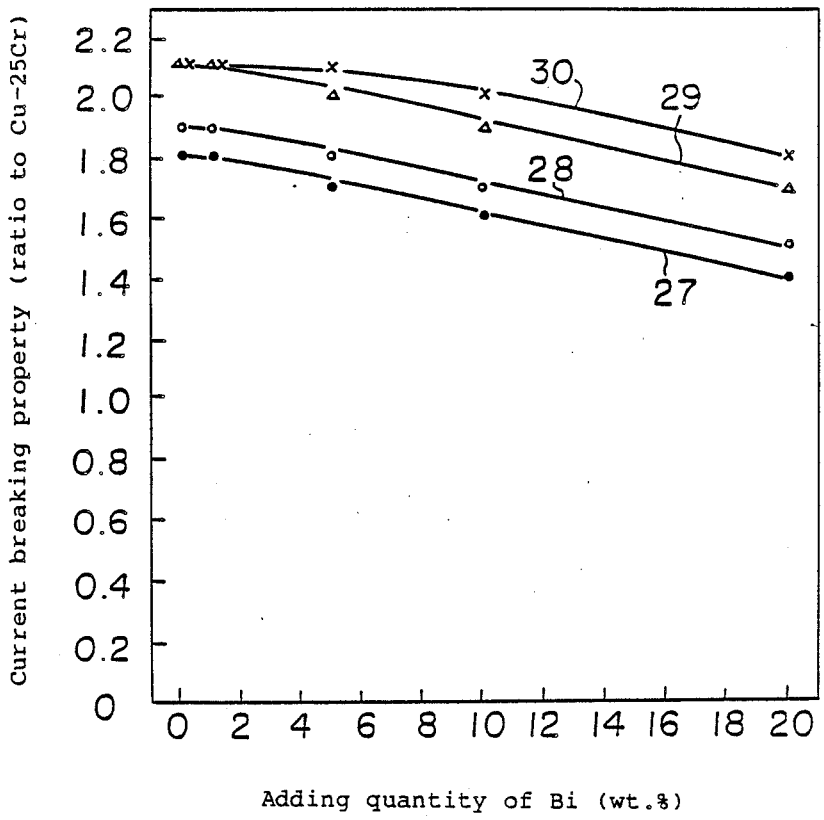
Figures 1, 13:
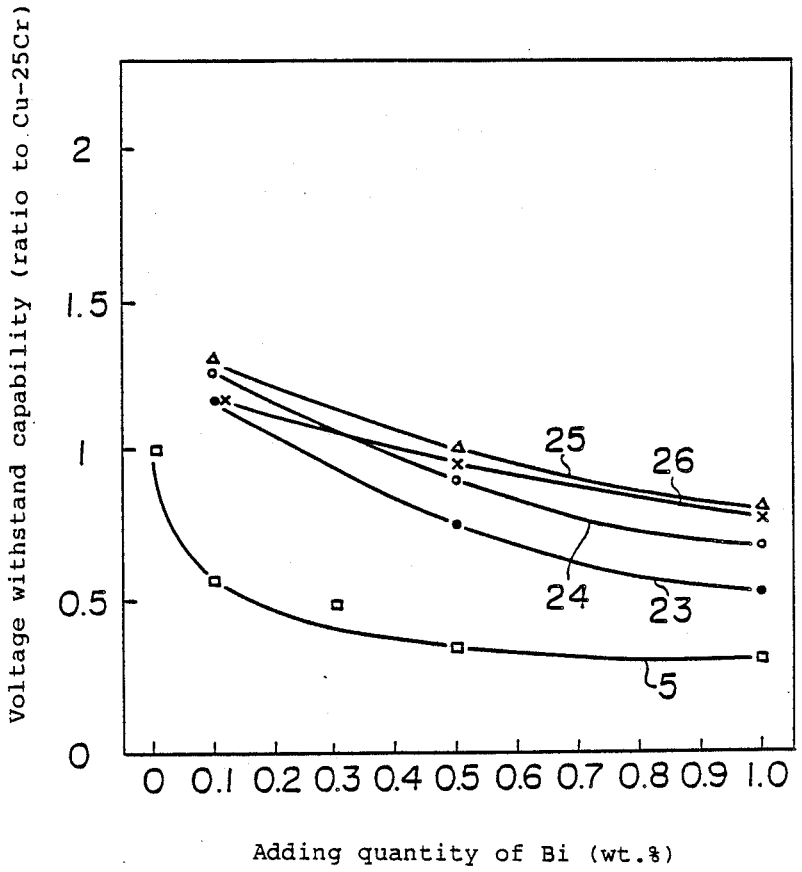
Figures 2, 13:
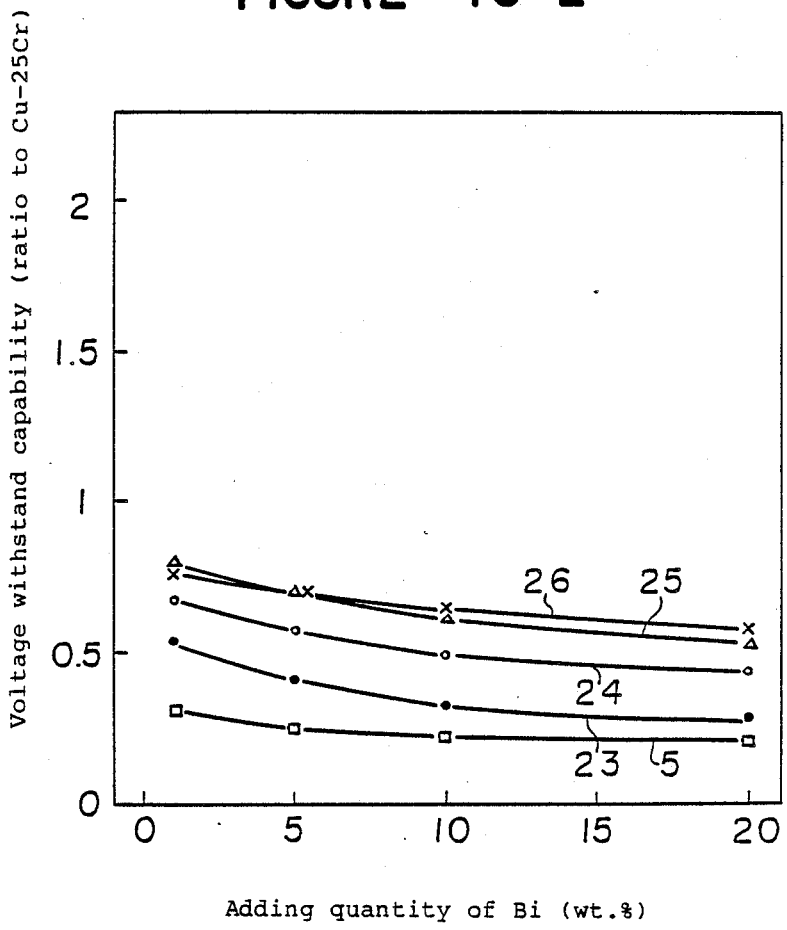
Figures 1, 14:
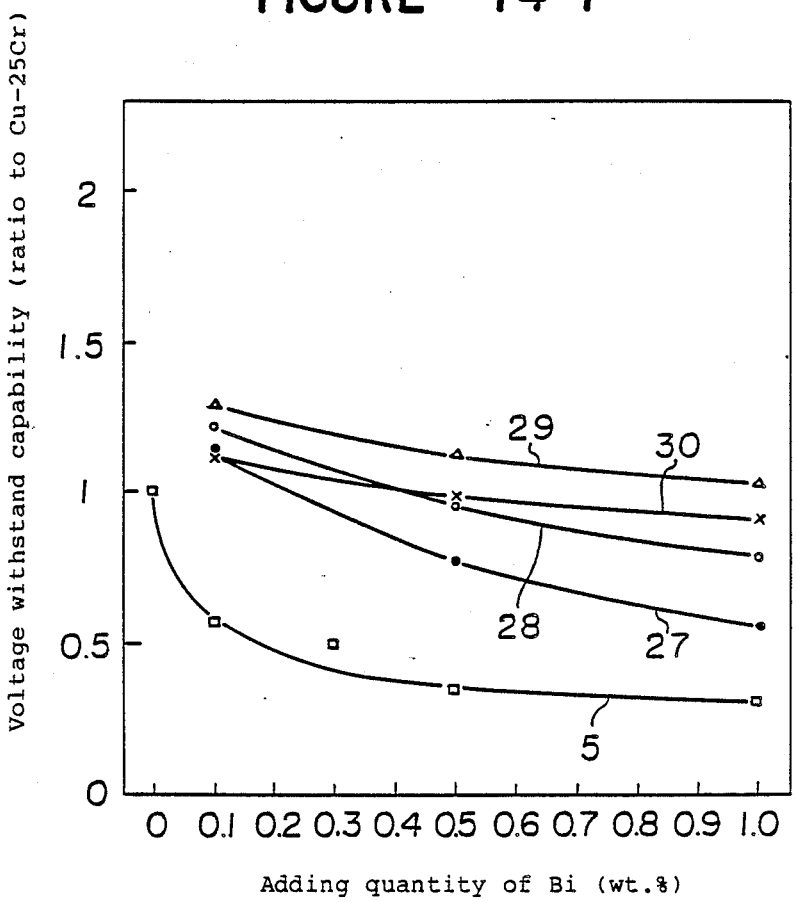
Figures 2, 14:
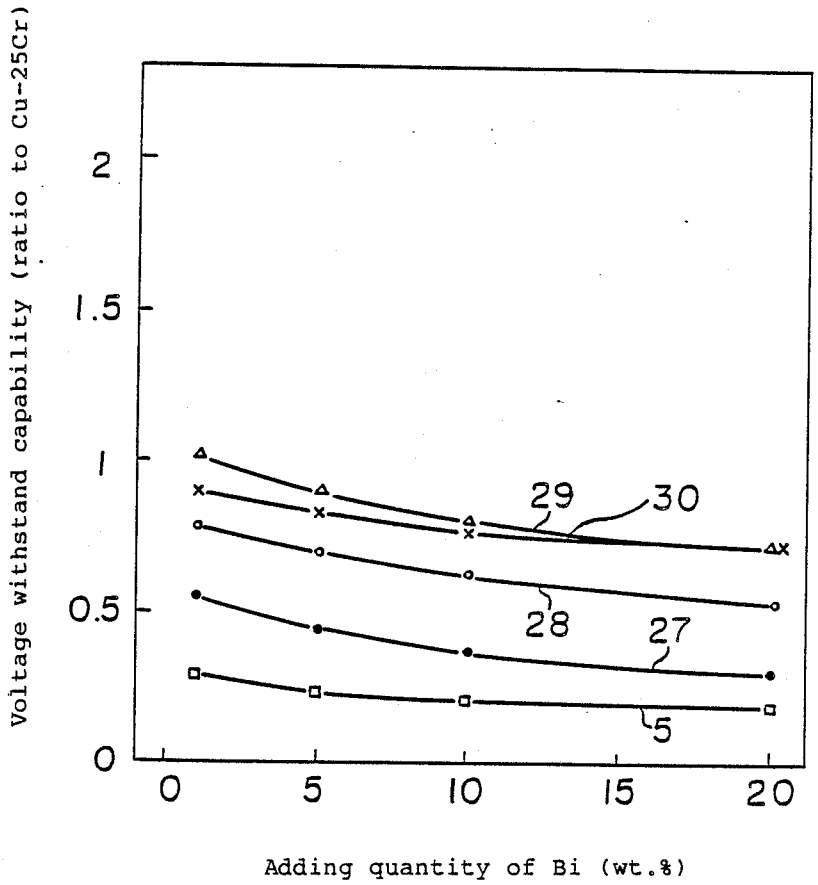

FIGS. 11 and 12 are graphical representations showing the current breaking property of the contact materials produced by the vacuum hot press method according to other example of the present invention; and FIGS. 13 and 14 are graphical representations showing the voltage withstand capability of the contact materials produced by the vaccum hot press method according to other example of the present invention.

Figure 15:
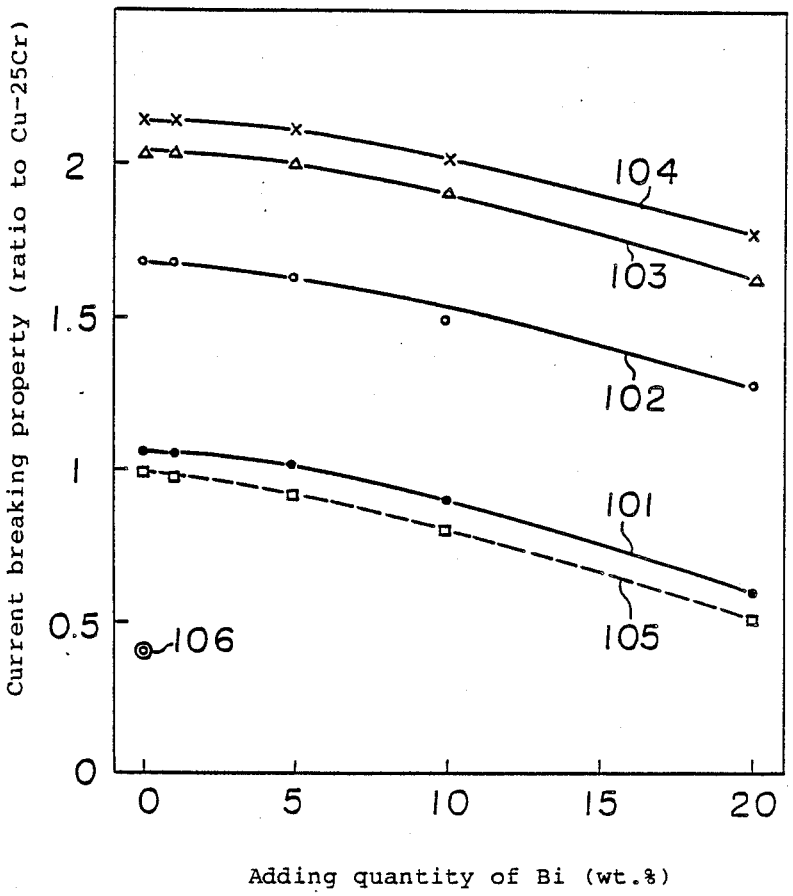
Figure 16:
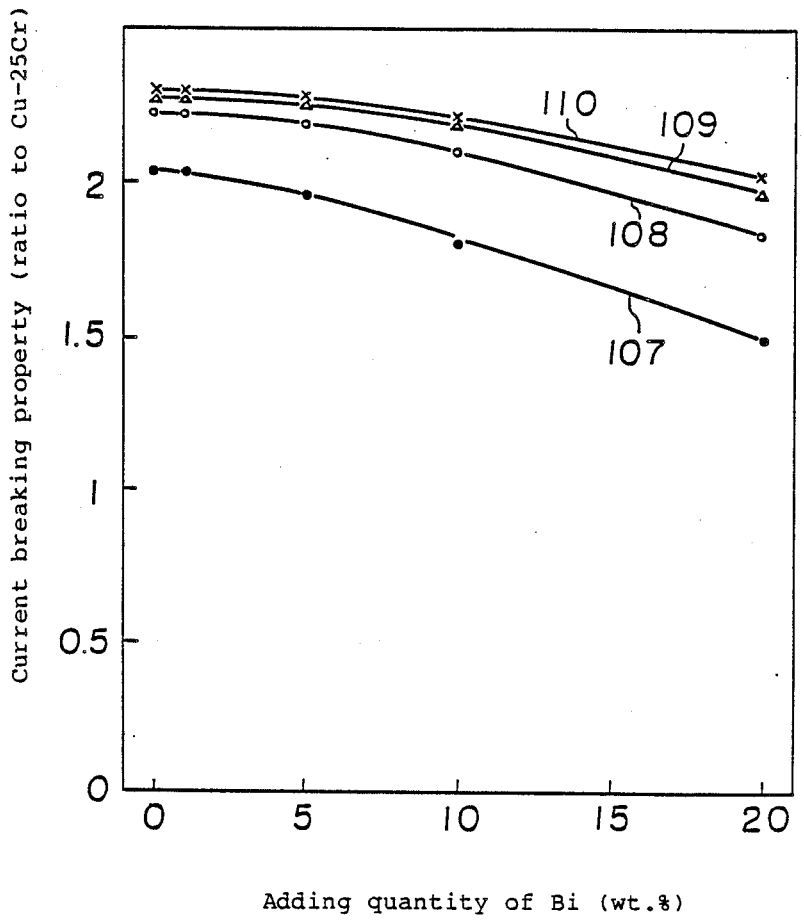
Figure 17:
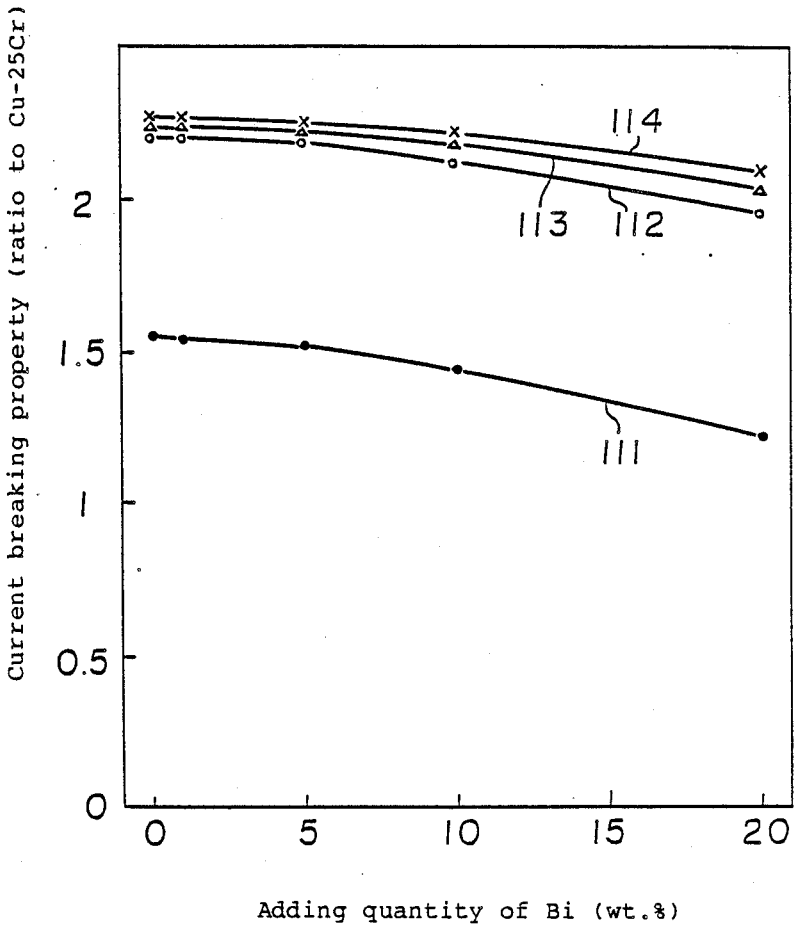
Figures 1, 18:
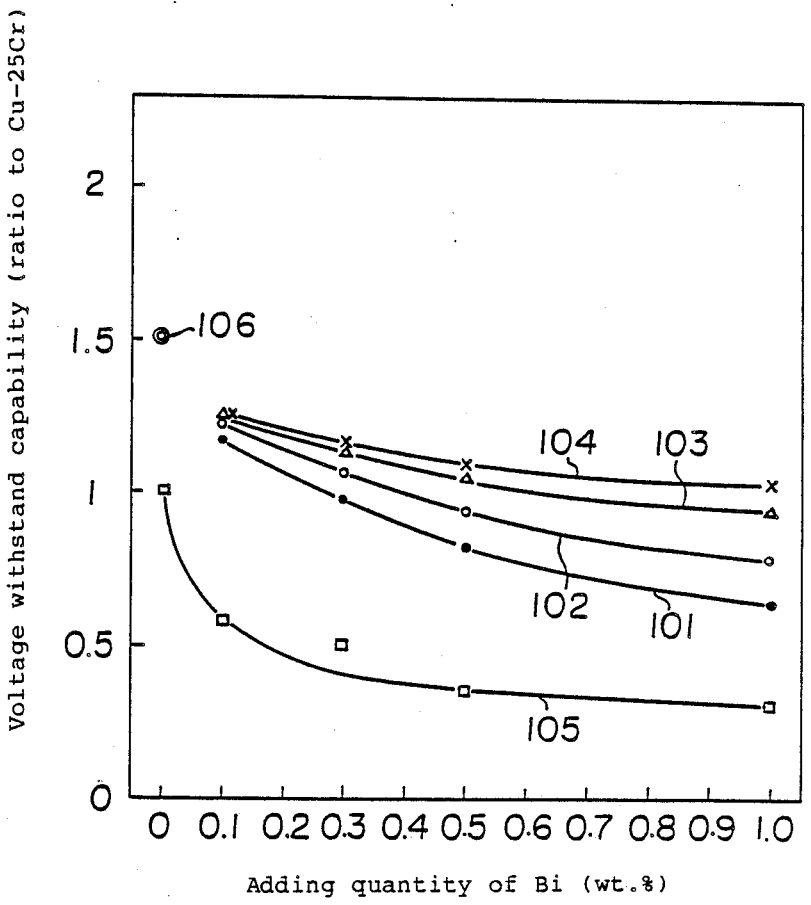
Figures 2, 18:
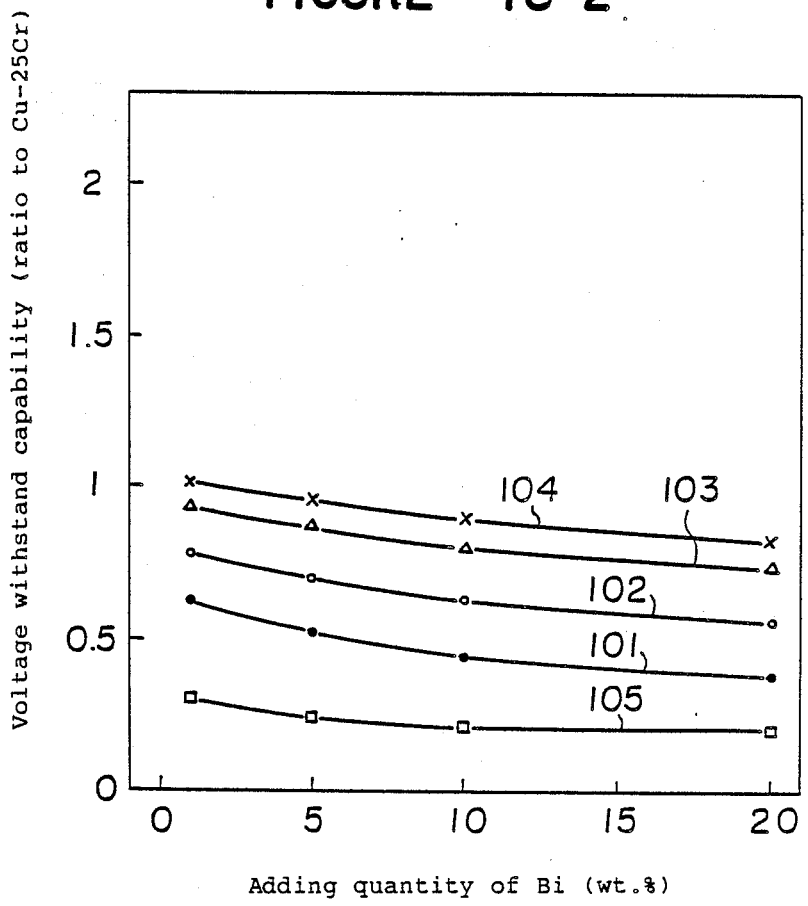
Figures 1, 19:
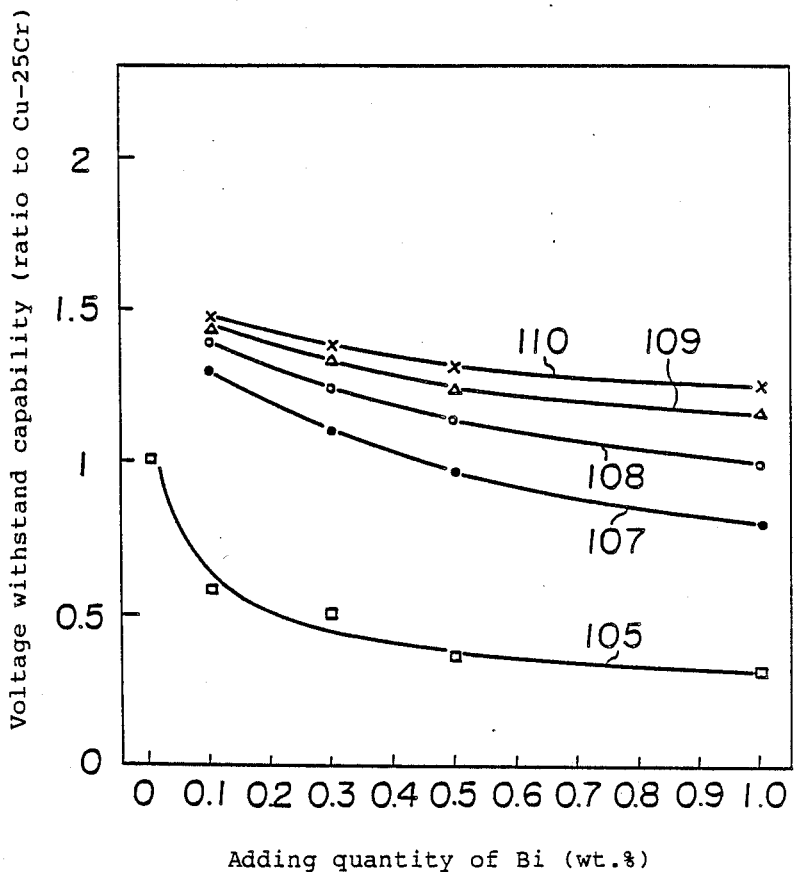
Figures 2, 19:
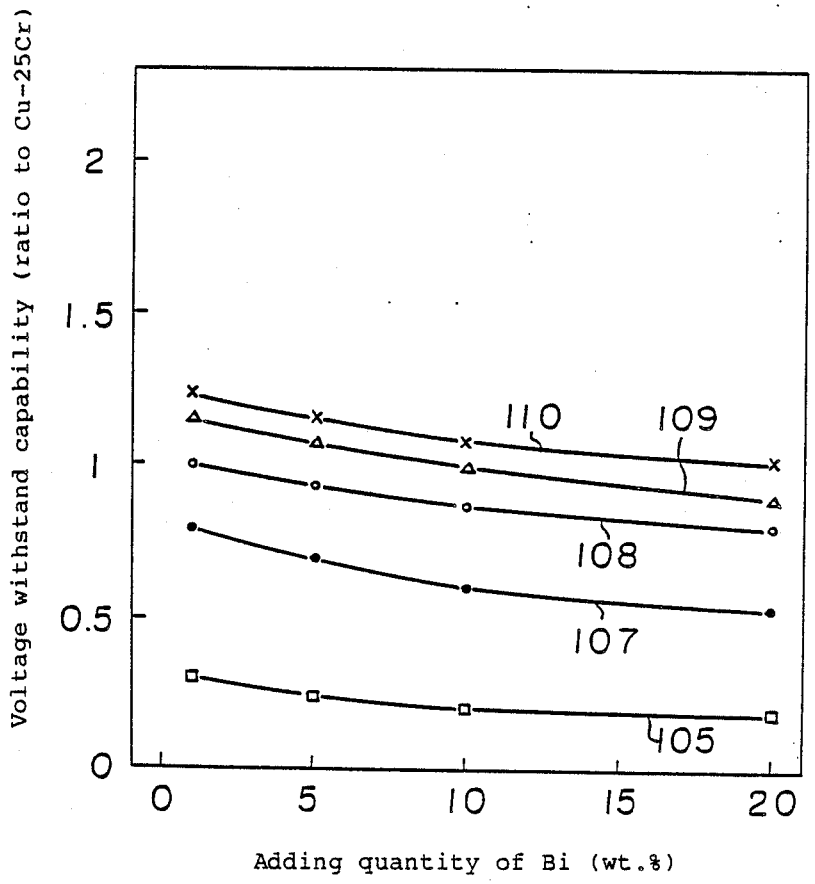
Figures 1, 20:
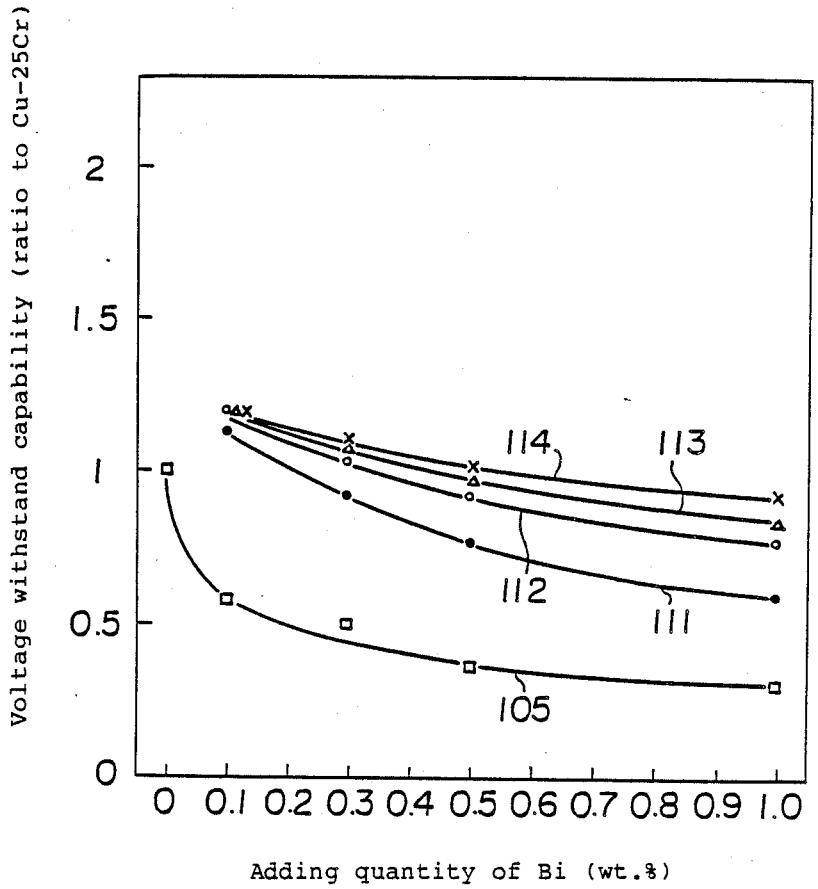
Figures 2, 20:
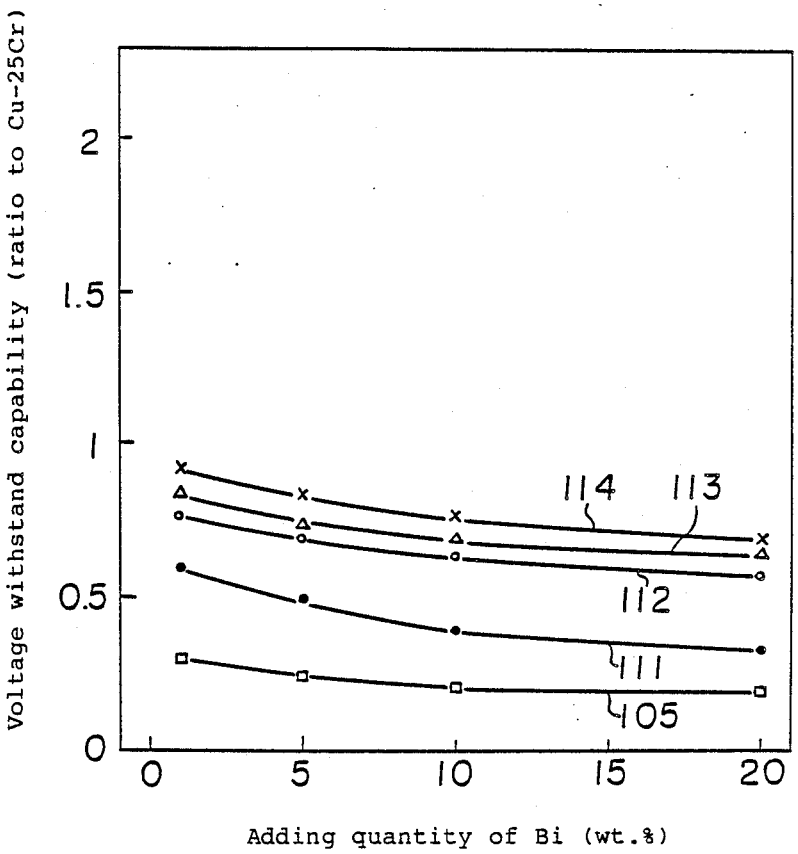
Figure 21:
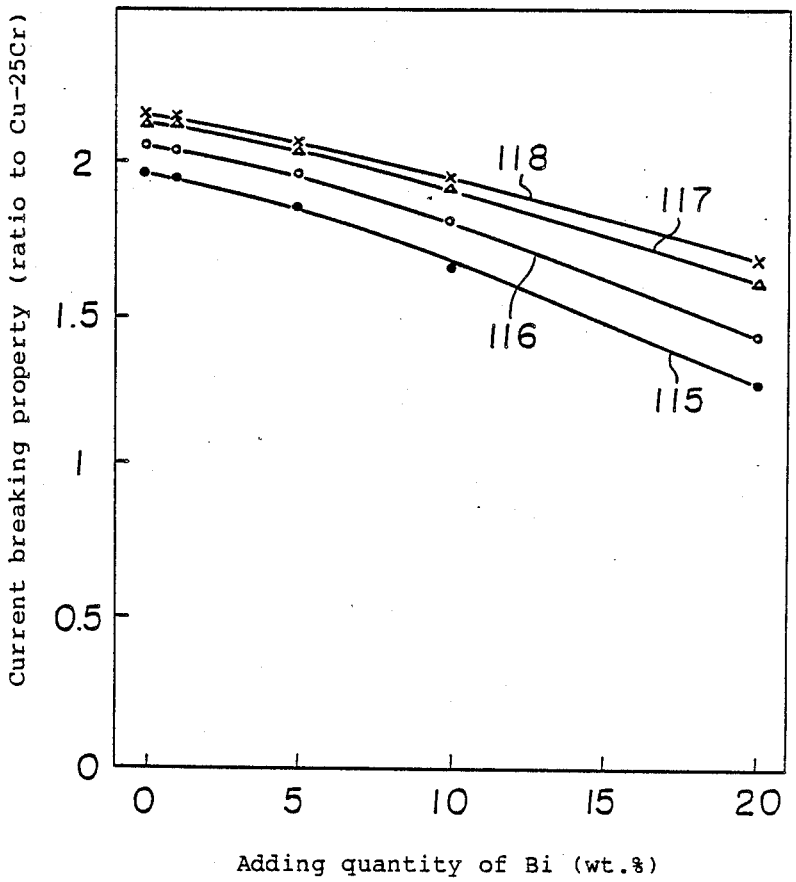
Figure 22:
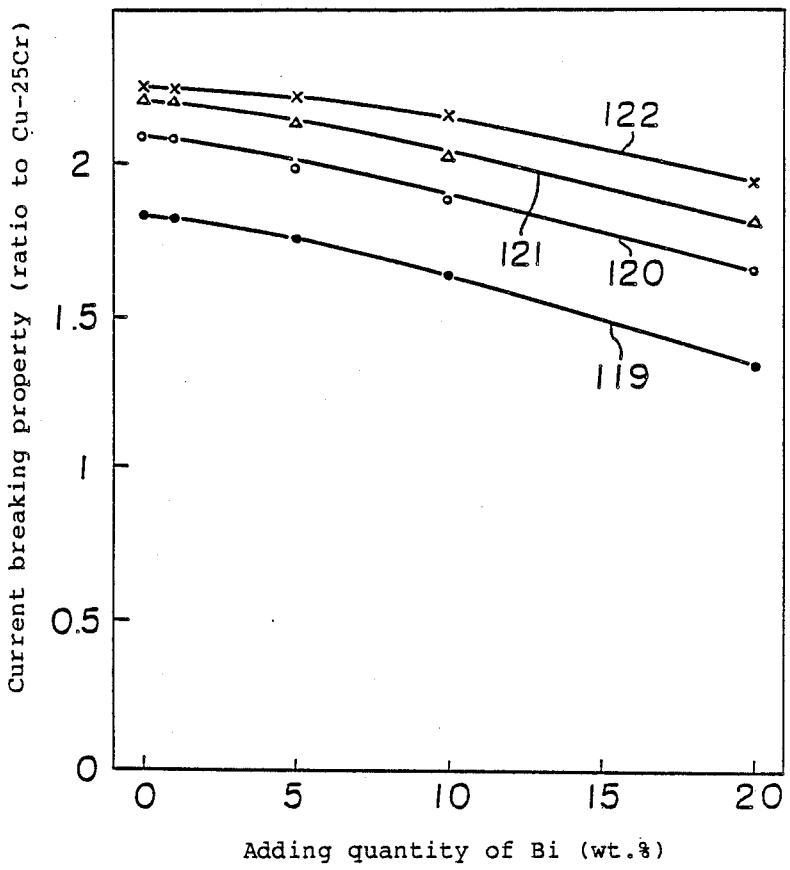
Figures 1, 23:
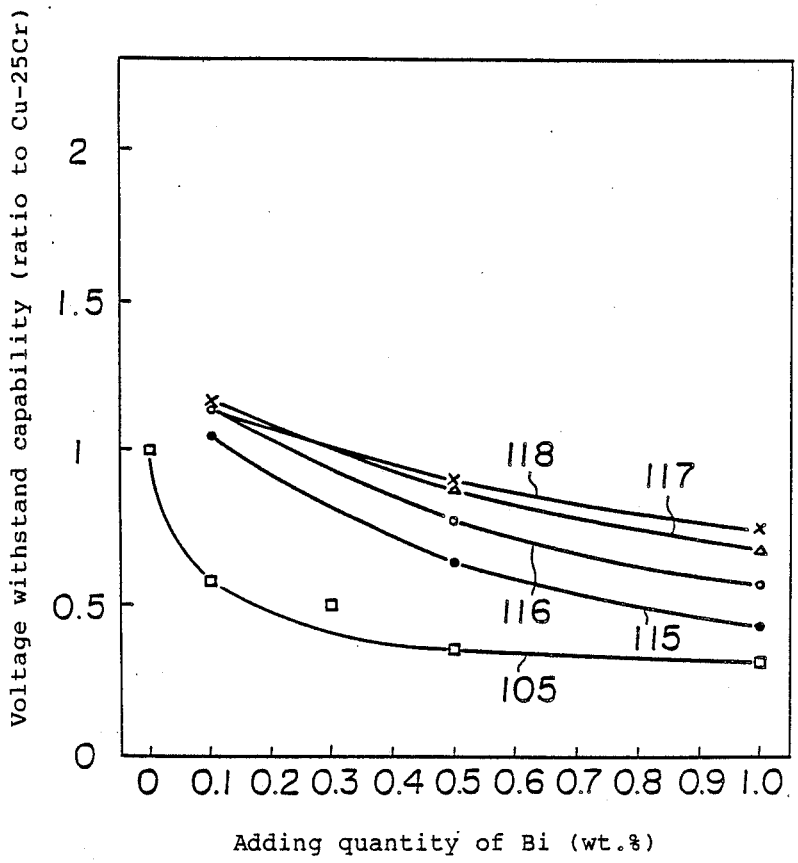
Figures 2, 23:
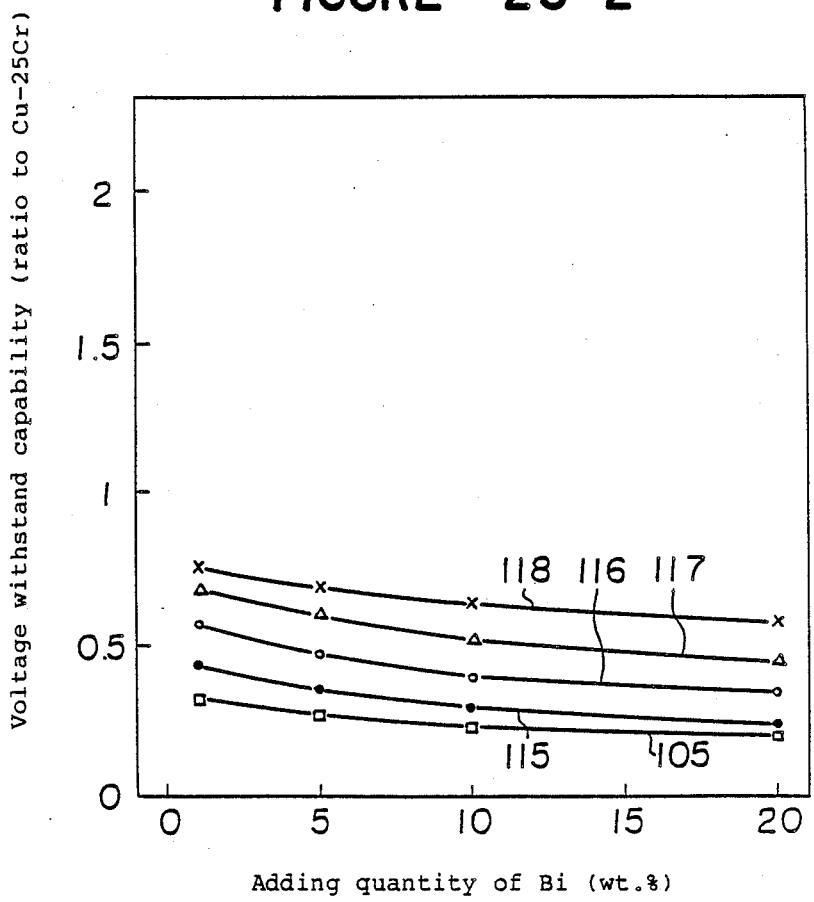
Figures 1, 24:
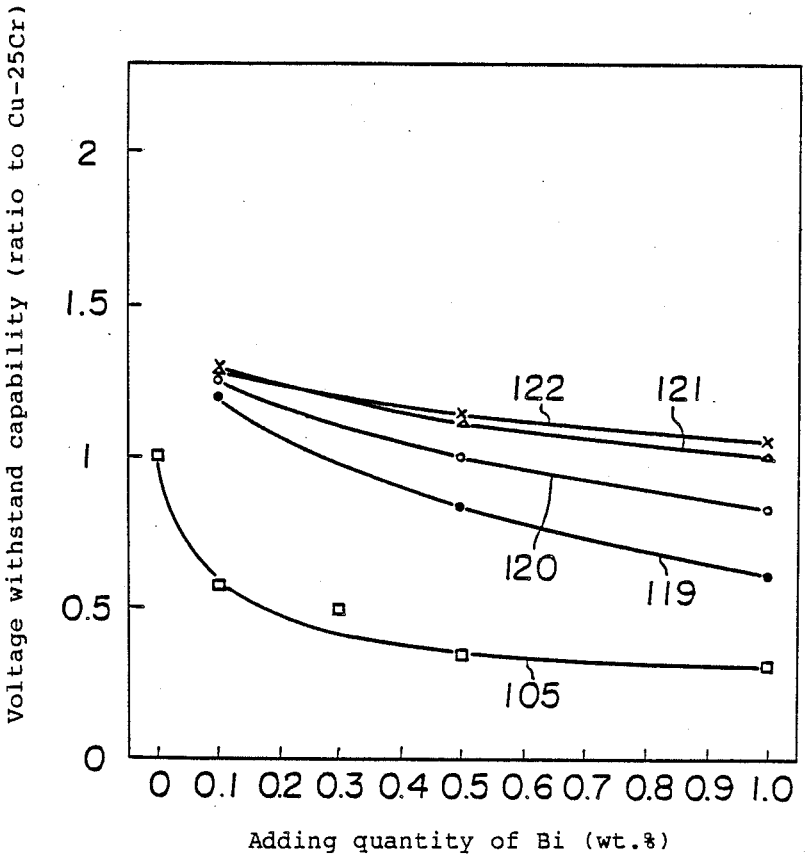
Figures 2, 24:
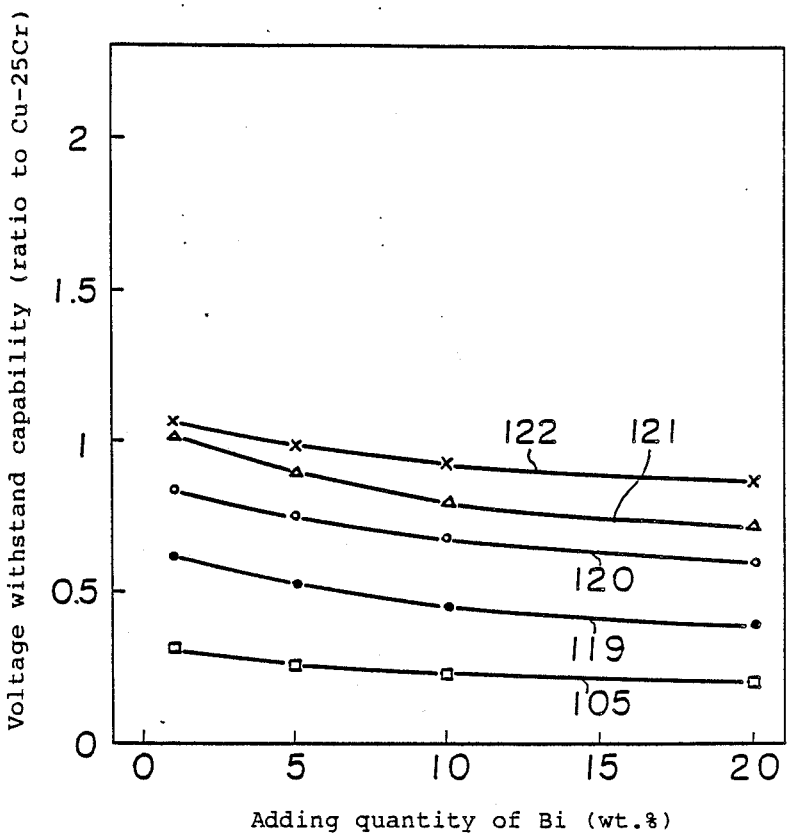
Figure 25:
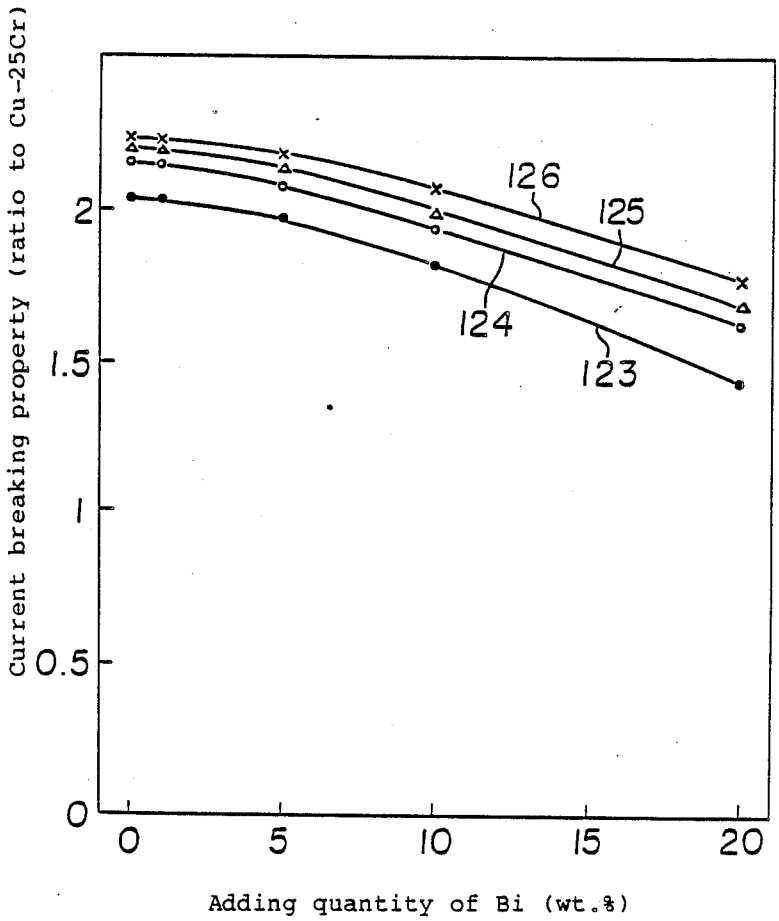
Figure 26:
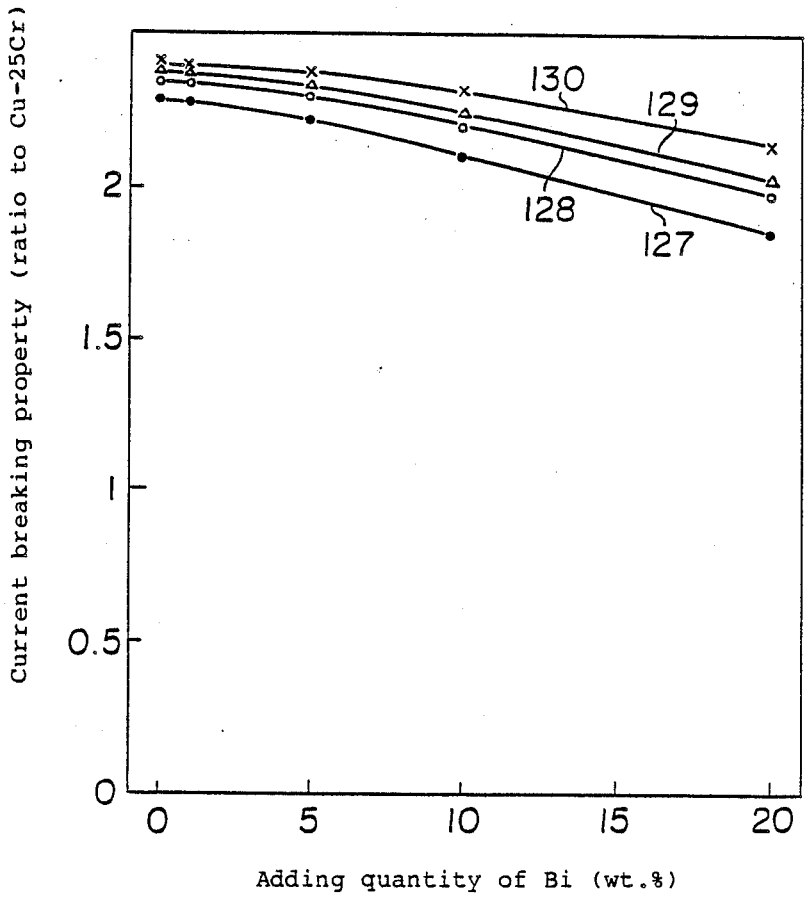
Figures 1, 27:
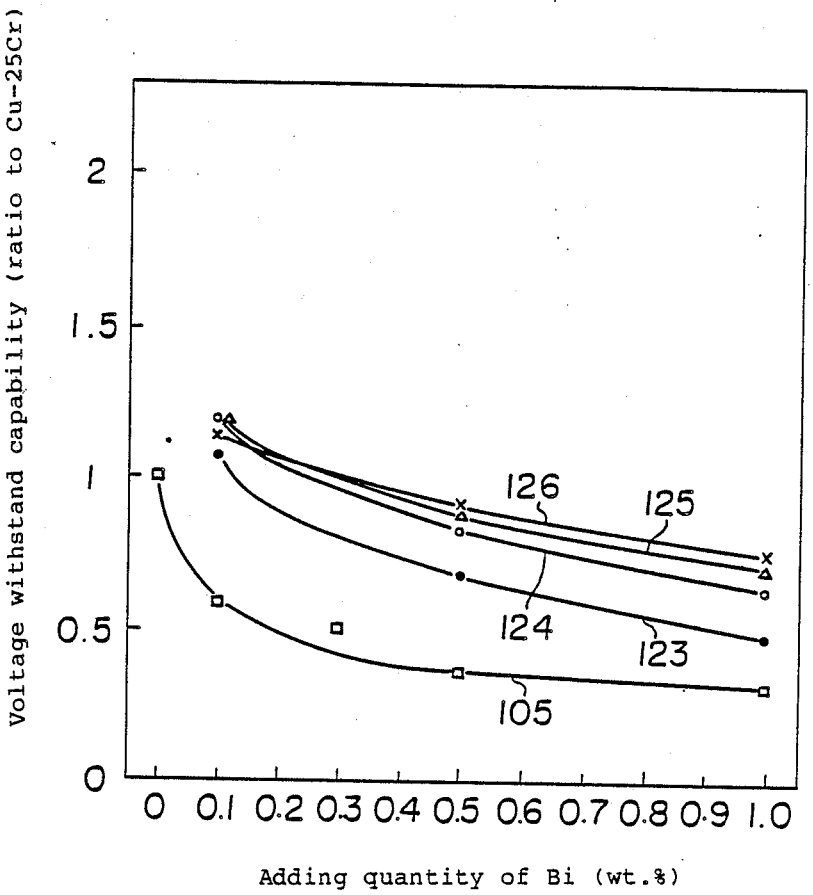
Figures 2, 27:
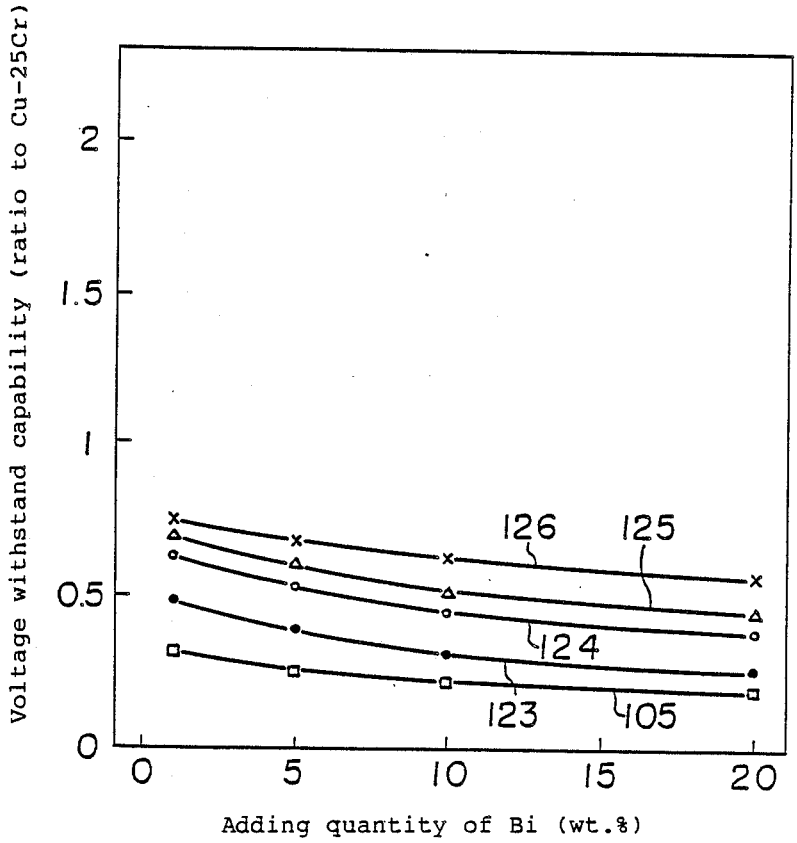
Figures 2, 28:
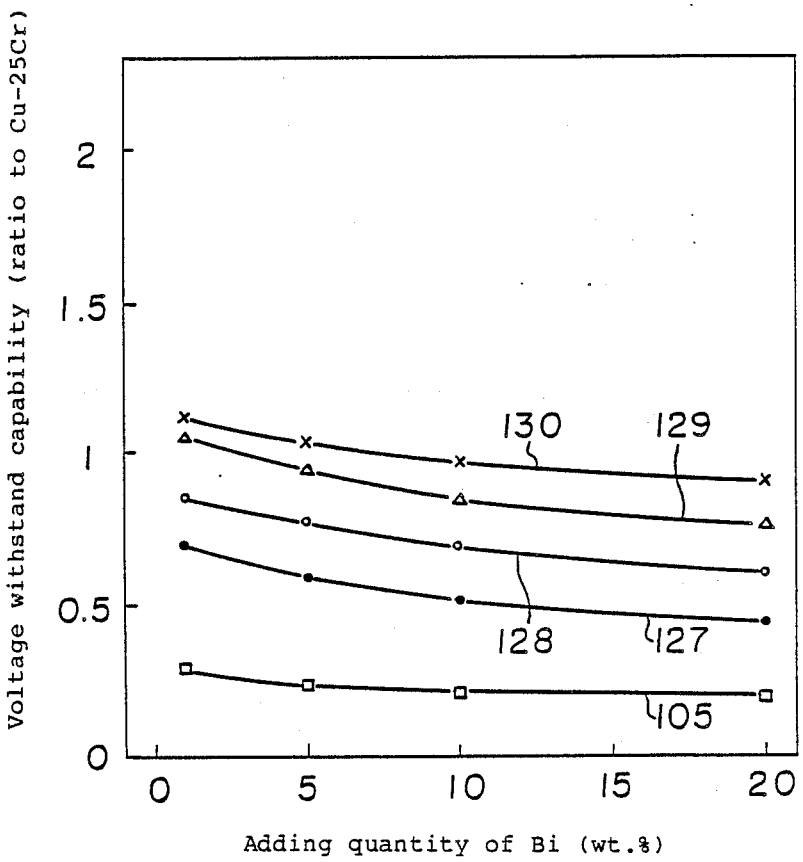
Figures 1, 28:
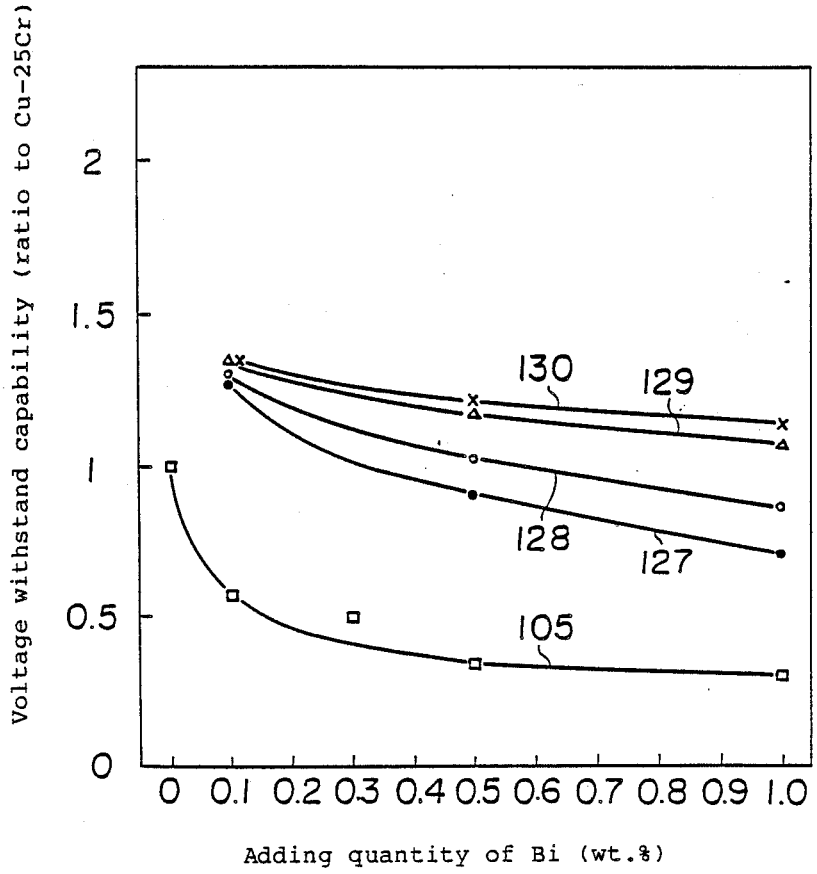

FIGS. 15, 16 and 17 are graphical representations showing the current breaking property of the contact materials produced by the infiltration method according to one example of the present invention;

FIGS. 18, 19 and 20 are graphical representations showing the voltage withstand capability of the contact materials produced by the infiltration method according to one example of the present invention;

FIGS. 21 and 22 are graphical representations showing the current breaking property of the contact materials produced by the powder sintering method according to another example of the present invention;

FIGS. 23 and 24 are graphical representations showing the voltage withstand capability of the contact materials produced by the powder sintering method according to another example of the present invention;

FIGS. 25 and 26 are graphical representations showing the current breaking property of the contact materials produced by the vacuum hot press method according to other example of the present invention; and FIGS. 27 and 28 are graphical representations showing the voltage withstand capability of the contact materials produced by the vaccum hot press method according to other example of the present invention.

EXAMPLES

In the following, the present invention will be described in detail with reference to specific examples thereof.

EXAMPLE 1

(Production of Contact Materials)

The contact materials were produced in accordance with the powder metallurgy using the three methods of "infiltration", "complete powder sintering"; and "hot pressing".

Production of the contact material according to the first method infiltration was carried out in such a manner that molybdenum powder having particle size of 3 μm in average, niobium powder having a particle size of 40 μm or below, copper powder having a particle size of 40 μm or below, and bismuth powder having a particle size of 75 μm or below were weighed at their respective ratios of 73.8:7.7:18.0: 0.5, followed by mixing the ingredients for two hours; subsequently, this mixed powder was filled in a metal mold of a predetermined configuration and subjected to shaping under a pressure of 1 ton/cm$^2$; thereafter, a mass of oxygen-free copper was placed on this shaped body, which was held for one hour in the hydrogen atmosphere at a temperature of 1,250° C. to thereby obtain the contact material with the oxygen-free copper having been impregnated into the shaped body. The ultimate compositional ratio of this contact material is indicated in Table 1 below, where it is indicated as "Sample No. N-Bi-18". Incidentally, this Table 1 lists other contact materials of various compositional ratios, which were produced by the same method as described above.

Production of the contact material according to the second method of complete powder sintering was carried out in such a manner that molybdenum powder having an average particle size of 3 μm, niobium powder having a particle size of 40 μm or below, copper powder having a particle size of 75 μm or below, and bismuth powder having a particle size of 75 μm or below were weighed at their respective ratios of 38.1:1.9:59.9:0.1, followed by mixing the ingredients for two hours; subsequently, this mixed powder was filled in a metal mold of a predetermined configuration and subjected to shaping under a pressure of 3.3 tons/cm$^2$; thereafter, this press-formed body was sintered for two hours in the hydrogen atmosphere at a temperature immediately below the melting point of copper, whereby the intended contact material was obtained. The ultimate compositional ratio of this contact material is indicated in Table 2, where it is indicated as "Sample No. N-Bi-89". By the way, this Table 2 also lists other contact materials of different compositional ratios, which were produced by the same method as described above.

Production of the contact material according to the third method of hot pressing was carried out in such a manner that molybdenum powder having an average particle size of 3 μm, niobium powder having a particle size of 40 μm, or below, copper powder having a particle size of 75 μm, or below, and bismuth powder having a particle size of 75 μm or below were weighed at their respective ratios of 38.1:1.9:59.9:0.1, followed by mixing the ingredients for two hours; subsequently, this mixed powder was filled in a dice made of carbon and then subjected to heating in the vacuum for two hours at a temperature of 1,000° C., during which a pressure of 200 kg/cm$^2$ was applied to the mixed powder by means of the hot press device, thereby obtaining a mass of the contact material. The ultimate compositional ratio of the thus obtained contact material is shown in Table 3 below, where it is indicated as "Sample No. N-Bi-137". By the way, this Table 3 also indicates other contact materials of different compositional ratios, which were produced by the same method as described above.

Also, for the purpose of comparing the properties with the contact materials according to the present invention, the compositional ratios of the contact materials which have heretofore been used are shown in Table 4 below. The same method of the complete powder sintering as described above was used for the production of these conventional contact materials.

(Properties of Contact Materials)

The above-described contact materials produced in accordance with each of the afore-described various methods in the powder metallurgy were machine-processed into electrodes, each having 20 mm in diameter. Each of these electrodes were then assembled into a vacuum circuit breaker to measure its electrical properties. The results of measurement are shown in Table 5 below. The measurements were carried out on the current breaking property, voltage withstand capability, chopping current value, melt-adhesion and peeling force, and power consumption at the contact points. The results are expressed in terms of magnification with the properties of the conventional Cu-25Cr alloy (the sample C-1 in Table 4) as the reference. For the current breaking capability, therefore, a higher magnification indicates superiority; and the contact point having its magnification of 1 or above indicates that it possesses more excellent current breaking capability than the conventional Cu-25Cr alloy. With regard to the voltage withstand capability, the same thing as that of the current breaking property can be said, i.e., a higher magnification indicates superiority. On the other hand, the chopping current value should desirably be lower in its magnification from the standpoint of its use, hence a lower magnification indicates superiority. In the same manner, a lower magnification of the melt-adhesion and peeling force may be advantageous from the view point of the operating mechanism, and a lower magnification should also be desirable concerning the power consumption at the contact point; therefore, lower values of the magnification for both properties indicate superiority.

From Table 5, it is seen that, with regard to the current breaking property, almost all of the contact materials according to the present invention which were produced by the infiltration method are superior to the conventional Cu-25Cr alloy contact material. For those contact materials having their current breaking property of 1 or below, when the Sample No. N-Bi-73, for example, is compared with Cu-Cr-Bi alloy material (Sample No. C-Bi-7 in Table 6 below) containing therein the same amount of bismuth (20% by weight) as in N-Bi-73, it is seen that N-Bi-73 has the magnification value of 0.6 (as compared with Cu-25Cr), while C-Bi-7 has the magnification value of 0.51 (as compared with Cu-25Cr), hence the contact material of the present invention is superior.

Figure 1:
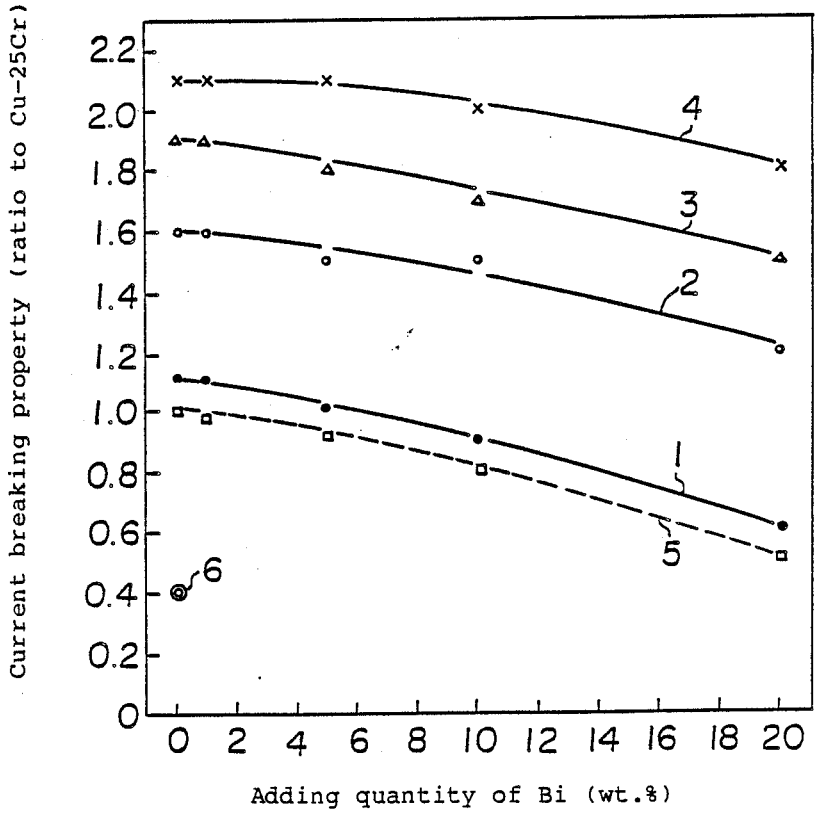
FIGS. 1, 2 and 3 are graphical representations showing the current breaking property of the contact materials produced by the infiltration method according to one example of the present invention.

FIG. 1 is a graphical representation showing the current breaking property of the contact materials according to the present invention, in which the current breaking property is expressed in terms of the contact material produced by the infiltration method with the amount of Cu being approximately 60% by weight. In the drawing, the ordinate axis denotes the current breaking property with the property of the conventional Cu-25Cr contact material (Sample No. C-1) being made the reference, while the abscissa axis represents the adding quantity of Bi. In the drawing, a curve 1 indicates the current breaking property of the contact material with the added quantity of Nb relative to Mo being 4.7% by weight, wherein the adding quantity of Bi is varied (Sample Nos. N-Bi-1, N-Bi-13, N-Bi-25, N-Bi-37, N-Bi-49, N-Bi-61, N-Bi-73); a curve 2 indicates the current breaking property of the contact material with the added quantity of Nb relative to Mo being 9.4% by weight, wherein the adding quantity of Bi is varied (Sample Nos. N-Bi-2, N-Bi-14, N-Bi-26, N-Bi-38, N-Bi-50, N-Bi-62, N-Bi-74); a curve 3 indicates the current breaking property of the contact material with the added quantity of Nb relative to Mo being 18.9% by weight, wherein the adding quantity of Bi is varied (Sample Nos, N-Bi-3, N-Bi-15, N-Bi-27, N-Bi-39, N-Bi-51, N-Bi-63, N-Bi-75); and a curve 4 also indicates the current breaking property of the contact material with the added quantity of Nb relative to Mo being 28.5% by weight, wherein the adding quantity of Bi is varied (Sample Nos, N-Bi-4, N-Bi-16, N-Bi-28, N-Bi-40, N-Bi-52, N-Bi-64, N-Bi-76). Further, in this drawing, a curve 5 (in dash line) indicates the current breaking property of the conventional Cu-25Cr alloy contact material (Sample Nos. C-1, C-Bi-1, C-Bi-2, C-Bi-3, C-Bi-4, C-Bi-5, C-Bi-6, C-Bi-7), to which Bi was added. Also, in the same drawing, a double-circle 6 indicates the current breaking property of the conventional Cu-Mo alloy contact material (Sample No. M-1). The results of the measurements on these conventional alloy contact materials are shown in Table 6 below.

From FIG. 1, it may be seen that the contact materials of the present invention with the added quantity of Nb relative to Mo being 9.4% by weight, 18.9% by weight and 28.5% by weight, respectively (the curves 2, 3 and 4 in the drawing) are superior to the conventional Cu-25Cr alloy contact material, even if the adding quantity of Bi is 20% by weight. Further, the alloy contact material of the present invention with the added quantity of Nb relative to Mo being 4.7% by weight (the curve 1 in the drawing) is also superior to the conventional Cu-25Cr alloy contact material, if the adding quantity of Bi is not exceeding 5% by weight, and this contact material is still excellent in comparison with the Cu-25Cr-Bi alloy contact material (the curve 5 in the drawing), even when the adding quantity of Bi is above 5% by weight.

Figure 2:
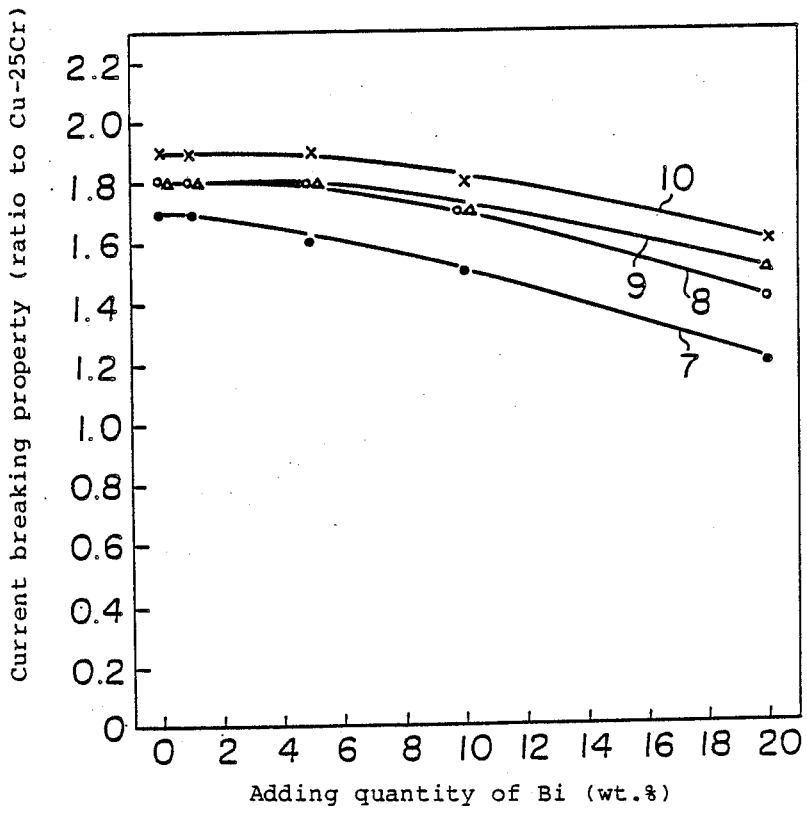

FIG. 2 is a graphical representation showing the current breaking property of the contact materials according to the present invention, in which the current breaking property is expressed in terms of the contact material produced by the infiltration method with the amount of Cu being approximately 50% by weight. In the drawing, both axes of ordinate and abscissa represent the same entries as in FIG. 1. In the drawing, a curve 7 indicates the current breaking property of the contact material of the present invention with the added quantity of Nb relative to Mo being 4.7by weight, wherein the adding quantity of Bi is varied (Sample Nos. N-Bi-5, N-Bi-17, N-Bi-29, N-Bi-41, N-Bi-53, N-Bi-65, N-Bi-77); a curve 8 indicates the current breaking property of the contact material with the added quantity of Nb relative to Mo being 9.4% by weight, wherein the adding quantity of Bi is varied (Sample Nos. N-Bi-6, N-Bi-18, N-Bi-30, N-Bi-42, N-Bi-54, N-Bi-66, N-Bi-78); a curve 9 is the current breaking property of the contact material with the added quantity of Nb relative to Mo being 18.9% by weight, wherein the adding quantity of Bi is varied (Sample Nos. N-Bi-7, N-Bi-19, N-Bi-31, N-Bi-43, N-Bi-55, N-Bi-67, N-Bi-79); a curve 10 indicates the current breaking property of the contact material with the added quantity of Nb relative to Mo being 28.5% by weight, wherein the adding quantity of Bi is varied (Sample Nos. N-Bi-8, N-Bi-20, N-Bi-32, N-Bi-44, N-Bi-56, N-Bi-68, N-Bi-80).

From FIG. 2, it may be seen that the contact materials of the present invention with their respective added quantity of Nb relative to Mo being 4.7% by weight, 9.4% by weight, 18.9% by weight, and 28.5% by weight (the curves 7, 8, 9 and 10) have more excellent current breaking property than that of the conventional Cu-25Cr alloy contact material, even when the adding quantity of Bi is 20% by weight. Further, in comparison with FIG. 1, the contact materials of the present invention with the added quantity of Nb relative to Mo being 4.7% by weight and 9.4% by weight, respectively, show their improved current breaking property.

Figure 3:
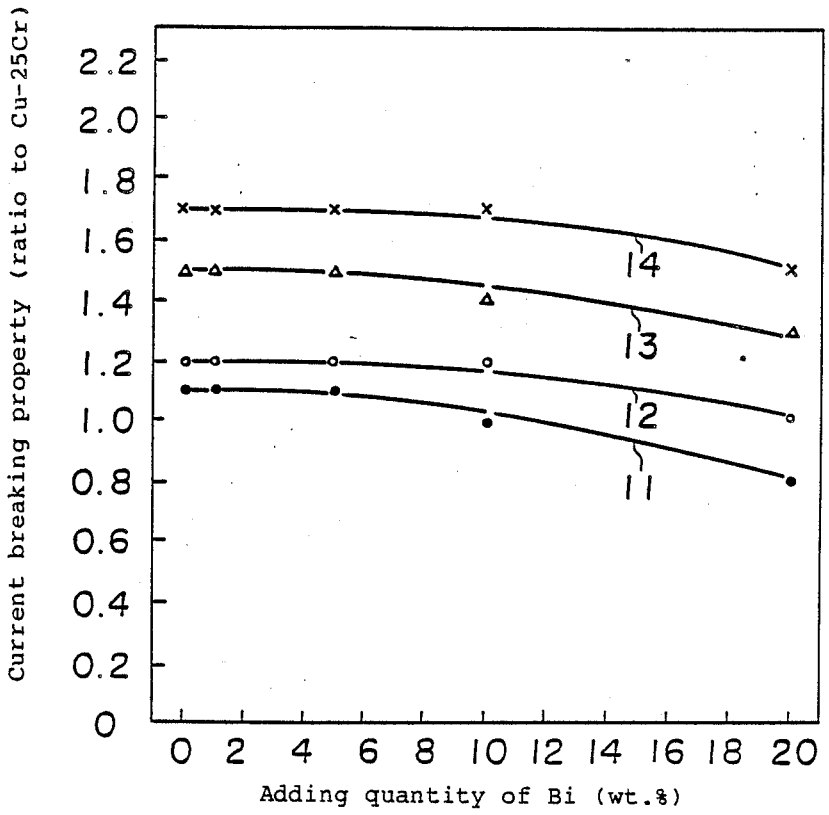

FIG. 3 is also a graphical representation showing the current breaking property of the contact materials according to the present invention, in which the current breaking property is expressed in terms of the contact material produced by the infiltration method with the amount of Cu being approximately 40% by weight. In the drawing, both axes of ordinate and abscissa denote the same entries as in FIG. 1. In the drawing, a curve 11 indicates the current breaking property of the contact material according to the present invention with the added quantity of Nb relative to Mo being 4.7% by weight, wherein the adding quantity of Bi is varied (Sample Nos. N-Bi-9, N-Bi-21, N-Bi-33, N-Bi-45, N-Bi-57, N-Bi-69, N-Bi-81); a curve 12 indicates the current breaking property of the contact material with the added quantity of Nb relative to Mo being 9.4% by weight, wherein the adding quantity of Bi is varied (Sample Nos. N-Bi-10, N-Bi-22, N-Bi-34, N-Bi-46, N-Bi-58, N-Bi-70, N-Bi-82); a curve 13 indicates the current breaking property of the contact material with the added quantity of Nb relative to Mo being 18.9% by weight, wherein the adding quantity of Bi is varied (Sample Nos. N-Bi-11, N-Bi-23, N-Bi-35, N-Bi-47, N-Bi-59, N-Bi-71, N-Bi-83); and a curve 14 indicates the current breaking property of the contact material with the added quantity of Nb relative to Mo being 28.5% by weight, wherein the adding quantity of Bi is varied (Sample Nos. N-Bi-12, N-Bi-24, N-Bi-36, N-Bi-48, N-Bi-60, N-Bi-72, N-Bi-84).

From FIG. 3, it may be seen that the contact materials of the present invention with their respective added quantities of Nb relative to Mo being 9.4% by weight, 18.9% by weight, and 28.5% by weight (the curves 12, 13 and 14 in the drawing) have the superior current breaking property to that of the conventional Cu-25Cr alloy contact material, even when the adding quantity of Bi is 20% by weight. It may also be seen that the contact material of the present invention with the added quantity of Nb relative to Mo being 4.7% by weight (the curve 11 in the drawing) has the superior current breaking property to that of the conventional Cu-25Cr alloy contact material, provided that the adding quantity of Bi does not exceeds 11.5% by weight. It may further be seen that, even when the adding quantity of Bi is above 11.5% by weight, the contact materials of the present invention are still more excellent, in respect of the same adding quantity of Bi, than the Cu-25Cr-Bi alloy contact material (vide: the curve 5 in FIG. 1). On the other hand, however, the current breaking property of the contact materials in FIG. 3 is generally low in comparison with that in FIG. 2. Further, when this FIG. 3 is compared with FIG. 1, the optimum current breaking property may be obtained on the alloy contact material with the Cu content being in the vicinity of 50% by weight.

In FIGS. 1, 2 and 3, on the other hand, it is seen that the degree of lowering in the current breaking property of the contact material, when the adding quantity of Bi is increased, tends to be smaller with the Cu content of 40% by weight than other constituent elements. Incidentally, it is to be added that, when comparing the contact material of the present invention (Sample Nos. N-Bi-1, through N-Bi-84) with the conventional Cu-Mo contact material (Sample No. M-1), all of the contact materials according to the present invention have more excellent current breaking property than the conventional Cu-Mo alloy contact material.

From the foregoing, it may be concluded that, when the added quantity of Nb relative to Mo is 9.4% by weight or above, the contact material of the present invention indicates more excellent current breaking property than the conventional Cu-25Cr alloy contact material within the Cu content ranging from 40 to 60% by weight, irrespective of the adding quantity of Bi; when the added quantity of Nb relative to Mo is 4.7% by weight, the contact material indicates more excellent current breaking property than the conventional Cu-25Cr alloy contact material with the adding quantity of Bi of up to 5% by weight in case the Cu content is 40% by weight, or with the adding quantity of Bi of up to 11.5% by weight in case the Cu content is 60% by weight; and when the added quantity of Nb relative to Mo is 4.7% by weight and the Cu content is 50% by weight, the contact material indicates more excellent current breaking property than the conventional Cu-25Cr alloy contact material, irrespective of the adding quantity of Bi. Therefore, when comparing the contact materials of the present invention with the conventional Cu-25Cr-Bi alloy contact material in respect of the same Bi content, all of the contact materials according to the present invention indicate their excellent current breaking property within the whole compositional range.

Moreover, from Table 5 below, it will be seen that the contact material according to the present invention is superior to the conventional Cu-25Cr alloy contact material in respect of the voltage withstand capability. More specifically, in respect of the contact material having the voltage withstand capability of 1 or below, when the Cu-25Cr-1Bi alloy contact material (Sample No. C-Bi-4) containing the same amount of Bi (1% by weight) as in the contact material of the present invention (Sample No. N-Bi-37, for example) is compared with the N-Bi-37 alloy contact material, the latter has its voltage withstand capability of 0.55 (a ratio to Cu-25Cr), in contrast to which the C-Bi-4 alloy contact material has its voltage withstand capability of 0.3 (a ratio to Cu-25Cr). From this, it is seen that the contact material of the present invention indicates more excellent voltage withstand capability than that of the conventional contact material.

The measurement of the voltage withstand capability of the contact material was done by repeating the following cycle of the steps in a number of times: (1) conduction of electric current; (2) no-load breaking; (3) application of high tension voltage; and (4) checking of presence or absence of electric discharge owing to application of high tension voltage. These four steps (1) to (4) constitute one cycle, and, by repeating this cycle in a number of times, a voltage withstand value was calculated from (the number of cycle, at which the electric discharge occurred)/(the total number of the cycle), based on which calculation the voltage application was adjusted so that the probability of the electric discharge may become 50%. Table 5 below indicates the voltage withstand value of the contact materials according to the present invention with the voltage value to bring about 50% discharge probability in the conventional Cu-25Cr alloy contact material as the reference. In this measurement, the current conduction, the space interval between the contacts, and other conditions were set same.

Figures 1, 4:
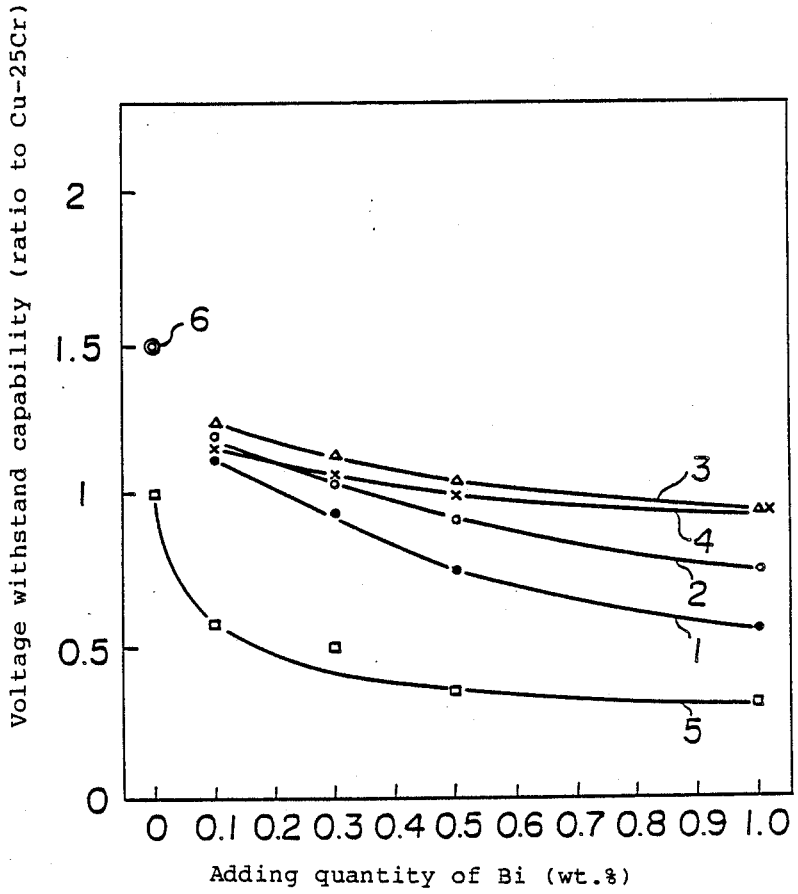
FIGS. 4, 5 and 6 are graphical representations showing the voltage withstand capability of the contact materials produced by the infiltration method according to one example of the present invention.
Figures 2, 4:
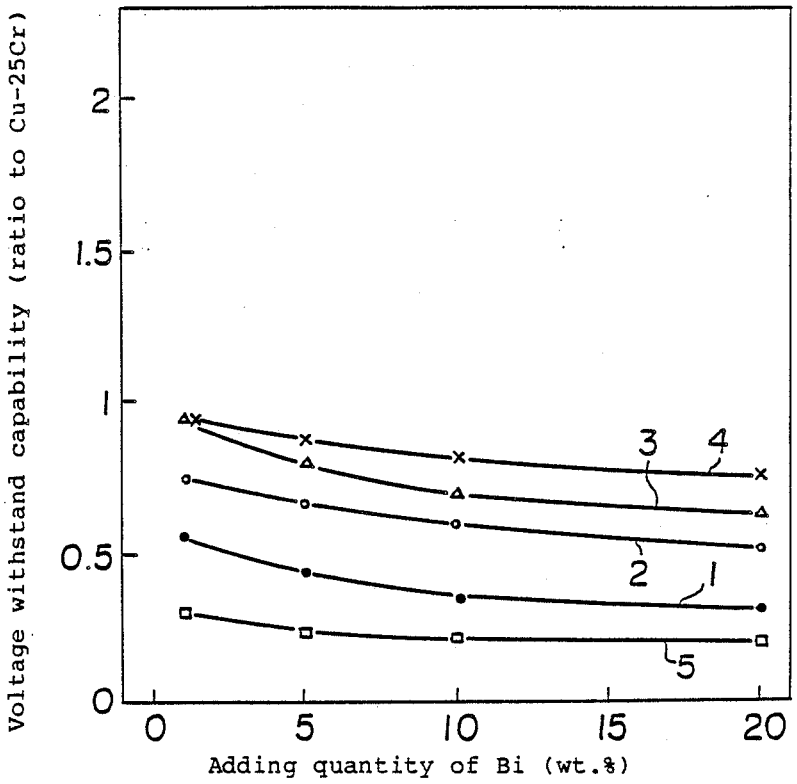

FIG. 4 is a graphical representation showing the voltage withstand capability of the contact material according to the present invention produced by the infiltration method with the Cu content being 60% by weight, in which the ordinate axis denotes the voltage withstand capability of the contact material of the present invention with the voltage withstand capability of the conventional Cu-25Cr alloy contact material being made the reference, and the abscissa axis shows the adding quantity of Bi. Incidentally, it should be noted that, for the purpose of indicating variations in the voltage withstand capability owing to addition of varying amount of Bi, the graphical representation is divided into FIG. 4-1 and FIG. 4-2 at the point of the Bi adding quantity of 1% by weight. In these divided graphical representations, the curves 1 to 5 and the double-circle 6 are for the same contact materials as those shown in FIG. 1.

From FIGS. 4-1 and 4-2, it may be seen that the contact materials of the present invention (the curves 1, 2, 3 and 4) are superior to the conventional Cu-25Cr-Bi alloy contact material (the curve 5). It may be seen further that, in comparison with the conventional Cu-25Cr alloy contact material, the contact materials of the present invention have their superior voltage withstand capability to that of the conventional Cu-25Cr alloy contact material, when the contact material has its added quantity of Nb relative to Mo of 4.7% by weight and the adding quantity of Bi is up to 0.2% by weight; when the contact material has its added quantity of Nb relative to Mo of 9.4% by weight and the adding quantity of Bi is up to 0.35% by weight; when the contact material has its added quantity of Nb relative to Mo of 18.9% by weight and the adding quantity of Bi is up to 0.5% by weight; and when the contact material has its added quantity of Nb relative to Mo of 28.5% by weight and the adding quantity of Bi is up to 0.65% by weight. Further, it may be seen from FIGS. 4-1 and 4-2 that the contact materials with more quantity of addition of Nb relative to Mo indicate a small degree of decrease in the voltage withstand capability owing to increase in the adding quantity of Bi.

Figures 1, 5:
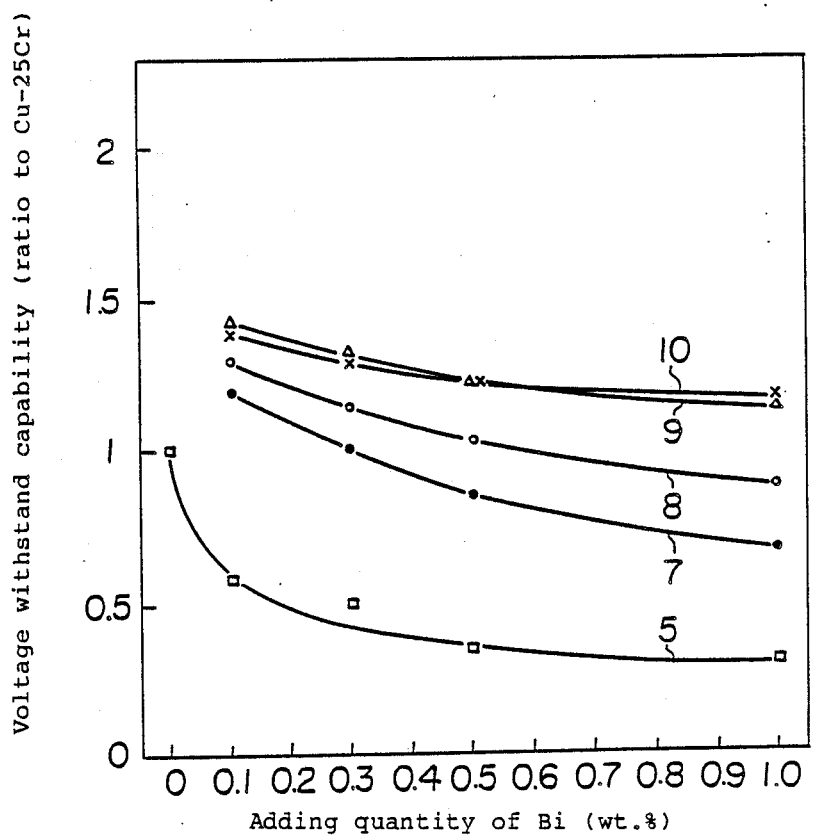
Figures 2, 5:
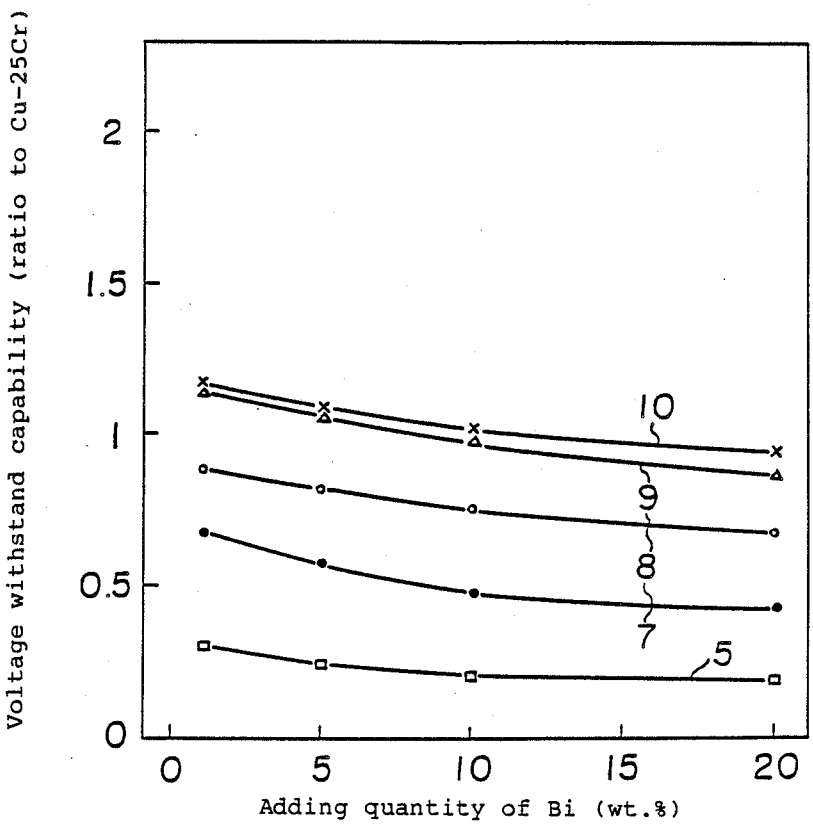

FIG. 5 is a graphical representation showing the voltage withstand capability of the contact material according to the present invention produced by the infiltration method with the Cu content being 50% by weight, in which both axes of ordinate and abscissa denote the same entries as in FIGS. 4-1 and 4-2. It is to be noted that, same as in FIG. 4, this graphical representation of FIG. 5 is divided into FIGS. 5-1 and 5-2 at the point of the Bi adding quantity of 1% by weight, and that the curves 7 to 10 are for the same contact materials as in FIG. 2.

From FIGS. 5-1 and 5-2, it may be seen that the contact materials of the present invention (the curves 7, 8, 9 and 10) are superior to the conventional Cu-25Cr-Bi alloy contact material (the curve 5). It may be seen further that, in comparison with the conventional Cu-25Cr alloy contact material, the contact materials of the present invention have their superior voltage withstand capability to that of the conventional Cu-25Cr alloy contact material, when it has the added quantity of Nb relative to Mo of 4.7% by weight and contains up to 0.3% by weight of the added Bi; when it has the added Nb relative to Mo of 9.4% by weight and contains up to 0.55% by weight of the added Bi; when it has the added quantity of Nb relative to Mo of 18.9% by weight and contains up to 8% by weight of the added Bi; and when it has the added Nb relative to Mo of 28.5% by weight contains up to 11.5% by weight of added Bi. Further, it may be seen from FIGS. 5-1 and 5-2 that the contact materials with more added quantity of Nb relative to Mo indicate a small degree of decrease in the voltage withstand capability due to increase in the adding quantity of Bi, as FIGS. 4-1 and 4-2 show. Moreover, when FIGS. 4-1 and 4-2 are compared with FIGS. 5-1 and 5-2, the latter graphical representations indicate, in general, a higher voltage withstand capability than the former, which appears to be due to the quantity of Cu in the contact materials according to the present invention. In other words, it may be said that the contact material having the Cu content of 50% by weight is more excellent in its voltage withstand capability than the contact material having the Cu content of 60% by weight.

Figures 1, 6:
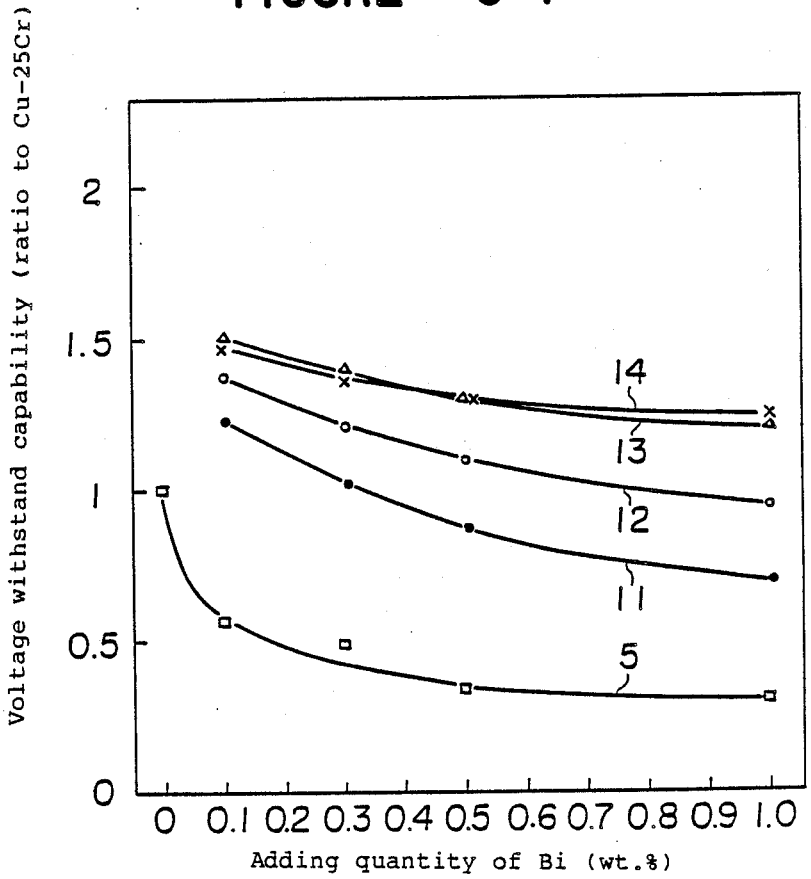
Figures 2, 6:
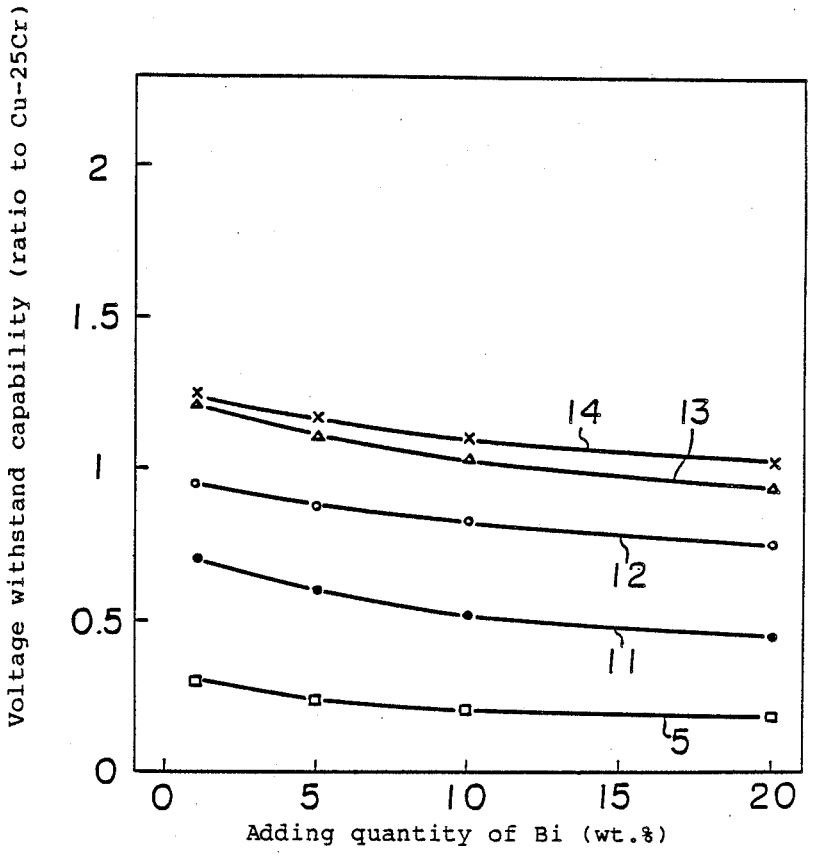

FIG. 6 is a graphical representation showing the voltage withstand capability of the contact materials according to the present invention produced by the infiltration method with the Cu content being 40% by weight, in which both axes of ordinate and abscissa denote the same entries as in FIGS. 4-1 and 4-2, and the curves 11 to 14 are for the same contact materials as in FIG. 3. In the same way as in FIG. 4, this graphical representation of FIG. 6 is divided into FIGS. 6-1 and 6-2 at the point of the Bi adding quantity of 1% by weight.

From FIGS. 6-1 and 6-2, it may be seen that the contact materials of the present invention (the curves 11, 12, 13 and 14) are superior to the conventional Cu-25Cr-Bi alloy contact material (the curve 5). It may be seen further that, in comparison with the conventional Cu-25Cr alloy contact material, the contact materials of the present invention are superior in their voltage withstand capability, when it contains up to 0.32% by weight of the added Bi content against the added Nb content of 4.7% by weight relative to Mo; when it contains up to 0.75% by weight of the added Bi content against the added Nb quantity of 9.4% by weight relative to Mo; when it contains up to 12% by weight of the added Bi content against the added Nb content of 18.9% by weight relative to Mo; and when it contains up to 20% by weight of the added Bi content against the added Nb content of 28.5% by weight relative to Mo. Further, it may be seen from FIGS. 6-1 and 6-2 that the contact materials with more added quantity of Nb relative to Mo indicate a small degree of decrease in the voltage withstand capability due to increase in the adding quantity of Bi. Moreover, when FIGS. 5-1 and 5-2 are compared with FIGS. 6-1 and 6-2, the latter graphical representations indicate, in general, a higher voltage withstand capability than the former. When the above-mentioned comparison between FIGS. 4-1 and 4-2 and FIGS. 5-1 and 5-2 is taken together, it will be seen that the contact materials of less Cu content (i.e., the Cu content of 40% by weight) are superior in their voltage withstand capability.

From Table 5 below, it will be seen that the contact materials of the present invention produced by the infiltration method (Sample Nos. N-Bi-1 through N-Bi-84) depend, in their chopping current value, on the adding quantity of Bi. The effect of addition of Bi emerges at about 1% by weight or so, and, thenceforward, the chopping current value decreases with increase in the adding quantity of Bi. The principal component which affects the chopping current value is Bi, the other components of Cu, Mo, and Nb having no remarkable influence on the chopping current value within their compositional ranges in the contact materials of the present invention. As for the melt-adhesion and peeling force, the contact materials of the present invention indicate considerable effect with the adding quantity of Bi of 0.1% by weight, beyond which the measured value thereof indicates zero (0). The measurement of the melt-adhesion and peeling force was done by first conducting electric current of 12.5 kA for three seconds in the state of the contacts of a vacuum switch which had been assembled in a circuit breaker being closed, and then the vacuum switch was removed from the circuit breaker to measure the melt-adhesion and peeling force between the contacts by means of a tension tester. In Table 5 below, the numeral zero (0) appearing in the column of "Melt-Adhesion and Peel Force" should be understood such that no melt-adhesion took place at the time of test by the tension tester, or the contacts were separated during their handling for the test owing to very small melt-adhesion and peeling force. As for the power consumption at the contact points, it is seen from Table 5 below that, irrespective of the adding quantity of Bi, the contact materials according to the present invention produced by the infiltration method are superior to the conventional Cu-25Cr alloy contact material. This superiority is considered due to the function of the component elements, in particular, Mo, Nb and Cu, constituting the contact materials. As the consequence, the contact materials according to the present invention exhibit their effect for the chopping current value at 1% by weight or above of the added Bi content, their effect for the melt-adhesion and peeling force at 0.1% by weight or above of the added Bi content, and their effect for the power consumption at the contact points with the compositional range of Cu, Mo, Nb and Bi contained in the contact materials as shown in Table 1 below (i.e., the Cu content ranging from 40 to 60% by weight; the Nb added quantity relative to Mo ranging from 4.7 to 28.5% by weight; and the Bi content ranging from 0.1 to 20% by weight).

From the above, it is seen that the contact materials according to the present invention produced by the infiltration method exhibit good properties within their compositional range of Cu of from 40 to 60% by weight; Mo of from 28.6 to 57.2% by weight; Nb of from 1.9 to 17.1% by weight; and Bi of from 0.1 to 20% by weight.

Table 5 below also shows, as Sample Nos. N-Bi-85 through N-Bi-132, various properties of the contact materials according to the present invention produced by the second method of powder sintering. As to the current breaking property, it will be seen clearly from Table 5 below that all the contact materials, except for Sample No. N-Bi-129, have their superior current breaking property to that of the conventional Cu-25Cr alloy contact material (Sample No. C-1). Even the contact material of Sample No. N-Bi-129 is seen to exhibit its superior current breaking property, when it is compared with the contact material of Sample No. C-Bi-7, on the basis of the same adding quantity of Bi.

Figure 7:
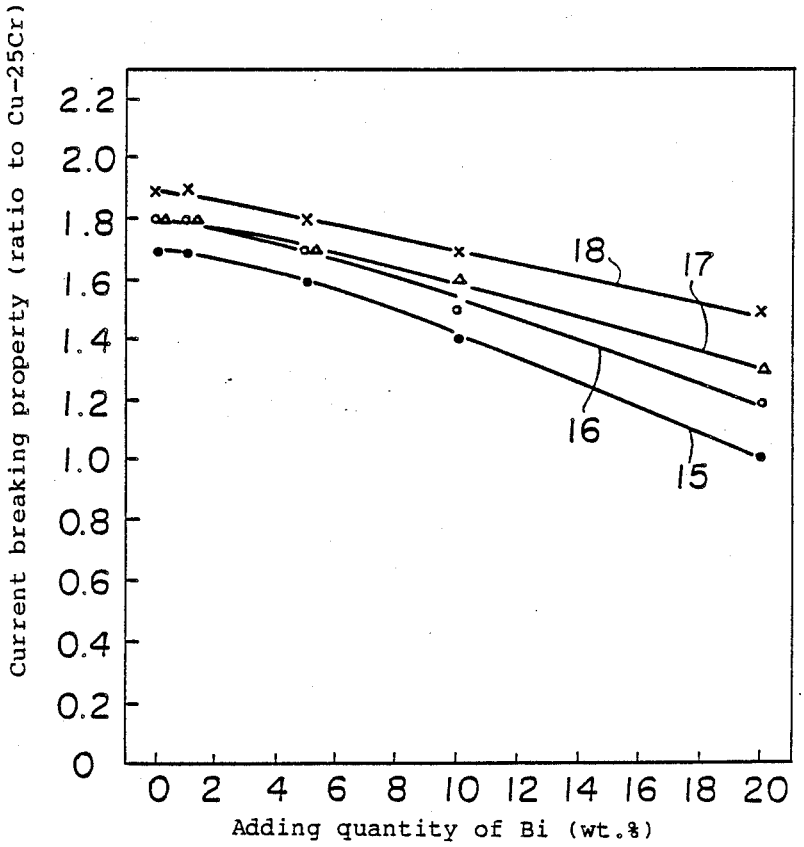
FIGS. 7 and 8 are graphical representations showing the current breaking property of the contact materials produced by the powder sintering method according to another example of the present invention.

FIG. 7 shows the current breaking property of the contact material according to the present invention produced by the powder sintering method with the Cu content of 75% by weight, in which the ordinate represents the current breaking property with the property of the conventional Cu-25Cr alloy contact material as the reference and the abscissa denotes the adding quantity of Bi. In the graphical representation of FIG. 7, a curve 15 indicates the current breaking property of the contact materials, in which the added quantity of Nb relative to Mo is 4.7% by weight and the adding quantity of Bi is varied (Sample Nos. N-Bi-85, N-Bi-93, N-Bi-101, N-Bi-109, N-Bi-117, N-Bi-125); a curve 16 indicates the current breaking property of the contact materials, in which the added quantity of Nb relative to Mo is 9.4% by weight and the adding quantity of Bi is varied (Sample Nos. N-Bi-86, N-Bi-94, N-Bi 102, N-Bi-110, N-Bi-118, N-Bi-126); a curve 17 indicates the current breaking property of the contact materials, in which the added quantity of Nb relative to Mo is 18.9% by weight and the adding quantity of Bi is varied (Sample Nos. N-Bi-87, N-Bi-95, N-Bi-103, N-Bi-111, N-Bi-119, N-Bi-127); and a curve 18 indicates the current breaking property of the contact materials, in which the added quantity of Nb relative to Mo is 28.5% by weight and the adding quantity of Bi is varied (Sample Nos. N-Bi-88, N-Bi-96, N-Bi-104, N-Bi-112, N-Bi-120, N-Bi-128).

From FIG. 7, it is seen that the contact materials of the present invention exhibit more excellent properties than the conventional Cu-25Cr alloy contact material in respect of the current breaking property, although the property thereof is seen to decrease with increase in the adding quantity of Bi. It is also seen that the contact materials of the present invention produced by the powder sintering method with the Cu content being 75% by weight have their superior current breaking property, with the added quantity of Nb relative to Mo being in a range of from 4.7 to 28.5% by weight and the adding quantity of Bi being up to 20% by weight.

Figure 8:
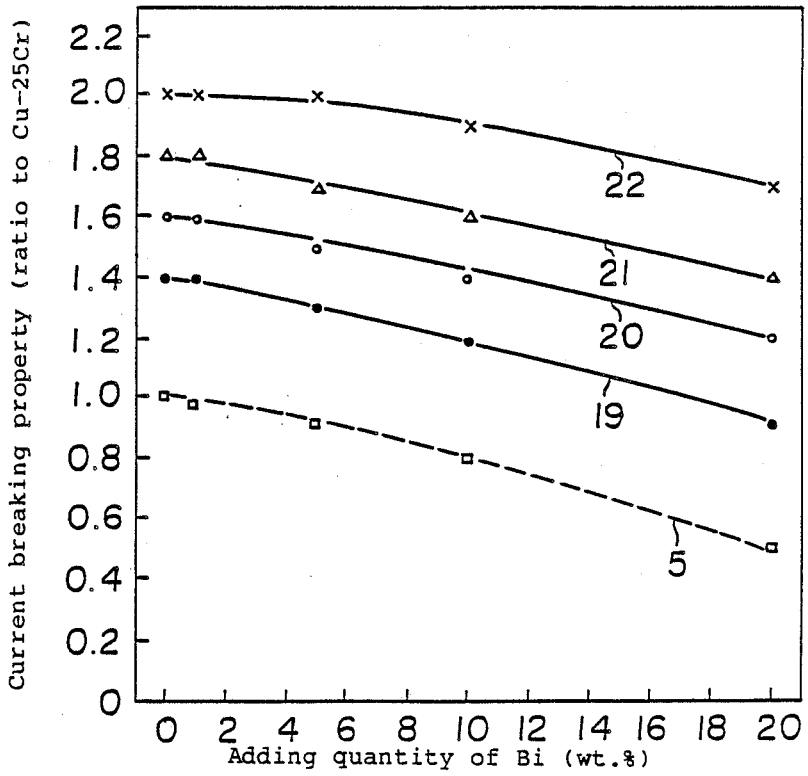

FIG. 8 shows the current breaking property of the contact materials of the present invention produced by the powder sintering method with the Cu content being 60% by weight, in which the ordinate and the abscissa denote the same entries as in FIG. 7. In the drawing, a curve 19 indicates the current breaking property of the contact materials, in which the added quantity of Nb relative to Mo is 4.7% by weight and the adding quantity of Bi is varied (Sample Nos. N-Bi-89, N-Bi-97, N-Bi-105, N-Bi-113, N-Bi-121, N-Bi-129); a curve 20 indicates the current breaking property of the contact materials, in which the added quantity of Nb relative to Mo is 9.4% by weight and the adding quantity of Bi is varied (Sample Nos. N-Bi-90, N-Bi-98, N-Bi-106, N-Bi-114, N-Bi-122, N-Bi-130); a curve 21 indicates the current breaking property of the contact materials, in which the added quantity of Nb relative to Mo is 18.9% by weight and the adding quantity of Bi is varied (Sample Nos. N-Bi-91, N-Bi-99, N-Bi-107, N-Bi-115, N-Bi-123, N-Bi-131); and a curve 22 indicates the current breaking property of the contact materials, in which the added quantity of Nb relative to Mo is 28.5% by weight and the adding quantity of Bi is varied (Sample Nos. N-Bi-92, N-Bi-100, N-Bi-108, N-Bi-116, N-Bi-124, N-Bi-132).

From FIG. 8, it may be seen that the contact materials according to the present invention having the added Nb content relative to Mo of 9.4, 18.9 and 28.5% by weight exhibit their excellent current breaking property in comparison with the conventional Cu-25Cr contact material, although their current breaking property decreases with increase in the adding quantity of Bi. It may also be seen that even the contact materials having the added quantity of Nb relative to Mo of 4.7% by weight show excellent current breaking property, if the quantity of addition of Bi does not exceeds 17% by weight. It may further be seen that the contact materials of the present invention having the added quantity of Nb relative to Mo of 4.7% by weight have sufficiently superior property when they are compared with the conventional Cu-25Cr-Bi alloy contact material (the curve 5) added with the same amount of Bi as in the above-mentioned contact material of the present invention. As to the difference in the current breaking property due to the difference in the Cu content, it may be seen from FIGS. 7 and 8 that the contact materials having the added Nb content relative to Mo of 4.7% by weight and 9.4% by weight exhibit their superior current breaking property with the Cu content of 75% by weight in the case of small adding quantity of Bi, and the difference in the current breaking property tends to be small with increase in the adding quantity of Bi, or to be substantially eliminated; on the other hand, the contact materials having the added Nb content relative to Mo of 18.9% by weight and 28.5% by weight exhibit their current breaking property which is equal to, or higher than, that of the conventional contact material, when the Cu content is 60% by weight. However, the contact materials having the Cu content of 60% by weight show a small degree of decrease in the current breaking property due to increase in the adding quantity of Bi.

From the foregoing, it may be concluded that, if the added Nb content relative to Mo is 9.4% by weight or more, the contact materials of the present invention indicate superior current breaking property to the conventional Cu-25Cr contact material within a range of the Cu content of from 60 to 75% by weight, without depending on the adding quantity of Bi; also, when the added Nb content relative to Mo is 4.7% by weight, the contact materials of the present invention indicate superior current breaking property to the conventional Cu-25Cr alloy contact material with the Cu content of 75% by weight, without depending on the adding quantity of Bi; and when the Cu content is 60% by weight, the contact materials of the present invention indicate more excellent current breaking property than the conventional Cu-25Cr alloy contact material with the adding quantity of Bi of up to 17% by weight. When the contact materials of the present invention are compared with the conventional Cu-25Cr-Bi alloy contact material, in respect of the same Bi content, the contact materials of the present invention have their superior current breaking property to the conventional one in their whole compositional range.

Figures 1, 9:
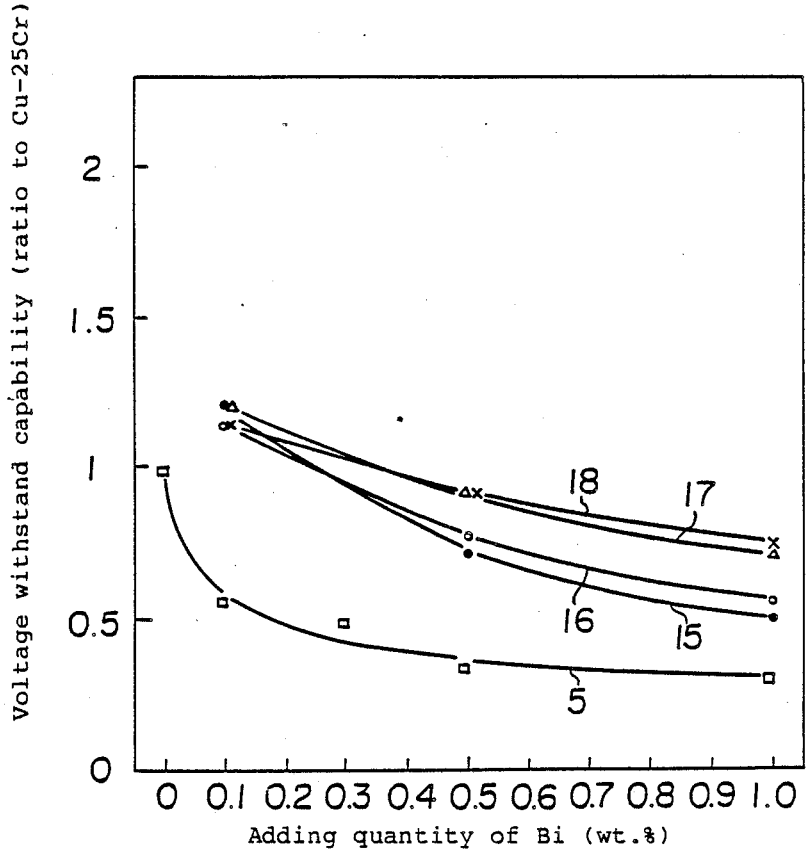
FIGS. 9 and 10 are graphical representations showing the voltage withstand capability of the contact materials produced by the powder sintering method according to another example of the present invention.
Figures 2, 9:
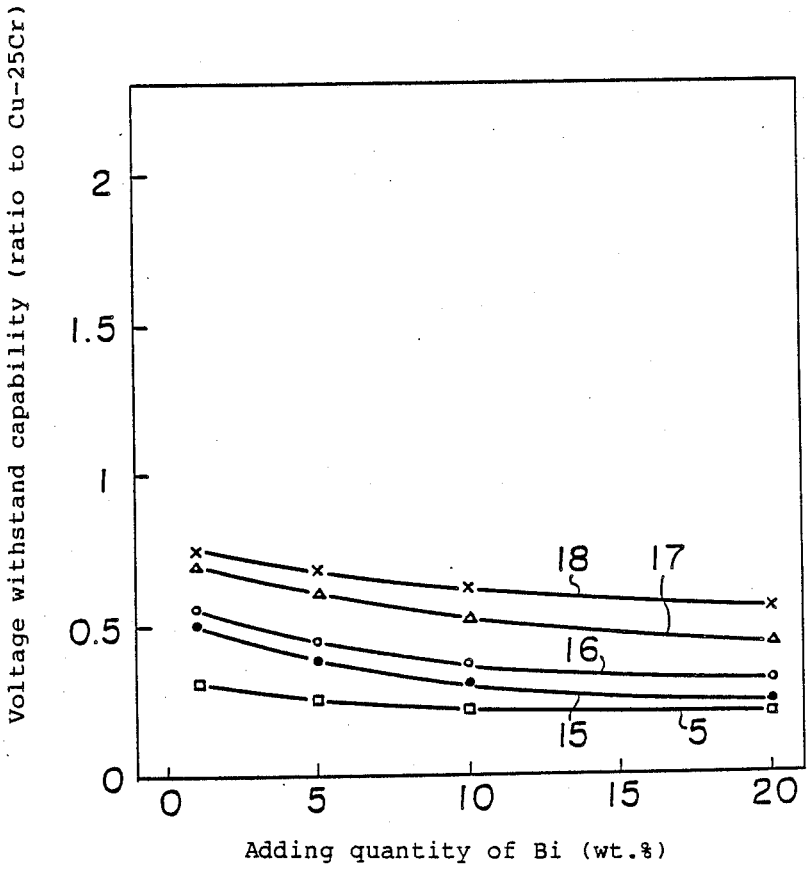

It may be further seen from Table 5 below that, with respect to the voltage withstand capability, the contact materials of the present invention produced by the powder sintering method, when the adding quantity of Bi is small, exhibit their superiority to the conventional Cu-25Cr alloy contact material FIG. 9 is a graphical representation showing the voltage withstand capability of the contact materials according to the present invention obtained by the powder sintering method with the Cu content of 75% by weight, in which the ordinate represents the voltage withstand capability with the capability of the conventional Cu-25Cr alloy contact material as the reference and the abscissa denotes the adding quantity of Bi. Incidentally, in the same manner as in FIG. 4 above, the graphical representation of FIG. 9 is divided into FIGS. 9-1 and 9-2 at the point of 1% by weight of the Bi content. In these graphical representations, the curves 15 to 18 are for the same contact materials as in FIG. 7.

From FIGS. 9-1 and 9-2, it may be seen that the contact materials of the present invention (the curves 15, 16, 17 and 18) possess their superior voltage withstand capability to that of the conventional Cu-25Cr-Bi alloy contact material (the curve 5). It may further be seen that the contact materials of the present invention having the added Nb content relative to Mo of 4.7% by weight are more excellent in their voltage withstand capability than the conventional Cu-25Cr contact material with the adding quantity of Bi of up to 0.25% by weight; the contact materials having the added Nb content relative to Mo of 9.4% by weight are more excellent than the conventional contact material with the adding quantity of Bi of up to 0.23% by weight; the contact materials having the added Nb content relative to Mo of 18.9% by weight are more excellent than the conventional contact material with the adding quantity of Bi of up to 0.35% by weight; and the contact materials having the added Nb content relative to Mo of 28.5% by weight are more excellent than the conventional contact material with the adding quantity of Bi of up to 0.32% by weight. Further, from FIGS. 9-1 and 9-2, it may be seen that the contact material having more Nb content relative to Mo shows a small degree of lowering in the voltage withstand capability due to increase in the adding quantity of Bi.

Figures 1, 10:
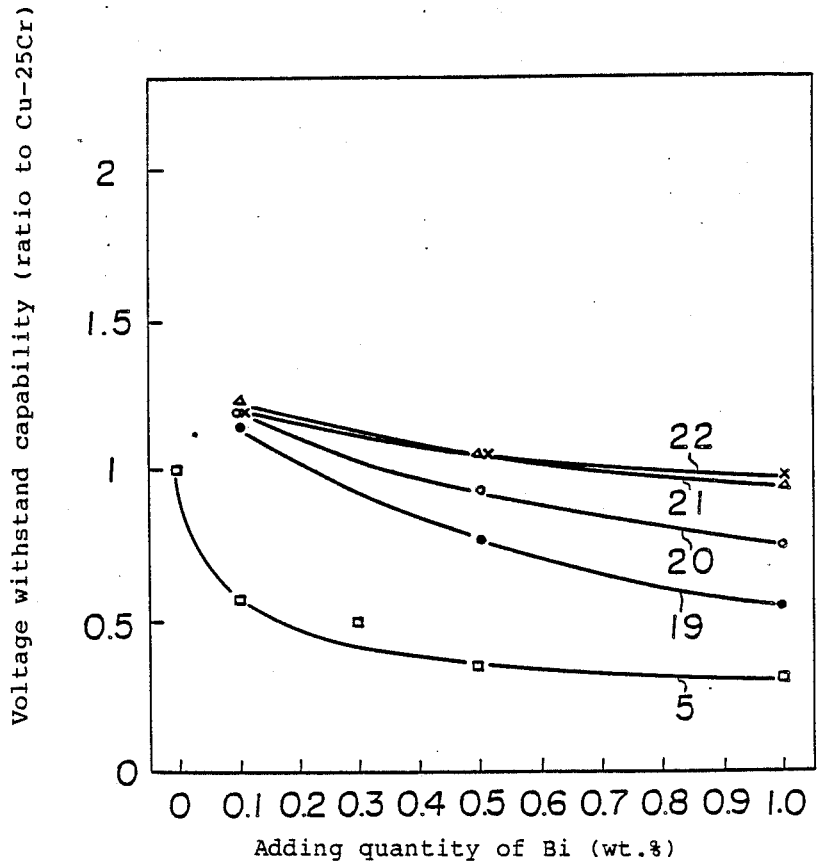
Figures 2, 10:
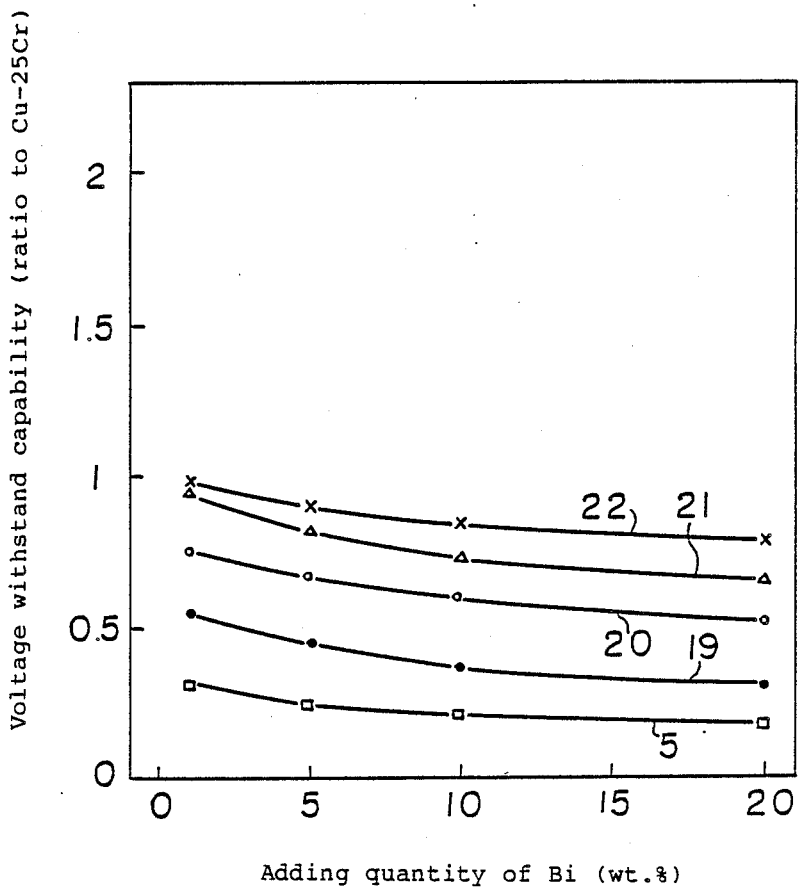

FIG. 10 is a graphical representation showing the voltage withstand capability of the contact materials according to the present invention obtained by the powder sintering method with the Cu content of 60% by weight, in which both ordinate and abscissa denote the same entries as in FIG. 9 above. Also, the graphical representation of FIG. 10 is divided into FIGS. 10-1 and 10-2 at the point of the Bi content of 1% by weight. In these graphical representations, the curves 19 to 22 are for the same contact materials as in FIG. 8.

From FIGS. 10-1 and 10-2, it is seen that the contact materials of the present invention (the curves 19, 20, 21 and 22) have their excellent voltage withstand capability over that of the conventional Cu-25Cr-Bi alloy contact material (the curve 5). It may be further seen that the contact materials of the present invention having the added Nb content relative to Mo of 4.7% by weight indicate their superior voltage withstand capability to the conventional Cu-25Cr alloy contact material with the adding quantity of Bi of up to 0.22% by weight; the contact materials having the added Nb content relative to Mo of 9.4% by weight are more excellent than the conventional contact material with the adding quantity of Bi of up to 0.35% by weight; the contact materials having the added Nb content relative to Mo of 18.9% by weight are more excellent than the conventional contact material with the adding quantity of Bi of up to 0.65% by weight; and the contact materials having the added Nb content relative to Mo of 28.5% by weight are more excellent than the conventional contact material with the adding quantity of Bi of up to 0.75% by weight. Further, from FIGS. 10-1 and 10-2, it may be seen that the contact material having more Nb content relative to Mo shows a small degree of lowering in the voltage withstand capability due to increase in the adding quantity of Bi. Moreover, upon comparison between FIGS. 9-1 and 9-2 and FIGS. 10-1 and 10-2, it may be seen that the contact materials with the Cu content of 60% by weight indicate the higher voltage withstand capability than the contact materials with the Cu content of 75% by weight.

Furthermore, it may be seen from Table 5 below that the chopping current value of the contact materials according to the present invention produced by the powder sintering method (Sample Nos. N-Bi-85 through N-Bi-132) is dependent on the adding quantity of Bi. The effect of addition of Bi emerges at about 1% by weight or so, and, thenceforward, the chopping current value decreases with increase in the adding quantity of Bi. As for the melt-adhesion and peeling force, the contact materials of the present invention indicate considerable effect with the adding quantity of Bi of 0.1% by weight, beyond which the measured value thereof indicates zero (0). As for the power consumption at the contact points, the contact materials of the present invention obtained by the powder sintering method are not dependent on the adding quantity of Bi, but on the content of Cu and other components. Here, the contact materials of the present invention with the Cu content of 60% by weight show their excellent capability of the power consumption at the contact points, which is 0.2 to 0.3 times as low as that of the conventional Cu-25Cr alloy contact material, the capability of which is as equal as that of the contact material of the present invention obtained by the afore-mentioned infiltration method. On the other hand, the contact materials with the Cu content of 75% by weight have their capability of the power consumption at the contact points of 0.5 to 0.7 times as low as that of the conventional Cu-25Cr alloy contact material, from which it will be seen that, when the Cu content becomes less than 60% by weight, there can be observed not so conspicuous change in the power consumption at the contact points. When the contact materials of the present invention with the Cu content of 75% by weight are compared with the conventional Cu-25Cr alloy contact material or Cu-25Cr-Bi alloy contact material, the power consumption at the contact points of the contact materials according to the present invention is seen to be 0.5 to 0.7 times as low as that of the conventional contact materials, the difference of which is considered due to difference in the constituent elements of the contact materials. As the consequence of this, the contact materials of the present invention produced by the powder sintering method show their effect on the chopping current value with the adding quantity of Bi of 1% by weight or above, their effect on the melt-adhesion and peeling force with the adding quantity of Bi of 0.1% by weight or above, and their favorable capability on the power consumption at the contact points with the Cu content in a range of from 60 to 75% by weight, the added Nb content relative to Mo in a range of from 4.7 to 28.5% by weight, and the adding quantity of Bi in a range of from 0.1 to 20% by weight.

From the foregoing, it may be seen that the contact materials of the present invention produced by the powder sintering method indicate their favorable properties with the range of content of Cu being from 60 to 75% by weight, Mo being from 17.9 to 38.1% by weight, Nb being from 1.1 to 11.4% by weight, and Bi being from 0.1 to 20% by weight.

Table 5 below also shows various properties of the contact materials according to the present invention produced by the third method of the vacuum hot press, as Sample Nos. N-Bi-133 through N-Bi-180. As to the current breaking property, it will be seen clearly from Table 5 that all the contact materials have their superior current breaking property to that of the conventional Cu-25Cr alloy contact material.

FIG. 11 shows the current breaking property of the contact materials according to the present invention obtained by the vacuum hot press method with the Cu content of 75% by weight, in which the ordinate represents the current breaking property with the property of the conventional Cu-25Cr alloy contact material being made the reference, and the abscissa denotes the adding quantity of Bi. In the graphical representation of FIG. 11, a curve 23 indicates the current breaking property of the contact materials, in which the added quantity of Nb relative to Mo is 4.7% by weight and the adding quantity of Bi is varied (Sample Nos. N-Bi-133, N-Bi-141, N-Bi-149, N-Bi-157, N-Bi-165, N-Bi-173); a curve 24 indicates the current breaking property of the contact materials, in which the added quantity of Nb relative to Mo is 9.4% by weight and the adding quantity of Bi is varied (Sample Nos. N-Bi-134, N-Bi-142, N-Bi-150, N-Bi-158, N-Bi-166, N-Bi-174); a curve 25 indicates the current breaking property of the contact materials, in which the added quantity of Nb relative to Mo is 18.9% by weight and the adding quantity of Bi is varied (Sample Nos. N-Bi-135, N-Bi-143, N-Bi-151, N-Bi-159, N-Bi-167, N-Bi-175); and a curve 26 indicates the current breaking property of the contact materials, in which the added quantity of Nb relative to Mo is 28.5% by weight and the adding quantity of Bi is varied (Sample Nos. N-Bi-136, N-Bi-144, N-Bi-152, N-Bi-160, N-Bi-168, N-Bi-176).

From FIG. 11, it is seen that the contact materials of the present invention have more excellent current breaking property than the conventional Cu-25Cr alloy contact material, although the property thereof is seen to be lowered with increase in the adding quantity of Bi. It is also seen from FIG. 11 that the contact materials according to the present invention produced by the vacuum hot press method with the Cu content of 75% by weight have their superior current breaking property, in case the added quantity of Nb relative to Mo is in a range of from 4.7 to 28.5% by weight and the adding quantity of Bi is up to 20% by weight.

FIG. 12 shows the current breaking property of the contact materials according to the present invention produced by the vacuum hot press method with the Cu content of 60% by weight, in which the ordinate and the abscissa denote the same entries as in FIG. 11. In the drawing, a curve 27 indicates the current breaking property of the contact materials, in which the added quantity of Nb relative to Mo is 4.7% by weight and the adding quantity of Bi is varied (Sample Nos. N-Bi-137, N-Bi-145, N-Bi-153, N-Bi-161, N-Bi-169, N-Bi-177); a curve 28 indicates the current breaking property of the contact materials, in which the added quantity of Nb relative to Mo is 9.4% by weight and the adding quantity of Bi is varied (Sample Nos. N-Bi-138, N-Bi-146, N-Bi-154, N-Bi-162, N-Bi-170, N-Bi-178); a curve 29 indicates the current breaking property of the contact materials, in which the added quantity of Nb relative to Mo is 18.9% by weight and the adding quantity of Bi is varied (Sample Nos. N-Bi-139, N-Bi-147, N-Bi-155, N-Bi-163, N-Bi-171, N-Bi-179); and a curve 30 indicates the current breaking property of the contact materials, in which the added quantity of Nb relative to Mo is 28.5% by weight and the adding quantity of Bi is varied (Sample Nos. N-Bi-140, N-Bi-148, N-Bi-156, N-Bi-164, N-Bi-172, N-Bi-180).

From FIG. 12, it may be seen that the contact materials according to the present invention have their superior current breaking property to that of the conventional Cu-25Cr alloy contact material, although the property is lowered with increase in the adding quantity of Bi. Moreover, it may be seen from FIG. 12 that the contact materials of the present invention produced by the vacuum hot press method with the Cu content of 60% by weight possess their excellent current breaking property with the added Nb content relative to Mo ranging from 4.7 to 28.5% by weight and the adding quantity of Bi of up to 20% by weight. As to the difference in the current breaking property due to the difference in the Cu content, it may be seen from FIGS. 11 and 12 that such difference tends to be higher, in general, with the contact materials having the Cu content of 60% by weight.

From the foregoing, it may be concluded that the contact materials of the present invention having the Cu content in a range of from 60 to 75% by weight, the added Nb content relative to Mo in a range of from 4.7 to 28.5% by weight, and the adding quantity of Bi of up to 20% by weight have their excellent current breaking property in comparison with that of the conventional Cu-25Cr alloy contact material.

It may be seen further from Table 5 below that, respect with to the voltage withstand capability, the contact materials of the present invention produced by the vacuum hot press method, when the adding quantity of Bi is small, exhibit their superiority to the conventional Cu-25Cr alloy contact material.

FIG. 13 is a graphical representation showing the voltage withstand capability of the contact materials according to the present invention obtained by the vacuum hot press method with the Cu content of 75% by weight, in which the ordinate represents the voltage withstand capability with the property of the conventional Cu-25Cr contact alloy material being made the reference, and the abscissa denotes the adding quantity of Bi. Incidentally, in the same manner as in FIG. 4, the graphical representation of FIG. 13 is divided into FIGS. 13-1 and 13-2 at the point of 1% by weight of the Bi content. In the drawing, the curves 23 to 26 are for the same contact materials as in FIG. 11.

From FIGS. 13-1 and 13-2, it may be seen that the contact materials of the present invention (the curves 23, 24, 25 and 26) have their superior voltage withstand capability to that of the conventional Cu-25Cr-Bi contact material (the curve 5). It may further be seen that the contact materials of the present invention having the added Nb content relative to Mo of 4.7% by weight are more excellent in its voltage withstand capability than the conventional Cu-25Cr alloy contact material with the adding quantity of Bi of up to 0.23% by weight; the contact materials having the added Nb content relative to Mo of 9.4% by weight are more excellent than the conventional contact material with the adding quantity of Bi of up to 0.36% by weight; the contact materials having the added Nb content relative to Mo of 18.9% by weight are more excellent than the conventional contact material with the adding quantity of Bi of up to 0.5% by weight; and the contact materials having the added Nb content relative to Mo of 28.5% by weight are more excellent than the conventional contact material with the adding quantity of Bi of up to 0.4% by weight. Further, from FIGS. 13-1 and 13-2, it may be seen that the contact material having more Nb content relative to Mo shows a small degree of lowering in the voltage withstand capability due to the addition of Bi.

FIG. 14 is a graphical representation showing the voltage withstand capability of the contact materials according to the present invention obtained by the vacuum hot press method with the Cu content being 60% by weight, in which both ordinate and abscissa denote the same entries as in FIG. 13. Also, the graphical representation of FIG. 14 is divided into FIGS. 14-1 and 14-2 at the point of the Bi content of 1% by weight. In these graphical representations, the curves 27 to 30 are for the same contact materials as in FIG. 12.

From FIGS. 14-1 and 14-2, it may be seen that the contact materials of the present invention (the curves 27, 28, 29 and 30) have their excellent voltage withstand capability over that of the conventional Cu-25Cr-Bi alloy contact material (the curve 5). It may be further seen that the contact materials of the present invention having the added Nb content relative to Mo of 4.7% by weight indicate their superior voltage withstand capability to the conventional Cu-25Cr alloy contact material, when the adding quantity of Bi is up to 0.22% by weight; the contact materials having the added Nb content relative to Mo of 9.4% by weight are more excellent than the conventional contact material, when the adding quantity of Bi is up to 0.4% by weight; the contact materials having the added Nb content relative to Mo of 18.9% by weight are more excellent than the conventional contact material, when the adding quantity of Bi is up to 1% by weight; and the contact materials having the added Nb content relative to Mo of 28.5% by weight are more excellent than the conventional contact material, when the adding quantity of Bi is up to 0.42% by weight. Further, from FIGS. 14-1 and 14-2, it may be seen that the contact material having more added Nb content relative to Mo shows a small degree of lowering in the voltage withstand capability due to addition of Bi. Moreover, upon comparison between FIGS. 13-1 and 13-2 and FIGS. 14-1 and 14-2, it may be seen that the contact material with the Cu content of 60% by weight indicates the higher voltage withstand capability than the contact material with the Cu content of 75% by weight.

Furthermore, it may be seen from Table 5 below that the chopping current value of the contact materials according to the present invention produced by the vacuum hot press method (Sample Nos. N-Bi-133 through N-Bi-180) is dependent on the adding quantity of Bi. The effect of the addition of Bi emerges at about 1% by weight or so, and thenceforward, the chopping current value decreases with increase in the adding quantity of Bi. As for the melt-adhesion and peeling force, the contact materials of the present invention indicate considerable effect with the adding quantity of Bi of 0.1% by weight, beyond which the measured value thereof indicates zero (0). As for the power consumption at the contact points, the contact materials of the present invention are not dependent on the adding quantity of Bi, but on the content of Cu and other components. Here, the contact material of the present invention with the Cu content of 60% by weight indicate their excellent power consumption, which is 0.2 to 0.3 times as low as that of the conventional Cu-25Cr alloy contact material, as is the case with the contact materials of the present invention obtained by the powder sintering method, the capability of which is comparable with the property of the above-mentioned contact materials of the present invention. On the other hand, the contact materials with the Cu content of 75% by weight show their capability of the power consumption at the contact points of 0.5 to 0.7 times as low as that of the conventional Cu-25Cr alloy contact material, i.e. their capability is as equal as that of the contact materials obtained by the powder sintering method. From this, it will be seen that, when the Cu content becomes less than 60% by weight, there is seen not so remarkable change in the power consumption at the contact points. When the contact materials of the present invention with the Cu content of 75% by weight are compared with the conventional Cu-25Cr or Cu-25Cr-Bi contact material, the contact materials of the present invention show their power consumption, which is 0.5 to 0.7 times as low as that of the conventional contact material, the difference of which is considered due to difference in the constituent elements of the contact materials. Therefore, the contact materials of the present invention produced by the vacuum hot press method show their effect on the chopping current value when the adding quantity of Bi is 1% by weight or above, their effect on the melt-adhesion and peeling force when the adding quantity of Bi is 0.1% by weight or above, and their favorable property on the power consumption at the contact points when the Cu content is in a range of from 60 to 75% by weight, the added Nb content relative to Mo is in a range of from 4.7 to 28.5% by weight, and the adding quantity of Bi is in a range of from 0.1 to 20% by weight.

From the foregoing, it may be concluded that the contact materials of the present invention produced by the vacuum hot press method and having the Cu content in a range of from 60 to 75% by weight, the Mo content in a range of from 17.9 to 38.1% by weight, the Nb content in a range of from 1.1 to 11.4% by weight, and the Bi content in a range of from 0.1 to 20% by weight exhibit their favorable properties.

In passing, it should be noted that, although, in the foregoing examples of the present invention, explanations have been given on the contact materials produced by addition of Bi to the base alloy of Cu-Mo-Nb, those elements such as Te, Sb, Tl and Pb may be used in place of Bi, in which case one or more kinds of these low melting point materials may be added to the base alloy. Table 7 below indicates various samples containing these elements. In this Table 7, the compositional ratio was determined in reference to the afore-described examples, and the adding quantity of the low melting point material, for the samples, was set to be 20% by weight at the maximum, based on which condition the contact materials of the present invention were compared with the conventional contact materials. The method for production of these contact materials is as follows: Sample Nos. 1, 2 and 3 are obtained by the infiltration method; Sample Nos. 4 and 5 are obtained by the powder sintering method; and Sample Nos. 6 and 7 are obtained by the vacuum hot press method. The shape of the contacts and the method of their testing are the same as in the afore-described examples. The results of the measurement are shown in Table 8 below.

From Table 8, it is seen that the contact materials of the present invention added with the low melting point component of Te, Sb, Tl, Pb, Se and Bi-Te in an amount of 20% by weight (Sample Nos. N-Te-2, N-Te-3, N-Te-5, N-Te-7, N-Sb-2, N-Sb-3, N-Sb-5, N-Sb-7, N-Tl-2, N-Tl-3, N-Tl-5, N-Tl-7, N-Pb-2, N-Pb-3, N-Pb-5, N-Pb-7, N-BT-2, N-BT-3, N-BT-5, N-BT-7) have more excellent current breaking property than the conventional contact material of Sample No. C-B-7, and that these contact materials of the present invention are also excellent in respect of their voltage withstand capability. It is further seen that, depending on the kind of the low melting point compact, the contact materials containing therein Bi and Te indicate a relatively small degree of lowering in their current breaking property, and the contact materials containing therein Pb are inferior in such property among the contact materials of the present invention. Further, more excellent current breaking property can be attained by adding 20% by weight in total of both Bi and Te together, each being at 10% by weight, rather than by adding 20% by weight of single Bi or Te. The same effect can be expected of the other low-melting point components. On the other hand, it is seen from Table 8 below that the chopping current value, the melt-adhesion and peeling force, and the power consumption at the contact points are not so much dependent upon the low melting point components to be added.

Accordingly, the properties of the contact materials according to the present invnetion as shown in Table 8 are considered to be essentially same as the contact materials added with Bi which are shown in Tables 1, 2 and 3. That is to say, the contact materials produced by the infiltration method exhibit their excellent properties with the content of Cu in the range of from 40 to 60% by weight, Nb relative to Mo in the range of from 4.7 to 28.5% by weight (i.e., the Mo content of from 28.6 to 57.2% by weight and the Nb content of from 1.9 to 17.1% by weight), and one or more kinds of the low melting point materials such as Te, Sb, Tl, Pb, and Bi in the range of from 0.1 to 20% by weight; and the contact materials produced by the powder sintering method or the vacuum hot press method exhibit their excellent properties with the content of Cu in the range of from 60 to 75% by weight, Nb relative to Mo in the range of from 4.7 to 28.5% by weight (i.e., the Mo content of from 17.9 to 38.1% by weight and the Nb content of from 1.1 to 11.4% by weight), and one or more kinds of the low melting point material such as Te, Sb, Tl, Pb and Bi of up to 20% by weight.

In the foregoing, the explanations have been made as to the contact materials according to the present invention with the Cu content of from 40 to 75% by weight, the Mo content of from 17.9 to 57.2% by weight, the Nb content of from 1.1 to 17.1% by weight, and one or more kinds of the low melting point materials of from 0.1 to 20% by weight. However, the compositional range of the practically useful contact materials is considered to be much broader. That is to say, there may be contemplated those contact materials having the Cu content of from 30 to 80% by weight, the Nb content relative to Mo of from 2 to 35% by weight (i.e., the Mo content of from 13 to 68.6% by weight and the Nb content of from 0.4 to 24.5% by weight), and the content of one or more of the low melting point materials of from 0.05 to 25% by weight, and any arbitrary alloy materials are able to be chosen within these compositional ranges depending on their use.

As has been mentioned in the foregoing, since the first Example of the present invention utilizes the contact materials composed of Cu, Mo, Nb and one or more kinds of the low melting point materials as the electrodes for the vacuum circuit breaker, the resulting vacuum circuit breaker has excellent operating characteristics.

EXAMPLE 2

(Production of Contact Materials)

The contact materials were produced in accordance with the powder metallurgy using the three methods of "infiltration", "complete powder sintering"; and "hot pressing".

Production of the contact material according to the first method infiltration was carried out in such a manner that molybdenum powder having particle size of 3 m in average, tantalum powder having a particle size of 40 μm or below, copper powder having a particle size of 40 μm or below, and bismuth powder having a particle size of 75 μm or below were weighed at their respective ratios of 67.6:13.9:18.0:0.5, followed by mixing the ingredients for two hours; subsequently, this mixed powder was filled in a metal mold of a predetermined configuration and subjected to shaping under a pressure of 1 ton/cm$^2$; thereafter, a mass of oxygen-free copper was placed on this shaped body, which was held for one hour in the hydrogen atmosphere at a temperature of 1250° C. to thereby obtain the contact material with the oxygen-free copper having been impregnated into the shaped body. The ultimate compositional ratio of this contact material is indicated in Table 9 below, where it is indicated as "Sample No. T-Bi-18". Incidentally, this Table 9 lists other contact materials of various compositional ratios, which were produced by the same method as described above.

Production of the contact material according to the second method of complete powder sintering was carried out in such a manner that molybdenum powder having an average particle size of 3 μm, tantalum powder having a particle size of 40 μm or below, copper powder having a particle size of 75 μm or below, and bismuth powder having a particle size of 75 μm or below were weighed at their respective ratios of 36.5:3.5:59.9:0.1, followed by mixing the ingredients for two hours; subsequently, this mixed powder was filled in a metal mold of a predetermined configuration and subjected to shaping under a pressure of 3.3 tons/cm$^2$; thereafter, this press-formed body was sintered for two hours in the hydrogen atmosphere at a temperature immediately below the melting point of copper, whereby the intended contact material was obtained. The ultimate compositional ratio of this contact material is indicated in Table 10, where it is indicated as "Sample No. T-Bi-89" By the way, this Table 10 also lists other contact materials of different compositional ratios, which were produced by the same method as described above Production of the contact material according to the third method of hot pressing was carried out in such a manner that molybdenum powder having an average particle size of 3 μm, niobium powder having a particle size of 40 μm or below, copper powder having a particle size of 75 μm or below, and bismuth powder having a particle size of 75 μm or below were weighed at their respective ratios of 36.5 : 3.5 : 59.9 : 0.1, followed by mixing the ingredients for two hours; subsequently, this mixed powder was filled in a dice made of carbon and then subjected to heating in the vacuum for two hours at a temperature of 1,000° C., during which a pressure of 200 kg/cm$^2$ was applied to the mixed powder by means of the hot press device, thereby obtaining a mass of the contact material The ultimate compositional ratio of the thus obtained contact material is shown in Table 11 below, where it is indicated as "Sample No. T-Bi-137" By the way, this Table 11 also indicates other contact materials of different compositional ratios, which were produced by the same method as described above Also, for the purpose of comparing the properties with the contact materials according to the present invention, the compositional ratios of the contact materials which have heretofore been used are shown in Table 12 below. The same method of the complete powder sintering as described above was used for the production of these conventional contact materials.

(Properties of Contact Materials)

The above-described contact materials produced in accordance with each of the afore-described various methods in the powder metallurgy were machine-processed into electrodes, each having 20 mm in diameter. Each of these electrodes were then assembled into a vacuum circuit breaker to measure its electrical properties. The results of measurement are shown in Table 13 below. The measurements were carried out on the current breaking property, voltage withstand capability, chopping current value, melt-adhesion and peeling force, and power consumption at the contact points. The results are expressed in terms of magnification with the properties of the conventional Cu-25Cr alloy (the sample C-1 in Table 12) as the reference. For the current breaking capability, therefore, a higher magnification indicates superiority; and the contact point having its magnification of 1 or above indicates that it possesses more excellent current breaking property than the conventional Cu-25Cr alloy. With regard to the voltage withstand capability, the same thing as that of the current breaking property can be said, i.e., a higher magnification indicates superiority. On the other hand, the chopping current value should desirably be lower in its magnification from the standpoint of its use, hence a lower magnification indicates superiority. In the same manner, a lower magnification of the melt-adhesion and peeling force may be advantageous from the view point of the operating mechanism, and a lower magnification should also be desirable concerning the power consumption at the contact point; therefore, lower values of the magnification for both properties indicate superiority.

From Table 13, it is seen that, with regard to the current breaking property, almost all of the contact materials according to the present invention which were produced by the infiltration method are superior to the conventional Cu-25Cr alloy contact material. For those contact materials having their current breaking property of 1 or below, when the Sample No. T-Bi-73, for example, is compared with Cu-Cr-Bi alloy material (Sample No. C-Bi-7 in Table 14 below) containing therein the same amount of bismuth (20% by weight) as in T-Bi-73, it is seen that T-Bi-73 has the magnification value of 0.6 (as compared with Cu-25Cr), while C-Bi-7 has the magnification value of 0.51 (as compared with Cu-25Cr), hence the contact material of the present invention is superior.

FIG. 15 is a graphical representation showing the current breaking property of the contact materials according to the present invention, in which the current breaking property is expressed in terms of the contact material produced by the infiltration method with the amount of Cu being approximately 60% by weight. In the drawing, the ordinate axis denotes the current breaking property with the property of the conventional Cu-25Cr contact material (Sample No. C-1) being made the reference, while the abscissa axis represents the adding quantity of Bi. In the drawing, a curve 101 indicates the current breaking property of the contact material with the added quantity of Ta relative to Mo being 8.8% by weight, wherein the adding quantity of Bi is varied (Sample Nos. T-Bi-1, T-Bi-13, T-Bi-25, T-Bi-37, T-Bi-49, T-Bi-61, T-Bi-73); a curve 102 indicates the current breaking property of the contact material with the added quantity of Ta relative to Mo being 17.0% by weight, wherein the adding quantity of Bi is varied (Sample Nos. T-Bi-2, T-Bi-14, T-Bi-26, T-Bi-38, T-Bi-50, T-Bi-62, T-Bi-74); a curve 103 indicates the current breaking property of the contact material with the added quantity of Ta relative to Mo being 31.5% by weight, wherein the adding quantity of Bi is varied (Sample Nos, T-Bi-3, T-Bi-15, T-Bi-27, T-Bi-39, T-Bi-51, T-Bi-63, T-Bi-75); and a curve 104 also indicates the current breaking property of the contact material with the added quantity of Ta relative to Mo being 44.1% by weight, wherein the adding quantity of Bi is varied (Sample Nos, T-Bi-4, T-Bi-16, T-Bi-28, T-Bi-40, T-Bi-52, T-Bi-64, T-Bi-76). Further, in this drawing, a curve 105 (in dash line) indicates the current breaking property of the conventional Cu-25Cr alloy contact material (Sample Nos. C-1, C-Bi-1, C-Bi-2, C-Bi-3, C-Bi-4, C-Bi-5, C-Bi-6, C-Bi-7), to which Bi was added. Also, in the same drawing, a double-circle 106 indicates the current breaking property of the conventional Cu-Mo alloy contact material (Sample No. M-1). The results of the measurements on these conventional alloy contact materials are shown in Table 14 below.

From FIG. 15, it may be seen that the contact materials of the present invention with the added quantity of Ta relative to Mo being 17.0% by weight, 31.5% by weight and 44.1% by weight, respectively (the curves 102, 103 and 104 in the drawing) are superior to the conventional Cu-25Cr alloy contact material, even if the adding quantity of Bi is 20% by weight. Further, the alloy contact material of the present invention with the added quantity of Ta relative to Mo being 8.8% by weight (the curve 101 in the drawing) is also superior to the conventional Cu-25Cr alloy contact material, if the adding quantity of Bi is not exceeding 5% by weight, and this contact material is still excellent in comparison with the Cu-25Cr-Bi alloy contact material (the curve 105 in the drawing), even when the adding quantity of Bi is above 5% by weight.

FIG. 16 is a graphical representation showing the current breaking property of the contact materials according to the present invention, in which the current breaking property is expressed in terms of the contact material produced by the infiltration method with the amount of Cu being approximately 50% by weight. In the drawing, both axes of ordinate and abscissa represent the same entries as in FIG. 15. In the drawing, a curve 107 indicates the current breaking property of the contact material of the present invention with the added quantity of Ta relative to Mo being 8.8% by weight, wherein the adding quantity of Bi is varied (Sample Nos. T-Bi-5, T-Bi-17, T-Bi-29, T-Bi-41, T-Bi-53, T-Bi-65, T-Bi-77); a curve 108 indicates the current breaking property of the contact material with the added quantity of Ta relative to Mo being 17.0% by weight, wherein the adding quantity of Bi is varied (Sample Nos. T-Bi-6, T-Bi-18, T-Bi-30, T-Bi-42, T-Bi-54, T-Bi-66, T-Bi-78); a curve 109 is the current breaking property of the contact material with the added quantity of Ta relative to Mo being 31.5% by weight, wherein the adding quantity of Bi is varied (Sample Nos. T-Bi-7, T-Bi-19, T-Bi-31, T-Bi-43, T-Bi-55, T-Bi-67, T-Bi-79); a curve 110 indicates the current breaking property of the contact material with the added quantity of Ta relative to Mo being 44.1% by weight, wherein the adding quantity of Bi is varied (Sample Nos. T-Bi-8, T-Bi-20, T-Bi-32, T-Bi-44, T-Bi-56, T-Bi-68, T-Bi-80).

From FIG. 16, it may be seen that the contact materials of the present invention with their respective added quantity of Ta relative to Mo being 8.8% by weight, 17.0% by weight, 31.5% by weight, and 44.1% by weight (the curves 107, 108, 109 and 110) have more excellent current breaking property than that of the conventional Cu-25Cr alloy contact material, even when the adding quantity of Bi is 20% by weight. Further, in comparison with FIG. 15, the contact materials of the present invention with the added quantity of Ta relative to Mo being 8.8% by weight and 17.0% by weight, respectively, show their improved current breaking property.

FIG. 17 is also a graphical representation showing the current breaking property of the contact materials according to the present invention, in which the current breaking property is expressed in terms of the contact material produced by the infiltration method with the amount of Cu being approximately 40% by weight. In the drawing, both axes of ordinate and abscissa denote the same entries as in FIG. 15. In the drawing, a curve 111 indicates the current breaking property of the contact material according to the present invention with the added quantity of Ta relative to Mo being 8.8% by weight, wherein the adding quantity of Bi is varied (Sample Nos. T-Bi-9, T-Bi-21, T-Bi-33, T-Bi-45, T-Bi-57, T-Bi-69, T-Bi-81); a curve 112 indicates the current breaking property of the contact material with the added quantity of Ta relative to Mo being 17.0% by weight, wherein the adding quantity of Bi is varied (Sample Nos. T-Bi-10, T-Bi-22, T-Bi-34, T-Bi-46, T-Bi-58, T-Bi-70, T-Bi-82); a curve 113 indicates the current breaking property of the contact material with the added quantity of Ta relative to Mo being 31.5% by weight, wherein the adding quantity of Bi is varied (Sample Nos. T-Bi-11, T-Bi-23, T-Bi-35, T-Bi-47, T-Bi-59, T-Bi-71, T-Bi-83); and a curve 114 indicates the current breaking property of the contact material with the added quantity of Ta relative to Mo being 44.1% by weight, wherein the adding quantity of Bi is varied (Sample Nos. T-Bi-12, T-Bi-12, T-Bi-24, T-Bi-36, T-Bi-48, T-Bi-60, T-Bi-72, T-Bi-84).

From FIG. 17, it may be seen that the contact materials of the present invention with their respective added quantities of Ta relative to Mo being 8.8% by weight, 17.0% by weight, 31.5% by weight, and 44.1% by weight (the curves 111, 112, 113 and 114 in the drawing) have the superior current breaking property to that of the conventional Cu-25Cr alloy contact material, even when the adding quantity of Bi is 20% by weight. On the other hand, however, the current breaking property of the contact materials of the present invention with the added quantity of Ta relative to Mo being 8.8% by weight is low in comparison with that in FIG. 16. Further, when this FIG. 3 is compared with FIG. 15, the optimum current breaking property may be obtained on the alloy contact material with the Cu content being in the vicinity of 50% by weight.

In FIGS. 15, 16 and 17, on the other hand, it is seen that the degree of lowering in the current breaking property of the contact material, when the adding quantity of Bi is increased, tends to be smaller with the Cu content of 40% by weight than other constituent elements. Incidentally, it is to be added that, when comparing the contact material of the present invention (Sample Nos. T-Bi-1, through T-Bi-84) with the conventional Cu-Mo contact material (Sample No. M-1), all of the contact materials according to the present invention have more excellent current breaking property than the conventional Cu-Mo alloy contact material.

From the foregoing, it may be concluded that, when the added quantity of Ta relative to Mo is 17.0% by weight or above, the contact material of the present invention indicates more excellent current breaking property than the conventional Cu-25Cr alloy contact material within the Cu content ranging from 40 to 60% by weight, irrespective of the adding quantity of Bi; when the added quantity of Ta relative to Mo is 8.8% by weight, the contact material indicates more excellent current breaking property than the conventional Cu-25Cr alloy contact material with the adding quantity of Bi of up to 5% by weight in case the Cu content is 60% by weight; and when the added quantity of Ta relative to Mo is 8.8% by weight and the Cu content is 50% by weight or 40% by weight, the contact material indicates more excellent current breaking property than the conventional Cu-25Cr alloy contact material, irrespective of the adding quantity of Bi. Therefore, when comparing the contact materials of the present invention with the conventional Cu-25Cr-Bi alloy contact material in respect of the same Bi content, all of the contact materials according to the present invention indicate their excellent current breaking property within the whole compositional range.

Moreover, from Table 13 below, it will be seen that the contact material according to the present invention is superior to the conventional Cu-25Cr alloy contact material in respect of the voltage withstand capability. More specifically, in respect of the contact material having the voltage withstand capability of 1 or below, when the Cu-25Cr-lBi alloy contact material (Sample No. C-Bi-4) containing the same amount of Bi (1% by weight) as in the contact material of the present invention (Sample No. T-Bi-37, for example) is compared with the T-Bi-37 alloy contact material, the latter has its voltage withstand capability of 0.64 (a ratio to Cu-25Cr), in contrast to which the C-Bi-4 alloy contact material has its voltage withstand capability of 0.3 (a ratio to Cu-25Cr). From this, it is seen that the contact material of the present invention indicates more excellent voltage withstand capability than that of the conventional contact material.

The measurement of the voltage withstand capability of the contact material was done by repeating the following cycle of the steps in a number of times: (1) conduction of electric current; (2) no-load breaking; (3) application of high tension voltage; and (4) checking of presence or absence of electric discharge owing to application of high tension voltage. These four steps (1) to (4) are made constitute one cycle, and, by repeating this cycle in a number of times, a voltage withstand value was calculated from (the number of cycle, at which the electric discharge occurred)/(the total number of the cycle), based on which calculation the voltage application was adjusted so that the probability of the electric discharge may become 50%. Table 13 below indicates the voltage withstand value of the contact materials according to the present invention with the voltage value to bring about 50% discharge probability in the conventional Cu-25Cr alloy contact material as the reference. In this measurement, the current conduction, the space interval between the contacts, and other conditions were set same.

FIG. 18 is a graphical representation showing the voltage withstand capability of the contact material according to the present invention produced by the infiltration method with the Cu content being 60% by weight, in which the ordinate axis denotes the voltage withstand capability of the contact material of the present invention with the voltage withstand capability of the conventional Cu-25Cr alloy contact material being made the reference, and the abscissa axis shows the adding quantity of Bi. Incidentally, it should be noted that, for the purpose of indicating variations in the voltage withstand capability owing to addition of varying amount of Bi, the graphical representation is divided into FIG. 18-1 and FIG. 18-2 at the point of the Bi adding quantity of 1% by weight. In these divided graphical representations, the curves 101 to 105 and the double-circle 106 are for the same contact materials as those shown in FIG. 15.

From FIGS. 18-1 and 18-2, it may be seen that the contact materials of the present invention (the curves 101, 102, 103 and 104) are superior to the conventional Cu-25Cr-Bi alloy contact material (the curve 105). It may be seen further that, in comparison with the conventional Cu-25Cr alloy contact material, the contact materials of the present invention have their superior voltage withstand capability to that of the conventional Cu-25Cr alloy contact material, when the contact material has its added quantity of Ta relative to Mo of 8.8% by weight and the adding quantity of Bi is up to 0.27% by weight; when the contact material has its added quantity of Ta relative to Mo of 17.0% by weight and the adding quantity of Bi is up to 0.4% by weight; when the contact material has its added quantity of Ta relative to Mo of 31.5% by weight and the adding quantity of Bi is up to 0.6% by weight; and when the contact material has its added quantity of Ta relative to Mo of 44.1% by weight and the adding quantity of Bi is up to 1.4% by weight. Further, it may be seen from FIGS. 18-1 and 18-2 that the contact materials with more quantity of addition of Ta relative to Mo indicate a small degree of decrease in the voltage withstand capability owing to increase in the adding quantity of Bi. FIG. 19 is a graphical representation showing the voltage withstand capability of the contact material according to the present invention produced by the infiltration method with the Cu content being 50% by weight, in which both axes of ordinate and abscissa denote the same entries as in FIGS. 18-1 and 18-2. It is to be noted that, same as in FIG. 18, this graphical representation of FIG. 19 is divided into FIGS. 19-1 and 19-2 at the point of the Bi adding quantity of 1% by weight, and that the curves 107 to 110 are for the same contact materials as in FIG. 16.

From FIGS. 19-1 and 19-2, it may be seen that the contact materials of the present invention (the curves 107, 108, 109 and 110) are superior to the conventional Cu-25Cr-Bi alloy contact material (the curve 105). It may be seen further that, in comparison with the conventional Cu-25Cr alloy contact material, the contact materials of the present invention have their superior voltage withstand capability to that of the conventional Cu-25Cr alloy contact material, when it has the added quantity of Ta relative to Mo of 8.8% by weight and contains up to 0.43% by weight of the added Bi; when it has the added Ta relative to Mo of 17.0% by weight and contains up to 0.94% by weight of the added Bi; when it has the added quantity of Ta relative to Mo of 31.5% by weight and contains up to 8.9% by weight of the added Bi; and when it has the added Ta relative to Mo of 44.1% by weight contains up to 20% by weight of added Bi. Further, it may be seen from FIGS. 19-1 and 19-2 that the contact materials with more added quantity of Ta relative to Mo indicate a small degree of decrease in the voltage withstand capability due to increase in the adding quantity of Bi, as FIGS. 18-1 and 18-2 show. Moreover, when FIGS. 18-1 and 18-2 are compared with FIGS. 19-1 and 19-2, the latter graphical representations indicate, in general, a higher voltage withstand capability than the former, which appears to be due to the quantity of Cu in the contact materials according to the present invention. In other words, it may be said that the contact material having the Cu content of 50% by weight is more excellent in its voltage withstand capability than the contact material having the Cu content of 60% by weight.

FIG. 20 is a graphical representation showing the voltage withstand capability of the contact materials according to the present invention produced by the infiltration method with the Cu content being 40% by weight, in which both axes of ordinate and abscissa denote the same entries as in FIGS. 18-1 and 18-2, and the curves 111 to 114 are for the same contact materials as in FIG. 17. In the same way as in FIG. 18, this graphical representation of FIG. 20 is divided into FIGS. 20-1 and 20-2 at the point of the Bi adding quantity of 1% by weight.

From FIGS. 20-1 and 20-2, it may be seen that the contact materials of the present invention (the curves 111, 112, 113 and 114) are superior to the conventional Cu-25Cr-Bi alloy contact material (the curve 105). It may be seen further that, in comparison with the conventional Cu-25Cr alloy contact material, the contact materials of the present invention are superior in their voltage withstand capability, when it contains up to 0.2% by weight of the added Bi content against the added Ta content of 8.8% by weight relative to Mo; when it contains up to 0.36% by weight of the added Bi content against the added Ta quantity of 17.0% by weight relative to Mo; when it contains up to 0.44% by weight of the added Bi content against the added Ta content of 31.5% by weight relative to Mo; and when it contains up to 0.54% by weight of the added Bi content against the added Ta content of 44.1% by weight relative to Mo. Further, it may be seen from FIGS. 20-1 and 20-2 that the contact materials with more added quantity of Ta relative to Mo indicate a small degree of decrease in the voltage withstand capability due to increase in the adding quantity of Bi. Moreover, when FIGS. 19-1 and 19-2 are compared with FIGS. 20-1 and 20-2, the former graphical representations indicate, in general, a higher voltage withstand capability than the latter. When the above-mentioned comparison between FIGS. 18-1 and 18-2 and FIGS. 19-1 and 19-2 is taken together, it will be seen that the contact materials of the Cu content of about 50% by weight are superior in their voltage withstand capability.

From Table 13 below, it will be seen that the contact materials of the present invention produced by the infiltration method (Sample Nos. T-Bi-1 through T-Bi-84) depend, in their chopping current value, on the adding quantity of Bi. The effect of addition of Bi emerges at about 1% by weight or so, and, thenceforward, the chopping current value decreases with increase in the adding quantity of Bi. The principal component which affects the chopping current value is Bi, the other components of Cu, Mo, and Nb having no remarkable influence on the chopping current value within their compositional ranges in the contact materials of the present invention. As for the melt-adhesion and peeling force, the contact materials of the present invention indicate considerable effect with the adding quantity of Bi of 0.1% by weight, beyond which the measured value thereof indicates zero (0). The measurement of the melt-adhesion and peeling force was done by first conducting electric current of 12.5 kA for three seconds in the state of the contacts of a vacuum switch which had been assembled in a circuit breaker being closed, and then the vacuum switch was removed from the circuit breaker to measure the melt-adhesion and peeling force between the contacts by means of a tension tester. In Table 13 below, the numeral zero (0) appearing in the column of "Melt-Adhesion and Peel Force" should be understood such that no melt-adhesion took place at the time of test by the tension tester, or the contacts were separated during their handling for the test owing to very small melt-adhesion and peeling force. As for the power consumption at the contact points, it is seen from Table 13 below that, irrespective of the adding quantity of Bi, the contact materials according to the present invention are superior to the conventional Cu-25Cr alloy contact material. This superiority is considered due to the function of the component elements, in particular, Mo, Ta and Cu, constituting the contact materials. As the consequence, the contact materials according to the present invention produced by the infiltration method exhibit their effect for the chopping current value at 1% by weight or above of the added Bi content, their effect for the melt-adhesion and peeling force at 0.1% by weight or above of the added Bi content, and their effect for the power consumption at the contact points with the compositional range of Cu, Mo, Ta and Bi contained in the contact materials as shown in Table 9 below (i.e., the Cu content ranging from 40 to 60% by weight; the Ta added quantity relative to Mo ranging from 8.8 to 44.1% by weight; and the Bi content ranging from 0.1 to 20% by weight).

From the above, it is seen that the contact materials according to the present invention produced by the infiltration method exhibit good properties within their compositional range of Cu of from 32.6 to 65.9% by weight; Mo of from 26.8 to 61.5% by weight; Ta of from 3.9 to 29.7% by weight; and Bi of from 0.1 to 20% by weight.

Table 13 below also shows, as Sample Nos. T-Bi-85 through T-Bi-132, various properties of the contact materials according to the present invention produced by the second method of powder sintering. As to the current breaking property, it will be seen clearly from Table 13 below that all the contact materials have their superior current breaking property to that of the conventional Cu-25Cr alloy contact material (Sample No. C-1).

FIG. 21 shows the current breaking property of the contact material according to the present invention produced by the powder sintering method with the Cu content of 75% by weight, in which the ordinate represents the current breaking property with the property of the conventional Cu-25Cr alloy contact material as the reference and the abscissa denotes the adding quantity of Bi. In the graphical representation of FIG. 21, a curve 115 indicates the current breaking property of the contact materials, in which the added quantity of Ta relative to Mo is 8.8% by weight and the adding quantity of Bi is varied (Sample Nos. T-Bi-85, T-Bi-93, T-Bi-101, T-Bi-109, T-Bi-117, T-Bi-125); a curve 116 indicates the current breaking property of the contact materials, in which the added quantity of Ta relative to Mo is 17.0% by weight and the adding quantity of Bi is varied (Sample Nos. T-Bi-86, T-Bi-94, T-Bi-102, T-Bi-110, T-Bi-118, T-Bi-126); a curve 117 indicates the current breaking property of the contact materials, in which the added quantity of Ta relative to Mo is 31.5% by weight and the adding quantity of Bi is varied (Sample Nos. T-Bi-87, T-Bi-95, T-Bi-103, T-Bi-111, T-Bi- 119, T-Bi-127); and a curve 118 indicates the current breaking property of the contact materials, in which the added quantity of Ta relative to Mo is 44.1% by weight and the adding quantity of Bi is varied (Sample Nos. T-Bi-88, T-Bi-96, T-Bi-104, T-Bi-112, T-Bi-120, T-Bi-128).

From FIG. 21, it is seen that the contact materials of the present invention exhibit more excellent properties than the conventional Cu-25Cr alloy contact material in respect of the current breaking characteristic, although the property thereof is seen to decrease with increase in the adding quantity of Bi. It is also seen that the contact materials of the present invention produced by the powder sintering method with the Cu content being 75% by weight have their superior current breaking property, with the added quantity of Ta relative to Mo being in a range of from 8.8 to 44.1% by weight and the adding quantity of Bi being up to 20% by weight.

FIG. 22 shows the current breaking property of the contact materials of the present invention produced by the powder sintering method with the Cu content being 60% by weight, in which the ordinate and the abscissa denote the same entries as in FIG. 21. In the drawing, a curve 119 indicates the current breaking property of the contact materials, in which the added quantity of Ta relative to Mo is 8.8% by weight and the adding quantity of Bi is varied (Sample Nos. T-Bi-89, T-Bi-97, T-Bi-105, T-Bi-113, T-Bi-121, T-Bi-129); a curve 120 indicates the current breaking property of the contact materials, in which the added quantity of Ta relative to Mo is 17.0% by weight and the adding quantity of Bi is varied (Sample Nos. T-Bi-90, T-Bi-98, T-Bi-106, T-Bi-114, T-Bi-122, T-Bi-130); a curve 121 indicates the current breaking property of the contact materials, in which the added quantity of Ta relative to Mo is 31.5% by weight and the adding quantity of Bi is varied (Sample Nos. T-Bi-91, T-Bi-99, T-Bi-107, T-Bi-115, T-Bi-123, T-Bi-131); and a curve 122 indicates the current breaking property of the contact materials, in which the added quantity of Ta relative to Mo is 44.1% by weight and the adding quantity of Bi is varied (Sample Nos. T-Bi-92, T-Bi-100, T-Bi-108, T-Bi-116, T-Bi-124, T-Bi-132).

From FIG. 22, it may be seen that the contact materials according to the present invention exhibit their excellent current breaking property in comparison with the conventional Cu-25Cr contact material, although their current breaking property decreases with increase in the adding quantity of Bi. It may also be seen that even the contact materials of the present invention produced by powder sintering method with the Cu content of being 60% by weight have their excellent current breaking property with the added quantity of Ta relative to Mo of 8.8 to 44.1% by weight and the quantity of addition of Bi being up to 20% by weight. As to the difference in the current breaking property due to the difference in the Cu content, it may be seen from FIGS. 21 and 22 that the contact materials having the added Ta content relative to Mo of 8.8% by weight exhibit their superior current breaking property with the Cu content of 75% by weight in the case of small adding quantity of Bi, and the difference in the current breaking property tends to be small with increase in the adding quantity of Bi, or to be substantially eliminated; on the other hand, the contact materials having the added Ta content relative to Mo of 17.0% by weight, 31.5% by weight and 44.1% by weight exhibit their current breaking property which is equal to, or higher than, that of the conventional contact material, when the Cu content is 60% by weight. However, the contact materials having the Cu content of 60% by weight show a small degree of decrease in the current breaking property due to increase in the adding quantity of Bi.

From the foregoing, it may be concluded that, if the added Ta content relative to Mo is 8.8% by weight or more, the contact materials of the present invention indicate superior current breaking property to the conventional Cu-25Cr contact material within a range of the Cu content of from 60 to 75% by weight, without depending on the adding quantity of Bi. When the contact materials of the present invention are compared with the conventional Cu-25Cr-Bi alloy contact material, in respect of the same Bi content, the contact materials of the present invention have their superior current breaking property to the conventional one in their whole compositional range.

It may be further seen from Table 13 below that, with respect to the voltage withstand capability, the contact materials of the present invention produced by the powder sintering method, when the adding quantity of Bi is small, exhibit their superiority to the conventional Cu-25Cr alloy contact material.

FIG. 23 is a graphical representation showing the voltage withstand capability of the contact materials according to the present invention obtained by the powder sintering method with the Cu content of 75% by weight, in which the ordinate represents the voltage withstand capability with the capability of the conventional Cu-25Cr alloy contact material as the reference and the abscissa denotes the adding quantity of Bi. Incidentally, in the same manner as in FIG. 18 above, the graphical representation of FIG. 23 is divided into FIGS. 23-1 and 23-2 at the point of 1% by weight of the Bi content. In these graphical representations, the curves 115 to 118 are for the same contact materials as in FIG. 21.

From FIGS. 23-1 and 23-2, it may be seen that the contact materials of the present invention (the curves 115, 116, 117 and 118) possess their superior voltage withstand capability to that of the conventional Cu-25Cr-Bi alloy contact material (the curve 105). It may further be seen that the contact materials of the present invention having the added Ta content relative to Mo of 8.8% by weight are more excellent in their voltage withstand capability than the conventional Cu-25Cr contact material with the adding quantity of Bi of up to 0.13% by weight; the contact materials having the added Ta content relative to Mo of 17.0% by weight are more excellent than the conventional contact material with the adding quantity of Bi of up to 0.23% by weight; the contact materials having the added Ta content relative to Mo of 31.5% by weight are more excellent than the conventional contact material with the adding quantity of Bi of up to 0.31% by weight; and the contact materials having the added Ta content relative to Mo of 44.1% by weight are more excellent than the conventional contact material with the adding quantity of Bi of up to 0.32% by weight. Further, from FIGS. 23-1 and 23-2, it may be seen that the contact material having more Ta content relative to Mo shows a small degree of lowering in the voltage withstand capability due to increase in the adding quantity of Bi.

FIG. 24 is a graphical representation showing the voltage withstand capability of the contact materials according to the present invention obtained by the powder sintering method with the Cu content of 60% by weight, in which both ordinate and abscissa denote the same entries as in FIG. 23 above. Also, the graphical representation of FIG. 24 is divided into FIGS. 24-1 and 24-2 at the point of the Bi content of 1% by weight. In these graphical representations, the curves 119 to 122 are for the same contact materials as in FIG. 22.

From FIGS. 20-1 and 20-2, it is seen that the contact materials of the present invention (the curves 119, 120, 121 and 122) have their excellent voltage withstand capability over that of the conventional Cu-25Cr-Bi alloy contact material (the curve 105). It may be further seen that the contact materials of the present invention having the added Ta content relative to Mo of 8.8% by weight indicate their superior voltage withstand capability to the conventional Cu-25Cr alloy contact material with the adding quantity of Bi of up to 0.26% by weight; the contact materials having the added Ta content relative to Mo of 17.0% by weight are more excellent than the conventional contact material with the adding quantity of Bi of up to 0.5% by weight; the contact materials having the added Ta content relative to Mo of 31.5% by weight are more excellent than the conventional contact material with the adding quantity of Bi of up to 1.2% by weight; and the contact materials having the added Ta content relative to Mo of 44.1% by weight are more excellent than the conventional contact material with the adding quantity of Bi of up to 3.6% by weight. Further, from FIGS. 24-1 and 24-2, it may be seen that the contact material having more Ta content relative to Mo shows a small degree of lowering in the voltage withstand capability due to increase in the adding quantity of Bi. Moreover, upon comparison between FIGS. 23-1 and 23-2 and FIGS. 24-1 and 24-2, it may be seen that the contact materials with the Cu content of 60% by weight indicate the higher voltage withstand capability than the contact materials with the Cu content of 75% by weight.

Furthermore, it may be seen from Table 13 below that the chopping current value of the contact materials according to the present invention produced by the powder sintering method (Sample Nos. T-Bi-85 through T-Bi-132) is dependent on the adding quantity of Bi. The effect of addition of Bi emerges at about 1% by weight or so, and, thenceforward, the chopping current value decreases with increase in the adding quantity of Bi. As for the melt-adhesion and peeling force, the contact materials of the present invention indicate considerable effect with the adding quantity of Bi of 0.1% by weight, beyond which the measured value thereof indicates zero (0). As for the power consumption at the contact points, the contact materials of the present invention obtained by the powder sintering method are not dependent on the adding quantity of Bi, but on the content of Cu and other components. Here, the contact materials of the present invention with the Cu content of 60% by weight show their excellent capability of the power consumption at the contact points, which is 0.2 to 0.3 times as low as that of the conventional Cu-25Cr alloy contact material, the capability of which is as equal as that of the contact material of the present invention obtained by the afore-mentioned infiltration method. On the other hand, the contact materials with the Cu content of 75% by weight have their capability of the power consumption at the contact points of 0.5 to 0.7 times as low as that of the conventional Cu-25Cr alloy contact material, from which it will be seen that, when the Cu content becomes less than 60% by weight, there can be observed not so conspicuous change in the power consumption at the contact points. When the contact materials of the present invention with the Cu content of 75% by weight are compared with the conventional Cu-25Cr alloy contact material or Cu-25Cr-Bi alloy contact material, the power consumption at the contact points of the contact materials according to the present invention is seen to be 0.5 to 0.7 times as low as that of the conventional contact materials, the difference of which is considered due to difference in the constituent elements of the contact materials. As the consequence of this, the contact materials of the present invention produced by the powder sintering method show their effect on the chopping current value with the adding quantity of Bi of 0.1% by weight or above, and their favorable capabicity on the power consumption at the contact points with the Cu content in a range of from 60 to 75% by weight, the added Ta content relative to Mo in a range of from 8.8 to 44.1% by weight, and the adding quantity of Bi in a range of from 0.1 to 20% by weight.

From the foregoing, it may be seen that the contact materials of the present invention produced by the powder sintering method indicate their favorable properties with the range of content of Cu being from 60 to 075% by weight, Mo being from 14.0 to 36.5% by weight, Ta being from 2.2 to 17.6% by weight, and Bi being from 0.1 to 20% by weight.

Table 13 below also shows various properties of the contact materials according to the present invention produced by the third method of the vacuum hot press, as Sample Nos T-Bi-133 through T-Bi-180. As to the current breaking property, it will be seen clearly from Table 13 that all the contact materials have their superior current breaking property to that of the conventional Cu-25Cr alloy contact material.

FIG. 25 shows the current breaking property of the contact materials according to the present invention obtained by the vacuum hot press method with the Cu content of 75% by weight, in which the ordinate represents the current breaking property with the property of the conventional Cu-25Cr alloy contact material being made the reference, and the abscissa denotes the adding quantity of Bi. In the graphical representation of FIG. 25, a curve 123 indicates the current breaking property of the contact materials, in which the added quantity of Ta relative to Mo is 8.8% by weight and the adding quantity of Bi is varied (Sample Nos. T-Bi-133, T-Bi-141, T-Bi-149, T-Bi-157, T-Bi-165, T-Bi-173); a curve 124 indicates the current breaking property of the contact materials, in which the added quantity of Ta relative to Mo is 17.0% by weight and the adding quantity of Bi is varied (Sample Nos. T-Bi-134, T-Bi-142, T-Bi-150, T-Bi-158, T-Bi-166, T-Bi-174); a curve 125 indicates the current breaking property of the contact materials, in which the added quantity of Ta relative to Mo is 31.5% by weight and the adding quantity of Bi is varied (Sample Nos. T-Bi-135, T-Bi-143, T-Bi-151, T-Bi-159, T-Bi-167, T-Bi-175); and a curve 126 indicates the current breaking property of the contact materials, in which the added quantity of Ta relative to Mo is 44.1% by weight and the adding quantity of Bi is varied (Sample Nos. T-Bi-136, T-Bi-144, T-Bi-152, T-Bi-160, T-Bi-168, T-Bi-176).

From FIG. 25, it is seen that the contact materials of the present invention have more excellent current breaking property than the conventional Cu-25Cr alloy contact material, although the property thereof is seen to be lowered with increase in the adding quantity of Bi.

It is also seen from FIG. 25 that the contact materials according to the present invention produced by the vacuum hot press method with the Cu content of 75% by weight have their superior current breaking property, in case the added quantity of Ta relative to Mo is in a range of from 8.8 to 44.1% by weight and the adding quantity of Bi is up to 20% by weight.

FIG. 26 shows the current breaking property of the contact materials according to the present invention produced by the vacuum hot press method with the Cu content of 60% by weight, in which the ordinate and the abscissa denote the same entries as in FIG. 25. In the drawing, a curve 127 indicates the current breaking property of the contact materials, in which the added quantity of Ta relative to Mo is 8.8% by weight and the adding quantity of Bi is varied (Sample Nos. T-Bi-137, curve 128 indicates the current breaking property of the contact materials, in which the added quantity of Ta relative to Mo is 17.0% by weight and the adding quantity of Bi is varied (Sample Nos. T-Bi-138, T-Bi-146, T-Bi-154, T-Bi-162, T-Bi-170, T-Bi-178); a curve 129 indicates the current breaking property of the contact materials, in which the added quantity of Ta relative to Mo is 31.5% by weight and the adding quantity of Bi is varied (Sample Nos. T-Bi-139, T-Bi-147, T-Bi-155, T-Bi-163, T-Bi-171, T-Bi-179); and a curve 130 indicates the current breaking property of the contact materials, in which the added quantity of Ta relative to Mo is 44.1% by weight and the adding quantity of Bi is varied (Sample Nos. T-Bi-140, T-Bi-148, T-Bi-156, T-Bi-164, T-Bi-172, T-Bi-180).

From FIG. 26, it may be seen that the contact materials according to the present invention have their superior current breaking property to that of the conventional Cu-25Cr alloy contact material, although the property is lowered with increase in the adding quantity of Bi. Moreover, it may be seen from FIG. 26 that the contact materials of the present invention produced by the vacuum hot press method with the Cu content of 60% by weight possess their excellent current breaking property with the added Ta content relative to Mo ranging from 8.8 to 44.1% by weight and the adding quantity of Bi of up to 20% by weight. As to the difference in the current breaking property due to the difference in the Cu content, it may be seen from FIGS. 25 and 26 that such difference tends to be higher, in general, with the contact materials having the Cu content of 60% by weight.

From the foregoing, it may be concluded that the contact materials of the present invention having the Cu content in a range of from 60 to 75% by weight, the added Ta content relative to Mo in a range of from 8.8 to 44.1% by weight, and the adding quantity of Bi of up to 20% by weight have their excellent current breaking property in comparison with that of the conventional Cu-25Cr alloy contact material.

It may be seen further from Table 13 below that, with respect to the voltage withstand capability, the contact materials of the present invention produced by the vacuum hot press method, when the adding quantity of Bi is small, exhibit their superiority to the conventional Cu-25Cr alloy contact material.

FIG. 27 is a graphical representation showing the voltage withstand capability of the contact materials according to the present invention obtained by the vacuum hot press method with the Cu content of 75% by weight, in which the ordinate represents the voltage withstand capability with the property of the conventional Cu-25Cr contact alloy material being made the reference, and the abscissa denotes the adding quantity of Bi. Incidentally, in the same manner as in FIG. 18, the graphical representation of FIG. 27 is divided into FIGS. 27-1 and 27-2 at the point of 1% by weight of the Bi content. In the drawing, the curves 123 to 126 are for the same contact materials as in FIG. 25.

From FIGS. 27-1 and 27-2, it may be seen that the contact materials of the present invention (the curves 123, 124, 125 and 126) have their superior voltage withstand capability to that of the conventional Cu-25Cr-Bi contact material (the curve 105). It may further be seen that the contact materials of the present invention having the added Ta content relative to Mo of 8.8% by weight are more excellent in its voltage withstand capability than the conventional Cu-25Cr alloy contact material with the adding quantity of Bi of up to 0.15% by weight; the contact materials having the added Ta content relative to Mo of 17.0% by weight are more excellent than the conventional contact material with the adding quantity of Bi of up to 0.25% by weight; the contact materials having the added Ta content relative to Mo of 31.5% by weight are more excellent than the conventional contact material with the adding quantity of Bi of up to 0.28% by weight; and the contact materials having the added Ta content relative to Mo of 44.1% by weight are more excellent than the conventional contact material with the adding quantity of Bi of up to 0.29% by weight Further, from FIGS. 27-1 and 27-2, it may be seen that the contact material having more Ta content relative to Mo shows a small degree of lowering in the voltage withstand capability due to the addition of Bi.

FIG. 28 is a graphical representation showing the voltage withstand capability of the contact materials according to the present invention obtained by the vacuum hot press method with the Cu content being 60% by weight, in which both ordinate and abscissa denote the same entries as in FIG. 27. Also, the graphical representation of FIG. 28 is divided into FIGS. 28-1 and 28-2 at the point of the Bi content of 1% by weight. In these graphical representations, the curves 127 to 130 are for the same contact materials as in FIG. 26.

From FIGS. 28-1 and 28-2, it may be seen that the contact materials of the present invention (the curves 127, 128, 129 and 130) have their excellent voltage withstand capability over that of the conventional Cu-25Cr-Bi alloy contact material (the curve 105). It may be further seen that the contact materials of the present invention having the added Ta content relative to Mo of 8.8% by weight indicate their superior voltage withstand capability to the conventional Cu-25Cr alloy contact material, when the adding quantity of Bi is up to 0.32% by weight; the contact materials having the added Ta content relative to Mo of 17.0% by weight are more excellent than the conventional contact material, when the adding quantity of Bi is up to 0.54% by weight; the contact materials having the added Ta content relative to Mo of 31.5% by weight are more excellent than the conventional contact material, when the adding quantity of Bi is up to 2.5% by weight; and the contact materials having the added Ta content relative to Mo of 44.1% by weight are more excellent than the conventional contact material, when the adding quantity of Bi is up to 7% by weight. Further, from FIGS. 28-1 and 28-2, it may be seen that the contact material having more added Ta content relative to Mo shows a small degree of lowering in the voltage withstand capability due to addition of Bi. Moreover, upon comparison between FIGS. 27-1 and 27-2 and FIGS. 28-1 and 28-2, it may be seen that the contact material with the Cu content of 60% by weight indicates the higher voltage withstand capability than the contact material with the Cu content of 75% by weight.

Furthermore, it may be seen from Table 13 below that the chopping current value of the contact materials according to the present invention produced by the vacuum hot press method (Sample Nos. T-Bi-133 through T-Bi-180) is dependent on the adding quantity of Bi. The effect of the addition of Bi emerges at about 1% by weight or so, and thenceforward, the chopping current value decreases with increase in the adding quantity of Bi. As for the melt-adhesion and peeling force, the contact materials of the present invention indicate considerable effect with the adding quantity of Bi of 0.1% by weight, beyond which the measured value thereof indicates zero (0). As for the power consumption at the contact points, the contact materials of the present invention are not dependent on the adding quantity of Bi, but on the content of Cu and other components. Here, the contact material of the present invention with the Cu content of 60% by weight indicate their excellent power consumption, which is 0.2 to 0.3 times as low as that of the conventional Cu-25Cr alloy contact material, as is the case with the contact materials of the present invention obtained by the powder sintering method, the capability of which is comparable with the property of the above-mentioned contact materials of the present invention. On the other hand, the contact materials with the Cu content of 75% by weight show their capability of the power consumption at the contact points of 0.5 to 0.7 times as low as that of the conventional Cu-25Cr alloy contact material, i.e. their capability is as equal as that of the contact materials obtained by the powder sintering method. From this, it will be seen that, when the Cu content becomes less than 60% by weight, there is seen not so remarkable change in the power consumption at the contact points. When the contact materials of the present invention with the Cu content of 75% by weight are compared with the conventional Cu-25Cr or Cu-25Cr-Bi contact material, the contact materials of the present invention show their power consumption, which is 0.5 to 0.7 times as low as that of the conventional contact material, the difference of which is considered due to difference in the constituent elements of the contact materials. Therefore, the contact materials of the present invention produced by the vacuum hot press method show their effect on the chopping current value when the adding quantity of Bi is 1% by weight or above, their effect on the melt-adhesion and peeling force when the adding quantity of Bi is 0.1% by weight or above, and their favorable property on the power consumption at the contact points when the Cu content is in a range of from 60 to 75% by weight, the added Ta content relative to Mo is in a range of from 8.8 to 44.1% by weight, and the adding quantity of Bi is in a range of from 0.1 to 20% by weight.

From the foregoing, it may be concluded that the contact materials of the present invention produced by the vacuum hot press method and having the Cu content in a range of from 60 to 75% by weight, the Mo content in a range of from 14.0 to 36.5% by weight, the Ta content in a range of from 2.2 to 17.6% by weight, and the Bi content in a range of from 0.1 to 20% by weight exhibit their favorable properties.

In passing, it should be noted that, although, in the foregoing examples of the present invention, explanations have been given on the contact materials produced by addition of Bi to the base alloy of Cu-Mo-Ta, those elements such as Te, Sb, Tl and Pb may be used in place of Bi, in which case one or more kinds of these low melting point materials may be added to the base alloy. Table 15 below indicates various samples containing these elements. In this Table 15, the compositional ratio was determined in reference to the afore-described examples, and the adding quantity of the low melting point material, for the samples, was set to be 20% by weight at the maximum, based on which condition the contact materials of the present invention were compared with the conventional contact materials. The method for production of these contact materials is as follows: Sample Nos. 1, 2 and 3 are obtained by the infiltration method; Sample Nos. 4 and 5 are obtained by the powder sintering method; and Sample Nos. 6 and 7 are obtained by the vacuum hot press method. The shape of the contacts and the method of their testing are the same as in the afore-described examples. The results of the measurement are shown in Table 16 below.

From Table 16, it is seen that the contact materials of the present invention added with the low melting point component of Te, Sb, Tl, Pb, Se and Bi-Te in an amount of 20% by weight (Sample Nos. T-Te-2, T-Te-3, T-Te-5, T-Te-7, T-Sb-2, T-Sb-3, T-Sb-5, T-Sb-7, T-Tl-2, T-Tl-3, T-Tl-5, T-Tl-7, T-Pb-2, T-Pb-3, T-Pb-5, T-Pb-7, T-BT-2, T-BT-3, T-BT-5, T-BT-7) have more excellent current breaking property than the conventional contact material of Sample No. C-B-7, and that these contact materials of the present invention are also excellent in respect of their voltage withstand capability. It is further seen that, depending on the kind of the low melting point compact, the contact materials containing therein Bi and Te indicate a relatively small degree of lowering in their current breaking property, and the contact materials containing therein Pb are inferior in such property among the contact materials of the present invention. Further, more excellent current breaking property can be attained by adding 20% by weight in total of both Bi and Te together, each being at 10% by weight, rather than by adding 20% by weight of single Bi or Te. The same effect can be expected of the other low-melting point components. On the other hand, it is seen from Table 16 below that the chopping current value, the melt-adhesion and peeling force, and the power consumption at the contact points are not so much dependent upon the low melting point components to be added.

Accordingly, the properties of the contact materials according to the present invnetion as shown in Table 16 are considered to be essentially same as the contact materials added with Bi which are shown in Tables 9, 10 and 11. That is to say, the contact materials produced by the infiltration method exhibit their excellent properties with the content of Cu in the range of from 32.6 to 65.9% by weight, Ta relative to Mo in the range of from 8.8 to 44.1% by weight (i.e., the Mo content of from 26.8 to 61.5% by weight and the Ta content of from 3.9 to 29.7% by weight), and one or more kinds of the low melting point materials such as Te, Sb, Tl, Pb, and Bi in the range of from 0.1 to 20% by weight; and the contact materials produced by the powder sintering method or the vacuum hot press method exhibit their excellent properties with the content of Cu in the range of from 60 to 75% by weight, Ta relative to Mo in the range of from 8.8 to 44.1% by weight (i.e., the Mo content of from 14.0 to 36.5% by weight and the Ta content of from 2.2 to 17.6% by weight), and one or more kinds of the low melting point material such as Te, Sb, Tl, Pb and Bi of up to 20% by weight.

In the foregoing, the explanations have been made as to the contact materials according to the present invention with the Cu content of from 32.6 to 75% by weight, the Mo content of from 14.0 to 61.5% by weight, the Ta content of from 2.2 to 29.7% by weight, and one or more kinds of the low melting point materials of from 0.1 to 20% by weight. However, the compositional range of the practically useful contact materials is considered to be much broader. That is to say, there may be contemplated those contact materials having the Cu content of from 30 to 80% by weight, the Ta content relative to Mo of from 2 to 55% by weight (i.e., the Mo content of from 9 to 68.6% by weight and the Ta content of from 0.4 to 38.5% by weight), and the content of one or more of the low melting point materials of from 0.05 to 25% by weight, and any arbitrary alloy materials are able to be chosen within these compositional ranges depending on their use.

As has been mentioned in the foregoing, since the second Example of the present invention utilizes the contact materials composed of Cu, Mo, Ta and one or more kinds of the low melting point materials as the electrodes for the vacuum circuit breaker, the resulting vacuum circuit breaker has excellent operating characteristics.

TABLE 1

| Sample No. | Composition |
|---|---|
| N—Bi-1 | Cu—43.0(Mo—4.7 Nb)—0.1 Bi |
| N—Bi-2 | Cu—42.8(Mo—9.4 Nb)—0.1 Bi |
| N—Bi-3 | Cu—42.3(Mo—18 9 Nb)—0.1 Bi |
| N—Bi-4 | Cu—41.9(Mo—28.5 Nb)—0.1 Bi |
| N—Bi-5 | Cu—53.1(Mo—4.7 Nb)—0.1 Bi |
| N—Bi-6 | Cu—52.9(Mo—9.4 Nb)—0.1 Bi |
| N—Bi-7 | Cu—52.4(Mo—18.9 Nb)—0.1 Bi |
| N—Bi-8 | Cu—52.0(Mo—28.5 Nb)—0.1 Bi |
| N—Bi-9 | Cu—62.9(Mo—4.7 Nb)—0.1 Bi |
| N—Bi-10 | Cu—62.7(Mo—9.4 Nb)—0.1 Bi |
| N—Bi-11 | Cu—62.3(M0—18.9 Nb)—0.1 Bi |
| N—Bi-12 | Cu—61.9(Mo—28.5 Nb)—0.1 Bi |
| N—Bi-13 | Cu—43.0(Mo—4.7 Nb)—0.3 Bi |
| N—Bi-14 | Cu—42.8(Mo—9.4 Nb)—0.3 Bi |
| N—Bi-15 | Cu—42.3(Mo—18.9 Nb)—0.3 Bi |
| N—Bi-16 | Cu—41.9(Mo—28.5 Nb)—0.3 Bi |
| N—Bi-17 | Cu—53.1(Mo—4.7 Nb)—0.3 Bi |
| N—Bi-18 | Cu—52.9(Mo—9.4 Nb)—0.3 Bi |
| N—Bi-19 | Cu—52.4(Mo—18.9 Nb)—0.3 Bi |
| N—Bi-20 | Cu—52.0(Mo—28.5 Nb)—0.3 Bi |
| N—Bi-21 | Cu—62.9(Mo—4.7 Nb)—0.3 Bi |
| N—Bi-22 | Cu—62.7(Mo—9.4 Nb)—0.3 Bi |
| N—Bi-23 | Cu—62.3(Mo—18.9 Nb)—0.3 Bi |
| N—Bi-24 | Cu—61.9(Mo—28.5 Nb)—0.3 Bi |
| N—Bi-25 | Cu—43.0(Mo—4.7 Nb)—0.5 Bi |
| N—Bi-26 | Cu—42.8(Mo—9.4 Nb)—0.5 Bi |
| N—Bi-27 | Cu—42.3(Mo—18.9 Nb)—0.5 Bi |
| N—Bi-28 | Cu—41.9(Mo—28.5 Nb)—0.5 Bi |
| N—Bi-29 | Cu—53.1(Mo—4.7 Nb)—0.5 Bi |
| N—Bi-30 | Cu—52.9(Mo—9.4 Nb)—0.5 Bi |
| N—Bi-31 | Cu—52.4(Mo—18.9 Nb)—0.5 Bi |
| N—Bi-32 | Cu—52.0(Mo—28.5 Nb)—0.5 Bi |
| N—Bi-33 | Cu—62.9(Mo—4.7 Nb)—0.5 Bi |
| N—Bi-34 | Cu—62.7(Mo—9.4 Nb)—0.5 Bi |
| N—Bi-35 | Cu—62.3(Mo—18.9 Nb)—0.5 Bi |
| N—Bi-36 | Cu—61.9(Mo—28.5 Nb)—0.5 Bi |
| N—Bi-37 | Cu—43.0(Mo—4.7 Nb)—1.0 Bi |
| N—Bi-38 | Cu—42.8(Mo—9.4 Nb)—1.0 Bi |
| N—Bi-39 | Cu—42.3(Mo—18.9 Nb)—1.0 Bi |
| N—Bi-40 | Cu—41.9(Mo—28.5 Nb)—1.0 Bi |
| N—Bi-41 | Cu—53.1(Mo—4.7 Nb)—1.0 Bi |
| N—Bi-42 | Cu—52.9(Mo—9.4 Nb)—1.0 Bi |
| N—Bi-43 | Cu—52.4(Mo—18.9 Nb)—1.0 Bi |

TABLE 1-continued

| Sample No. | Composition |
|---|---|
| N—Bi-44 | Cu—52.0 (Mo—28.5 Nb)—1.0 Bi |
| N—Bi-45 | Cu—62.9(Mo—4.7 Nb)—1.0 Bi |
| N—Bi-46 | Cu—62.7(Mo—9.4 Nb)—1.0 Bi |
| N—Bi-47 | Cu—62.3(Mo—18.9 Nb)—1.0 Bi |
| N—Bi-48 | Cu—61.9(Mo—28.5 Nb)—1.0 Bi |
| N—Bi-49 | Cu—43.0(Mo—4.7 Nb)—5.0 Bi |
| N—Bi-50 | Cu—42.8(Mo—9.4 Nb)—5.0 Bi |
| N—Bi-51 | Cu—42.3(Mo—18.9 Nb)—5.0 Bi |
| N—Bi-52 | Cu—41.9(Mo—28.5 Nb)—5.0 Bi |
| N—Bi-53 | Cu—53.1(Mo—4.7 Nb)—5.0 Bi |
| N—Bi-54 | Cu—52.9(Mo—9.4 Nb)—5.0 Bi |
| N—Bi-55 | Cu—52.4(Mo—18.9 Nb)—5.0 Bi |
| N—Bi-56 | Cu—52.0(Mo—28.5 Nb)—5.0 Bi |
| N—Bi-57 | Cu—62.9(Mo—4.7 Nb)—5.0 Bi |
| N—Bi-58 | Cu—62.7(Mo—9.4 Nb)—5.0 Bi |
| N—Bi-59 | Cu—62.3(Mo—18.9 Nb)—5.0 Bi |
| N—Bi-60 | Cu—61.9(Mo—28.5 Nb)—5.0 Bi |
| N—Bi-61 | Cu—43.0(Mo—4.7 Nb)—10.0 Bi |
| N—Bi-62 | Cu—42.8(Mo—9.4 Nb)—10.0 Bi |
| N—Bi-63 | Cu—42.3(Mo—18.9 Nb)—10.0 Bi |
| N—Bi-64 | Cu—41.9(Mo—28.5 Nb)—10.0 Bi |
| N—Bi-65 | Cu—53.1(Mo—4.7 Nb)—10.0 Bi |
| N—Bi-66 | Cu—52.9(Mo—9.4 Nb)—10.0 Bi |
| N—Bi-67 | Cu—52.4(Mo—18.9 Nb)—10.0 Bi |
| N—Bi-68 | Cu—52.0(Mo—28.5 Nb)—10.0 Bi |
| N—Bi-69 | Cu—62.9(Mo—4.7 Nb)—10.0 Bi |
| N—Bi-70 | Cu—62.7(Mo—9.4 Nb)—10.0 Bi |
| N—Bi-71 | Cu—62.3(Mo—18.9 Nb)—10.0 Bi |
| N—Bi-72 | Cu—61.9(Mo—28.5 Nb)—10.0 Bi |
| N—Bi-73 | Cu—43.0(Mo—4.7 Nb)—20.0 Bi |
| N—Bi-74 | Cu—42.8(Mo—9.4 Nb)—20.0 Bi |
| N—Bi-75 | Cu—42.3(Mo—18.9 Nb)—20.0 Bi |
| N—Bi-76 | Cu—41.9(Mo—28.5 Nb)—20.0 Bi |
| N—Bi-77 | Cu—53.1(Mo—4.7 Nb)—20.0 Bi |
| N—Bi-78 | Cu—52.9(Mo—9.4 Nb)—20.0 Bi |
| N—Bi-79 | Cu—52.4(Mo—18.9 Nb)—20.0 Bi |
| N—Bi-80 | Cu—52.0(Mo—28.5 Nb)—20.0 Bi |
| N—Bi-81 | Cu—62.9(Mo—4.7 Nb)—20.0 Bi |
| N—Bi-82 | Cu—62.7(Mo—9.4 Nb)—20.0 Bi |
| N—Bi-83 | Cu—62.3(Mo—18.9 Nb)—20.0 Bi |
| N—Bi-84 | Cu—61.9(Mo—28.5 Nb)—20.0 Bi |

TABLE 2

| Sample No. | Composition |
|---|---|
| N—Bi-85 | Cu—25.0(Mo—4.7 Nb)—0.1 Bi |
| N—Bi-86 | Cu—25.0(Mo—9.4 Nb)—0.1 Bi |
| N—Bi-87 | Cu—25.0(Mo—18.9 Nb)—0.1 Bi |
| N—Bi-88 | Cu—25.0(Mo—28.5 Nb)—0.1 Bi |
| N—Bi-89 | Cu—40.0(Mo—4.7 Nb)—0.1 Bi |
| N—Bi-90 | Cu—40.0(Mo—9.4 Nb)—0.1 Bi |
| N—Bi-91 | Cu—40.0(Mo—18.9 Nb)—0.1 Bi |
| N—Bi-92 | Cu—40.0(Mo—28.5 Nb)—0.1 Bi |
| N—Bi-93 | Cu—25.0(Mo—4.7 Nb)—0.5 Bi |
| N—Bi-94 | Cu—25.0(Mo—9.4 Nb)—0.5 Bi |
| N—Bi-95 | Cu—25.0(Mo—18.9 Nb)—0.5 Bi |
| N—Bi-96 | Cu—25.0(Mo—28.5 Nb)—0.5 Bi |
| N—Bi-97 | Cu—40.0(Mo—4.7 Nb)—0.5 Bi |
| N—Bi-98 | Cu—40.0(Mo—9.4 Nb)—0.5 Bi |
| N—Bi-99 | Cu—40.0(Mo—18.9 Nb)—0.5 Bi |
| N—Bi-100 | Cu—40.0(Mo—28.5 Nb)—0.5 Bi |
| N—Bi-101 | Cu—25.0(Mo—4.7 Nb)—1.0 Bi |
| N—Bi-102 | Cu—25.0(Mo—9.4 Nb)—1.0 Bi |
| N—Bi-103 | Cu—25.0(Mo—18.9 Nb)—1.0 Bi |
| N—Bi-104 | Cu—25.0(Mo—28.5 Nb)—1.0 Bi |
| N—Bi-105 | Cu—40.0(Mo—4.7 Nb)—1.0 Bi |
| N—Bi-106 | Cu—40.0(Mo—9.4 Nb)—1.0 Bi |
| N—Bi-107 | Cu—40.0(Mo—18.9 Nb)—1.0 Bi |
| N—Bi-108 | Cu—40.0(Mo—28.5 Nb)—1.0 Bi |
| N—Bi-109 | Cu—25.0(Mo—4.7 Nb)—5.0 Bi |
| N—Bi-110 | Cu—25.0(Mo—9.4 Nb)—5.0 Bi |
| N—Bi-111 | Cu—25.0(Mo—18.9 Nb)—5.0 Bi |
| N—Bi-112 | Cu—25.0(Mo—28.5 Nb)—5.0 Bi |
| N—Bi-113 | Cu—40.0(Mo—4.7 Nb)—5.0 Bi |
| N—Bi-114 | Cu—40.0(Mo—9.4 Nb)—5.0 Bi |
| N—Bi-115 | Cu—40.0(Mo—18.9 Nb)—5.0 Bi |
| N—Bi-116 | Cu—40.0(Mo—28.5 Nb)—5.0 Bi |
| N—Bi-117 | Cu—25.0(Mo—4.7 Nb)—10.0 Bi |
| N—Bi-118 | Cu—25.0(Mo—9.4 Nb)—10.0 Bi |

TABLE 2-continued

| Sample No. | Composition |
|---|---|
| N—Bi-119 | Cu—25.0(Mo—18.9 Nb)—10.0 Bi |
| N—Bi-120 | Cu—25.0(Mo—28.5 Nb)—10.0 Bi |
| N—Bi-121 | Cu—40.0(Mo—4.7 Nb)—10.0 Bi |
| N—Bi-122 | Cu—40.0(Mo—9.4 Nb)—10.0 Bi |
| N—Bi-123 | Cu—40.0(Mo—18.9 Nb)—10.0 Bi |
| N—Bi-124 | Cu—40.0(Mo—28.5 Nb)—10.0 Bi |
| N—Bi-125 | Cu—25.0(Mo—4.7 Nb)—20.0 Bi |
| N—Bi-126 | Cu—25.0(Mo—9.4 Nb)—20.0 Bi |
| N—Bi-127 | Cu—25.0(Mo—18.0 Nb)—20.0 Bi |
| N—Bi-128 | Cu—25.0(Mo—28.5 Nb)—20.0 Bi |
| N—Bi-129 | Cu—40.0(Mo—4.7 Nb)—20.0 Bi |
| N—Bi-130 | Cu—40.0(Mo—9.4 Nb)—20.0 Bi |
| N—Bi-131 | Cu—40.0(Mo—18.9 Nb)—20.0 Bi |
| N—Bi-132 | Cu—40.0(Mo—28.5 Nb)—20.0 Bi |

TABLE 3

| Sample No. | Composition |
|---|---|
| N—Bi-133 | Cu—25.0(Mo—4.7 Nb)—0.1 Bi |
| N—Bi-134 | Cu—25.0(Mo—9.4 Nb)—0.1 Bi |
| N—Bi-135 | Cu—25.0(Mo—18.9 Nb)—0.1 Bi |
| N—Bi-136 | Cu—25.0(Mo—28.5 Nb)—0.1 Bi |
| N—Bi-137 | Cu—40.0(Mo—4.7 Nb)—0.1 Bi |
| N—Bi-138 | Cu—40.0(Mo—9.4 Nb)—0.1 Bi |
| N—Bi-139 | Cu—40.0(Mo—18.9 Nb)—0.1 Bi |
| N—Bi-140 | Cu—40.0(Mo—28.5 Nb)—0.1 Bi |
| N—Bi-141 | Cu—25.0(Mo—4.7 Nb)—0.5 Bi |
| N—Bi-142 | Cu—25.0(Mo—9.4 Nb)—0.5 Bi |
| N—Bi-143 | Cu—25.0(Mo—18.9 Nb)—0.5 Bi |
| N—Bi-144 | Cu—25.0(Mo—28.5 Nb)—0.5 Bi |
| N—Bi-145 | Cu—40.0(Mo—4.7 Nb)—0.5 Bi |
| N—Bi-146 | Cu—40.0(Mo—9.4 Nb)—0.5 Bi |
| N—Bi-147 | Cu—40.0(Mo—18.9 Nb)—0.5 Bi |
| N—Bi-148 | Cu—40.0(Mo—28.5 Nb)—0.5 Bi |
| N—Bi-149 | Cu—25.0(Mo—4.7 Nb)—1.0 Bi |
| N—Bi-150 | Cu—25.0(Mo—9.4 Nb)—1.0 Bi |
| N—Bi-151 | Cu—25.0(Mo—18.9 Nb)—1.0 Bi |
| N—Bi-152 | Cu—25.0(Mo—28.5 Nb)—1.0 Bi |
| N—Bi-153 | Cu—40.0(Mo—4.7 Nb)—1.0 Bi |
| N—Bi-154 | Cu—40.0(Mo—9.4 Nb)—1.0 Bi |

TABLE 3-continued

| Sample No. | Composition |
|---|---|
| N—Bi-155 | Cu—40.0(Mo—18.9 Nb)—1.0 Bi |
| N—Bi-156 | Cu—40.0(Mo—28.5 Nb)—1.0 Bi |
| N—Bi-157 | Cu—25.0(Mo—4.7 Nb)—5.0 Bi |
| N—Bi-158 | Cu—25.0(Mo—9.4 Nb)—5.0 Bi |
| N—Bi-159 | Cu—25.0(Mo—18.9 Nb)—5.0 Bi |
| N—Bi-160 | Cu—25.0(Mo—28.5 Nb)—5.0 Bi |
| N—Bi-161 | Cu—40.0(Mo—4.7 Nb)—5.0 Bi |
| N—Bi-162 | Cu—40.0(Mo—9.4 Nb)—5.0 Bi |
| N—Bi-163 | Cu—40.0(Mo—18.9 Nb)—5.0 Bi |
| N—Bi-164 | Cu—40.0(Mo—28.5 Nb)—5.0 Bi |
| N—Bi-165 | Cu—25.0(Mo—4.7 Nb)—10.0 Bi |
| N—Bi-166 | Cu—25.0(Mo—9.4 Nb)—10.0 Bi |
| N—Bi-167 | Cu—25.0(Mo—18.9 Nb)—10.0 Bi |
| N—Bi-168 | Cu—25.0(Mo—28.5 Nb)—10.0 Bi |
| N—Bi-169 | Cu—40.0(Mo—4.7 Nb)—10.0 Bi |
| N—Bi-170 | Cu—40.0(Mo—9.4 Nb)—10.0 Bi |
| N—Bi-171 | Cu—40.0(Mo—18.9 Nb)—10.0 Bi |
| N—Bi-172 | Cu—40.0(Mo—28.5 Nb)—10.0 Bi |
| N—Bi-173 | Cu—25.0(Mo—4.7 Nb)—20.0 Bi |
| N—Bi-174 | Cu—25.0(Mo—9.4 Nb)—20.0 Bi |
| N—Bi-175 | Cu—25.0(Mo—18.9 Nb)—20.0 Bi |
| N—Bi-176 | Cu—25.0(Mo—28.5 Nb)—20.0 Bi |
| N—Bi-177 | Cu—40.0(Mo—4.7 Nb)—20.0 Bi |
| N—Bi-178 | Cu—40.0(Mo—9.4 Nb)—20.0 Bi |
| N—Bi-179 | Cu—40.0(Mo—18.9 Nb)—20.0 Bi |
| N—Bi-180 | Cu—40.0(Mo—28.5 Nb)—20.0 Bi |

TABLE 4

| Sample No. | Composition |
|---|---|
| C—1 | Cu—25 Cr |
| C—Bi-1 | Cu—25 Cr—0.1 Bi |
| C—Bi-2 | Cu—25 Cr—0.3 Bi |
| C—Bi-3 | Cu—25 Cr—0.5 Bi |
| C—Bi-4 | Cu—25 Cr—1.0 Bi |
| C—Bi-5 | Cu—25 Cr—5.0 Bi |
| C—Bi-6 | Cu—25 Cr—10.0 Bi |
| C—Bi-7 | Cu—25 Cr—20.0 Bi |
| M—1 | Cu—53.3 Mo |

TABLE 5

| Sample No. | Current breaking property (ratio to Cu—25 Cr) | Voltage withstand capability (ratio to Cu—25 Cr) | Chopping current value (ratio to Cu—25 Cr) | Melt—adhesion & peel force (ratio to Cu—25 Cr) | Power consumption at contact points (ratio to Cu—25 Cr) |
|---|---|---|---|---|---|
| N—Bi-1 | 1.1 | 1.13 | 0.9~1.1 | 0.3~0.4 | 0.2~0.3 |
| N—Bi-2 | 1.6 | 1.2 | | | |
| N—Bi-3 | 1.9 | 1.25 | | | |
| N—Bi-4 | 2.1 | 1.18 | | | |
| N—Bi-5 | 1.7 | 1.2 | | | |
| N—Bi-6 | 1.8 | 1.3 | | | |
| N—Bi-7 | 1.8 | 1.43 | | | |
| N—Bi-8 | 1.9 | 1.4 | | | |
| N—Bi-9 | 1.1 | 1.25 | | | |
| N—Bi-10 | 1.2 | 1.38 | | | |
| N—Bi-11 | 1.5 | 1.5 | | | |
| N—Bi-12 | 1.7 | 1.48 | | | |
| N—Bi-13 | 1.1 | 0.95 | 0.9~11 | (0)~0 | 0.2~0.3 |
| N—Bi-14 | 1.7 | 1.05 | | | |
| N—Bi-15 | 1.9 | 1.15 | | | |
| N—Bi-16 | 2.1 | 1.08 | | | |
| N—Bi-17 | 1.7 | 1.0 | | | |
| N—Bi-18 | 1.9 | 1.15 | | | |
| N—Bi-19 | 1.3 | 13.8 | | | |
| N—Bi-20 | 1.9 | 1.3 | | | |
| N—Bi-21 | 1.2 | 1.03 | | | |
| N—Bi-22 | 1.3 | 1.23 | | | |
| N—Bi-23 | 1.5 | 1.4 | | | |
| N—Bi-24 | 1.7 | 1.38 | | | |
| N—Bi-25 | 1.2 | 0.75 | 0.9~1.1 | (0) | 0.2~0.3 |
| N—Bi-26 | 1.6 | 0.93 | | | |
| N—Bi-27 | 1.9 | 1.05 | | | |
| N—Bi-28 | 2.1 | 1.0 | | | |
| N—Bi-29 | 1.7 | 0.85 | | | |
| N—Bi-30 | 1.8 | 1.03 | | | |
| N—Bi-31 | 1.8 | 1.23 | | | |
| N—Bi-32 | 1.9 | 1.23 | | | |
| N—Bi-33 | 1.2 | 0.88 | | | |

TABLE 5-continued

| Sample No. | Current breaking property (ratio to Cu—25 Cr) | Voltage withstand capability (ratio to Cu—25 Cr) | Chopping current value (ratio to Cu—25 Cr) | Melt—adhesion & peel force (ratio to Cu—25 Cr) | Power consumption at contact points (ratio to Cu—25 Cr) |
|---|---|---|---|---|---|
| N—Bi-34 | 1.3 | 1.1 | | | |
| N—Bi-35 | 1.6 | 1.3 | | | |
| N—Bi-36 | 1.8 | 1.3 | | | |
| N—Bi-37 | 1.1 | 0.55 | 0.7~0.9 | (0) | 0.2~0.3 |
| N—Bi-38 | 1.6 | 0.75 | | | |
| N—Bi-39 | 1.9 | 0.95 | | | |
| N—Bi-40 | 2.1 | 0.95 | | | |
| N—Bi-41 | 1.7 | 0.68 | | | |
| N—Bi-42 | 1.8 | 0.88 | | | |
| N—Bi-43 | 1.8 | 1.15 | | | |
| N—Bi-44 | 1.9 | 1.18 | | | |
| N—Bi-45 | 1.1 | 0.7 | | | |
| N—Bi-46 | 1.2 | 0.95 | | | |
| N—Bi-47 | 1.5 | 1.23 | | | |
| N—Bi-48 | 1.7 | 1.25 | | | |
| N—Bi-49 | 1.0 | 0.45 | 0.4~0.6 | (0) | 0.2~0.3 |
| N—Bi-50 | 1.5 | 0.68 | | | |
| N—Bi-51 | 1.8 | 0.8 | | | |
| N—Bi-52 | 2.1 | 0.88 | | | |
| N—Bi-53 | 1.6 | 0.58 | | | |
| N—Bi-54 | 1.8 | 0.83 | | | |
| N—Bi-55 | 1.8 | 1.05 | | | |
| N—Bi-56 | 1.9 | 1.08 | | | |
| N—Bi-57 | 1.1 | 0.6 | | | |
| N—Bi-58 | 1.2 | 0.88 | | | |
| N—Bi-59 | 1.5 | 1.1 | | | |
| N—Bi-60 | 1.7 | 1.18 | | | |
| N—Bi-61 | 0.9 | 0.35 | 0.3~0.5 | (0) | 0.2~0.3 |
| N—Bi-62 | 1.5 | 0.6 | | | |
| N—Bi-63 | 1.7 | 0.7 | | | |
| N—Bi-64 | 2.0 | 0.83 | | | |
| N—Bi-65 | 1.5 | 0.48 | | | |
| N—Bi-66 | 1.7 | 0.75 | | | |
| N—Bi-67 | 1.7 | 0.98 | | | |
| N—Bi-68 | 1.8 | 1.03 | | | |
| N—Bi-69 | 1.0 | 0.53 | | | |
| N—Bi-70 | 1.2 | 0.83 | | | |
| N—Bi-71 | 1.4 | 1.03 | | | |
| N—Bi-72 | 1.7 | 1.1 | | | |
| N—Bi-73 | 0.6 | 0.3 | 0.2~0.3 | (0) | 0.2~0.3 |
| N—Bi-74 | 1.2 | 0.5 | | | |
| N—Bi-75 | 1.5 | 0.63 | | | |
| N—Bi-76 | 1.8 | 0.75 | | | |
| N—Bi-77 | 1.2 | 0.43 | | | |
| N—Bi-78 | 1.4 | 0.68 | | | |
| N—Bi-79 | 1.5 | 0.88 | | | |
| N—Bi-80 | 1.6 | 0.95 | | | |
| N—Bi-81 | 0.8 | 0.45 | | | |
| N—Bi-82 | 1.0 | 0.75 | | | |
| N—Bi-83 | 1.3 | 0.95 | | | |
| N—Bi-84 | 1.5 | 1.03 | | | |
| N—Bi-85 | 1.7 | 1.2 | 0.9~1.1 | 0.3~0.4 | 0.5~0.7 |
| N—Bi-86 | 1.3 | 1.15 | | | |
| N—Bi-87 | 1.8 | 1.2 | | | |
| N—Bi-88 | 1.9 | 1.15 | | | |
| N—Bi-89 | 1.4 | 1.15 | | | 0.2~0.3 |
| N—Bi-90 | 1.6 | 1.2 | | | |
| N—Bi-91 | 1.8 | 1.23 | | | |
| N—Bi-92 | 2.0 | 1.2 | | | |
| N—Bi-93 | 1.7 | 0.73 | 0.9~1.1 | (0) | 0.5~0.7 |
| N—Bi-94 | 1.8 | 0.78 | | | |
| N—Bi-95 | 1.8 | 0.9 | | | |
| N—Bi-96 | 1.9 | 0.9 | | | |
| N—Bi-97 | 1.4 | 0.78 | | | 0.2~0.3 |
| N—Bi-98 | 1.6 | 0.93 | | | |
| N—Bi-99 | 1.8 | 1.05 | | | |
| N—Bi-100 | 2.0 | 1.05 | | | |
| N—Bi-101 | 1.7 | 0.5 | 0.7~0.9 | (0) | 0.5~0.7 |
| N—Bi-102 | 1.8 | 0.55 | | | |
| N—Bi-103 | 1.8 | 0.7 | | | |
| N—Bi-104 | 1.9 | 0.75 | | | |
| N—Bi-105 | 1.4 | 0.55 | | | 0.2~0.3 |
| N—Bi-106 | 1.6 | 0.75 | | | |
| N—Bi-107 | 1.8 | 0.95 | | | |
| N—Bi-108 | 2.0 | 0.98 | | | |
| N—Bi-109 | 1.6 | 0.38 | 0.4~0.6 | (0) | 0.5~0.7 |
| N—Bi-110 | 1.7 | 0.45 | | | |
| N—Bi-111 | 1.7 | 0.6 | | | |
| N—Bi-112 | 1.8 | 0.68 | | | |

TABLE 5-continued

| Sample No. | Current breaking property (ratio to Cu—25 Cr) | Voltage withstand capability (ratio to Cu—25 Cr) | Chopping current value (ratio to Cu—25 Cr) | Melt—adhesion & peel force (ratio to Cu—25 Cr) | Power consumption at contact points (ratio to Cu—25 Cr) |
|---|---|---|---|---|---|
| N—Bi-113 | 1.3 | 0.45 | | | 0.2~0.3 |
| N—Bi-114 | 1.5 | 0.68 | | | |
| N—Bi-115 | 1.7 | 0.83 | | | |
| N—Bi-116 | 2.0 | 0.9 | | | |
| N—Bi-117 | 1.4 | 0.3 | 0.3~0.5 | (0) | 0.5~0.7 |
| N—Bi-118 | 1.5 | 0.38 | | | |
| N—Bi-119 | 1.6 | 0.53 | | | |
| N—Bi-120 | 1.7 | 0.63 | | | |
| N—Bi-121 | 1.2 | 0.38 | | | 0.2~0.3 |
| N—Bi-122 | 1.4 | 0.6 | | | |
| N—Bi-123 | 1.7 | 0.73 | | | |
| N—Bi-124 | 1.9 | 0.85 | | | |
| N—Bi-125 | 1.0 | 0.23 | 0.2~0.3 | (0) | 0.5~0.7 |
| N—Bi-126 | 1.2 | 0.3 | | | |
| N—Bi-127 | 1.3 | 0.43 | | | |
| N—Bi-128 | 1.5 | 0.55 | | | |
| N—Bi-129 | 0.9 | 0.3 | | | 0.2~0.3 |
| N—Bi-130 | 1.2 | 0.5 | | | |
| N—Bi-131 | 1.4 | 0.65 | | | |
| N—Bi-132 | 1.7 | 0.78 | | | |
| N—Bi-133 | 1.7 | 1.18 | 0.9~1.1 | 0.3~0.4 | 0.5~0.7 |
| N—Bi-134 | 1.8 | 1.28 | | | |
| N—Bi-135 | 1.9 | 1.3 | | | |
| N—Bi-136 | 1.9 | 1.18 | | | |
| N—Bi-137 | 1.8 | 1.15 | | | 0.2~0.3 |
| N—Bi-138 | 1.9 | 1.23 | | | |
| N—Bi-139 | 2.1 | 1.3 | | | |
| N—Bi-140 | 2.1 | 1.13 | | | |
| N—Bi-141 | 1.7 | 0.75 | 0.9~1.1 | (0) | 0.5-0.7 |
| N—Bi-142 | 1.8 | 0.9 | | | |
| N—Bi-143 | 1.9 | 1.0 | | | |
| N—Bi-144 | 1.9 | 0.95 | | | |
| N—Bi-145 | 1.8 | 0.78 | 0.9~1.1 | (0) | 0.2~0.3 |
| N—Bi-146 | 1.9 | 0.95 | | | |
| N—Bi-147 | 2.1 | 1.13 | | | |
| N—Bi-148 | 2.1 | 0.98 | | | |
| N—Bi-149 | 1.7 | 0.53 | 0.7~0.9 | (0) | 0.5~0.7 |
| N—Bi-150 | 1.8 | 0.68 | | | |
| N—Bi-151 | 1.9 | 0.8 | | | |
| N—Bi-152 | 1.9 | 0.78 | | | |
| N—Bi-153 | 1.8 | 0.55 | | | 0.2~0.3 |
| N—Bi-154 | 1.9 | 0.78 | | | |
| N—Bi-155 | 2.1 | 1.03 | | | |
| N—Bi-156 | 2.1 | 0.9 | | | |
| N—Bi-157 | 1.6 | 0.4 | 0.4~0.6 | (0) | 0.5~0.7 |
| N—Bi-158 | 1.7 | 0.58 | | | |
| N—Bi-159 | 1.8 | 0.7 | | | |
| N—Bi-160 | 1.9 | 0.7 | | | |
| N—Bi-161 | 1.7 | 0.45 | | | 0.2~0.3 |
| N—Bi-162 | 1.8 | 0.7 | | | |
| N—Bi-163 | 2.0 | 0.9 | | | |
| N—Bi-164 | 2.1 | 0.82 | | | |
| N—Bi-165 | 1.5 | 0.33 | 0.3~0.5 | (0) | 0.5~0.7 |
| N—Bi-166 | 1.6 | 0.5 | | | |
| N—Bi-167 | 1.7 | 0.63 | | | |
| N—Bi-168 | 1.7 | 0.65 | | | |
| N—Bi-169 | 1.6 | 0.38 | | | 0.2~0.3 |
| N—Bi-170 | 1.7 | 0.73 | | | |
| N—Bi-171 | 1.9 | 0.8 | | | |
| N—Bi-172 | 2.0 | 0.78 | | | |
| N—Bi-173 | 1.1 | 0.28 | 0.2~0.3 | (0) | 0.5~0.7 |
| N—Bi-174 | 1.3 | 0.43 | | | |
| N—Bi-175 | 1.4 | 0.53 | | | |
| N—Bi-176 | 1.5 | 0.58 | | | |
| N—Bi-177 | 1.4 | 0.3 | | | |
| N—Bi-178 | 1.5 | 0.53 | | | |
| N—Bi-179 | 1.7 | 0.73 | | | |
| N—Bi-180 | 1.3 | 0.73 | | | |

TABLE 6

| Sample No. | Current breaking property (ratio to Cu—25 Cr) | Voltage withstand capability (ratio to Cu—25 Cr) | Chopping current value (ratio to Cu—25 Cr) | Melt-adhesion & peel force (ratio to Cu—25 Cr) | Power consumption at contact points (ratio to Cu—25 Cr) |
|---|---|---|---|---|---|
| C-1 | 1 | 1 | 1 | 1 | 1 |
| | | | (0.9~1.1) | (0.8~1.2) | (0.9~1.1) |
| C—Bi-1 | 1 | 0.58 | 0.9~1.1 | 0.3~0.5 | 0.9~1.1 |

TABLE 6-continued

| Sample No. | Current breaking property (ratio to Cu—25 Cr) | Voltage withstand capability (ratio to Cu—25 Cr) | Chopping current value (ratio to Cu—25 Cr) | Melt-adhesion & peel force (ratio to Cu—25 Cr) | Power consumption at contact points (ratio to Cu—25 Cr) |
|---|---|---|---|---|---|
| C—Bi-2 | 1 | 0.5 | 0.9~1.1 | (0) | 0.9~1.1 |
| C—Bi-3 | 0.98 | 0.35 | 0.9~1.1 | (0) | 0.9~1.1 |
| C—Bi-4 | 0.97 | 0.3 | 0.7~0.9 | (0) | 0.9~1.1 |
| C—Bi-5 | 0.92 | 0.25 | 0.4~0.6 | (0) | 0.9~1.1 |
| C—Bi-6 | 0.80 | 0.23 | 0.3~0.5 | (0) | 0.9~1.1 |
| C—Bi-7 | 0.51 | 0.2 | 0.2~0.3 | (0) | 0.9~1.1 |
| M-1 | 0.4 | 1.5 | 0.9~1.1 | 0.3~0.4 | 0.2~0.3 |

TABLE 7

| Sample No. | Composition |
|---|---|
| N—Te-1 | Cu—52.9(Mo—4.7Nb)—0.1Te |
| N—Te-2 | Cu—53.0 (Mo—4.7 Nb)—20.0 Te |
| N—Te-3 | Cu—52.3 (Mo—28.5 Nb)—20.0 Te |
| N—Te-4 | Cu—25.0 (Mo—4.7 Nb)—0.1 Te |
| N—Te-5 | Cu—40.0 (Mo—4.7 Nb)—20.0 Te |
| N—Te-6 | Cu—25.0 (Mo—4.7 Nb)—0.1 Te |
| N—Te-7 | Cu—40.0 (Mo—4.7 Nb)—20.0 Te |
| N—Sb-1 | Cu—53.1 (Mo—4.7 Nb)—0.1 Sb |
| N—Sb-2 | Cu—52.9 (Mo—4.7 Nb)—20.0 Sb |
| N—Sb-3 | Cu—52.1 (Mo—28.5 Nb)—20.0 Sb |
| N—Sb-4 | Cu—25.0 (Mo—4.7 Nb)—0.1 Sb |
| N—Sb-5 | Cu—40.0 (Mo—4.7 Nb)—20.0 Sb |
| N—Sb-6 | Cu—25.0 (Mo—4.7 Nb)—0.1 Sb |

TABLE 7-continued

| Sample No. | Composition |
|---|---|
| N—Pb-4 | Cu—25.0 (Mo—4.7 Nb)—0.1 Pb |
| N—Pb-5 | Cu—40.0 (Mo—4.7 Nb)—20.0 Pb |
| N—Pb-6 | Cu—25.0 (Mo—4.7 Nb)—0.1 Pb |
| N—Pb-7 | Cu—40.0 (Mo—4.7 Nb)—20.0 Pb |
| N—BT-1 | Cu—53.1 (Mo—4.7 Nb)—0.1 Bi—0.1 Te |
| N—BT-2 | Cu—53.1 (Mo—4.7 Nb)—10.0 Bi—10.0 Te |
| N—BT-3 | Cu—52.0 (Mo—28.5 Nb)—10.0 Bi—10.0 Te |
| N—BT-4 | Cu—25.0 (Mo—4.7 Nb)—0.1 Bi—0.1 Te |
| N—BT-5 | Cu—40.0 (Mo—4.7 Nb)—10.0 Bi—10.0 Te |
| N—BT-6 | Cu—25.0 (Mo—4.7 Nb)—0.1 Bi—0.1 Te |
| N—BT-7 | Cu—40.0 (Mo—4.7 Nb)—10.0 Bi—10.0 Te |

TABLE 8

| Sample No. | Current breaking property (ratio to Cu—25 Cr) | Voltage withstand capability (ratio to Cu—25 Cr) | Chopping current value (ratio to Cu—25 Cr) | Melt-adhesion & peel force (ratio to Cu—25 Cr) | Power consumption at contact points (ratio to Cu—25 Cr) |
|---|---|---|---|---|---|
| N—Te-1 | 1.7 | 1.20 | 0.9~1.1 | 0.3~0.4 | 0.2~0.3 |
| N—Te-2 | 1.0 | 0.40 | 0.2~0.3 | (0) | 0.2~0.3 |
| N—Te-3 | 1.5 | 0.93 | 0.2~0.3 | (0) | 0.2~0.3 |
| N—Te-4 | 1.7 | 1.13 | 0.9~1.1 | 0.3~0.4 | 0.5~0.7 |
| N—Te-5 | 0.8 | 0.28 | 0.2~0.3 | (0) | 0.2~0.3 |
| N—Te-6 | 1.7 | 1.05 | 0.9~1.1 | 0.3~0.4 | 0.5~0.7 |
| N—Te-7 | 1.4 | 0.30 | 0.2~0.3 | (0) | 0.2~0.3 |
| N—Sb-1 | 1.7 | 1.23 | 0.9~1.1 | 0.3~0.4 | 0.2~0.3 |
| N—Sb-2 | 1.0 | 0.43 | 0.2~0.3 | (0) | 0.2~0.3 |
| N—Sb-3 | 1.4 | 0.95 | 0.2~0.3 | (0) | 0.2~0.3 |
| N—Sb-4 | 1.7 | 1.15 | 0.9~1.1 | 0.3~0.4 | 0.5~0.7 |
| N—Sb-5 | 0.9 | 0.30 | 0.2~0.3 | (0) | 0.2~0.3 |
| N—Sb-6 | 1.7 | 1.15 | 0.9~1.1 | 0.3~0.4 | 0.5~0.7 |
| N—Sb-7 | 1.4 | 0.33 | 0.2~0.3 | (0) | 0.2~0.3 |
| N—Tl-1 | 1.7 | 1.20 | 0.9~1.1 | 0.3~0.4 | 0.2~0.3 |
| N—Tl-2 | 1.2 | 0.38 | 0.2~0.3 | (0) | 0.2~0.3 |
| N—Tl-3 | 1.5 | 0.90 | 0.2~0.3 | (0) | 0.2~0.3 |
| N—Tl-4 | 1.7 | 1.10 | 0.9~1.1 | 0.3~0.4 | 0.5~0.7 |
| N—Tl-5 | 0.8 | 0.28 | 0.2~0.3 | (0) | 0.2~0.3 |
| N—Tl-6 | 1.7 | 1.10 | 0.9~1.1 | 0.3~0.4 | 0.5~0.7 |
| N—Tl-7 | 1.3 | 0.33 | 0.2~0.3 | (0) | 0.2~0.3 |
| N—Pb-1 | 1.6 | 1.18 | 0.9~1.1 | 0.3~0.4 | 0.2~0.3 |
| N—Pb-2 | 1.0 | 0.38 | 0.2~0.3 | (0) | 0.2~0.3 |
| N—Pb-3 | 1.4 | 0.88 | 0.2~0.3 | (0) | 0.2~0.3 |
| N—Pb-4 | 1.7 | 1.08 | 0.9~1.1 | 0.3~0.4 | 0.5~0.7 |
| N—Pb-5 | 0.7 | 0.28 | 0.2~0.3 | (0) | 0.2~0.3 |
| N—Pb-6 | 1.6 | 1.05 | 0.9~1.1 | 0.3~0.4 | 0.5~0.7 |
| N—Pb-7 | 1.3 | 0.30 | 0.2~0.3 | (0) | 0.2~0.3 |
| N—BT-1 | 1.7 | 1.18 | 0.9~1.1 | (0)~0.1 | 0.2~0.3 |
| N—BT-2 | 1.3 | 0.45 | 0.2~0.3 | (0) | 0.2~0.3 |
| N—BT-3 | 1.6 | 1.0 | 0.2~0.3 | (0) | 0.2~0.3 |
| N—BT-4 | 1.7 | 1.20 | 0.9~1.1 | (0)~0.1 | 0.5~0.7 |
| N—BT-5 | 1.1 | 0.33 | 0.2~0.3 | (0) | 0.2~0.3 |
| N—BT-6 | 1.7 | 1.20 | 0.9~1.1 | (0)~0.1 | 0.5~0.7 |
| N—BT-7 | 1.5 | 0.33 | 0.2~0.3 | (0) | 0.2~0.3 |

| | |
|---|---|
| N—Sb-7 | Cu—40.0 (Mo—4.7 Nb)—20.0 Sb |
| N—Tl-1 | Cu—53.0 (Mo—4.7 Nb)—0.1 Tl |
| N—Tl-2 | Cu—53.1 (Mo—4.7 Nb)—20.0 Tl |
| N—Tl-3 | Cu—52.0 (Mo—28.5 Nb)—20.0 Tl |
| N—Tl-4 | Cu—25.0 (Mo—4.7 Nb)—0.1 Tl |
| N—Tl-5 | Cu—40.0 (Mo—4.7 Nb)—20.0 Tl |
| N—Tl-6 | Cu—25.0 (Mo—4.7 Nb)—0.1 Tl |
| N—Tl-7 | Cu—40.0 (Mo—4.7 Nb)—20.0 Tl |
| N—Pb-1 | Cu—52.9 (Mo—4.7 Nb)—0.1 Pb |
| N—Pb-2 | Cu—53.1 (Mo—4.7 Nb)—20.0 Pb |
| N—Pb-3 | Cu—52.2 (Mo—28.5 Nb)—20.0 Pb |

TABLE 9

| Sample No. | Composition |
|---|---|
| T—Bi-1 | Cu—44.1 (Mo—8.8 Ta)—0.1 Bi |
| T—Bi-2 | Cu—44.9 (Mo—17.0 Ta)—0.1 Bi |
| T—Bi-3 | Cu—46.5 (Mo—31.5 Ta)—0.1 Bi |
| T—Bi-4 | Cu—47.9 (Mo—44.1 Ta)—0.1 Bi |
| T—Bi-5 | Cu—54.2 (Mo—8.8 Ta)—0.1 Bi |
| T—Bi-6 | Cu—55.0 (Mo—17.0 Ta)—0.1 Bi |
| T—Bi-7 | Cu—56.6 (Mo—31.5 Ta)—0.1 Bi |

TABLE 9-continued

| Sample No. | Composition |
|---|---|
| T—Bi-8 | Cu—57.9 (Mo—44.1 Ta)—0.1 Bi |
| T—Bi-9 | Cu—64.0 (Mo—8.8 Ta)—0.1 Bi |
| T—Bi-10 | Cu—64.7 (Mo—17.0 Ta)—0.1 Bi |
| T—Bi-11 | Cu—66.1 (Mo—31.5 Ta)—0.1 Bi |
| T—Bi-12 | Cu—67.4 (Mo—44.1 Ta)—0.1 Bi |
| T—Bi-13 | Cu—44.1 (Mo—8.8 Ta)—0.3 Bi |
| T—Bi-14 | Cu—44.9 (Mo—17.0 Ta)—0.3 Bi |
| T—Bi-15 | Cu—46.5 (Mo—31.5 Ta)—0.3 Bi |
| T—Bi-16 | Cu—47.9 (Mo—44.1 Ta)—0.3 Bi |
| T—Bi-17 | Cu—54.2 (Mo—8.8 Ta)—0.3 Bi |
| T—Bi-18 | Cu—55.0 (Mo—17.0 Ta)—0.3 Bi |
| T—Bi-19 | Cu—56.6 (Mo—31.5 Ta)—0.3 Bi |
| T—Bi-20 | Cu—57.9 (Mo—44.1 Ta)—0.3 Bi |
| T—Bi-21 | Cu—64.0 (Mo—8.8 Ta)—0.3 Bi |
| T—Bi-22 | Cu—64.7 (Mo—17.0 Ta)—0.3 Bi |
| T—Bi-23 | Cu—66.1 (Mo—31.5 Ta)—0.3 Bi |
| T—Bi-24 | Cu—67.4 (Mo—44.1 Ta)—0.3 Bi |
| T—Bi-25 | Cu—44.1 (Mo—8.8 Ta)—0.5 Bi |
| T—Bi-26 | Cu—44.9 (Mo—17.0 Ta)—0.5 Bi |
| T—Bi-27 | Cu—46.5 (Mo—31.5 Ta)—0.5 Bi |
| T—Bi-28 | Cu—47.9 (Mo—44.1 Ta)—0.5 Bi |
| T—Bi-29 | Cu—54.2 (Mo—8.8 Ta)—0.5 Bi |
| T—Bi-30 | Cu—55.0 (Mo—17.0 Ta)—0.5 Bi |
| T—Bi-31 | Cu—56.6 (Mo—31.5 Ta)—0.5 Bi |
| T—Bi-32 | Cu—57.9 (Mo—44.1 Ta)—0.5 Bi |
| T—Bi-33 | Cu—64.0 (Mo—8.8 Ta)—0.5 Bi |
| T—Bi-34 | Cu—64.7 (Mo—17.0 Ta)—0.5 Bi |
| T—Bi-35 | Cu—66.1 (Mo—31.5 Ta)—0.5 Bi |
| T—Bi-36 | Cu—67.4 (Mo—44.1 Ta)—0.5 Bi |
| T—Bi-37 | Cu—44.1 (Mo—8:8 Ta)—1.0 Bi |
| T—Bi-38 | Cu—44.9 (Mo—17.0 Ta)—1.0 Bi |
| T—Bi-39 | Cu—46.5 (Mo—31.5 Ta)—1.0 Bi |
| T—Bi-40 | Cu—47.9 (Mo—44.1 Ta)—1.0 Bi |
| T—Bi-41 | Cu—54.2 (Mo—8.8 Ta)—1.0 Bi |
| T—Bi-42 | Cu—55.0 (Mo—17.0 Ta)—1.0 Bi |
| T—Bi-43 | Cu—56.6 (Mo—31.5 Ta)—1.0 Bi |
| T—Bi-44 | Cu—57.9 (Mo—44.1 Ta)—1.0 Bi |
| T—Bi-45 | Cu—64.0 (Mo—8.8 Ta)—1.0 Bi |
| T—Bi-46 | Cu—64.7 (Mo—17.0 Ta)—1.0 Bi |
| T—Bi-47 | Cu—66.1 (Mo—31.5 Ta)—1.0 Bi |
| T—Bi-48 | Cu—67.4 (Mo—44.1 Ta)—1.0 Bi |
| T—Bi-49 | Cu—44.1 (Mo—8.8 Ta)—5.0 Bi |
| T—Bi-50 | Cu—44.9 (Mo—17.0 Ta)—5.0 Bi |
| T—Bi-51 | Cu—46.5 (Mo—31.5 Ta)—5.0 Bi |
| T—Bi-52 | Cu—47.9 (Mo—44.1 Ta)—5.0 Bi |
| T—Bi-53 | Cu—54.2 (Mo—8.8 Ta)—5.0 Bi |
| T—Bi-54 | Cu—55.0 (Mo—17.0 Ta)—5.0 Bi |
| T—Bi-55 | Cu—56.6 (Mo—31.5 Ta)—5.0 Bi |
| T—Bi-56 | Cu—57.9 (Mo—44.1 Ta)—5.0 Bi |
| T—Bi-57 | Cu—64.0 (Mo—8.8 Ta)—5.0 Bi |
| T—Bi-58 | Cu—64.7 (Mo—17.0 Ta)—5.0 Bi |
| T—Bi-59 | Cu—66.1 (Mo—31.5 Ta)—5.0 Bi |
| T—Bi-60 | Cu—67.4 (Mo—44.1 Ta)—5.0 Bi |
| T—Bi-61 | Cu—44.1 (Mo—8.8 Ta)—10.0 Bi |
| T—Bi-62 | Cu—44.9 (Mo—17.0 Ta)—10.0 Bi |
| T—Bi-63 | Cu—46.5 (Mo—31.5 Ta)—10.0 Bi |
| T—Bi-64 | Cu—47.9 (Mo—44.1 Ta)—10.0 Bi |
| T—Bi-65 | Cu—54.2 (Mo—8.8 Ta)—10.0 Bi |
| T—Bi-66 | Cu—55.0 (Mo—17.0 Ta)—10.0 Bi |
| T—Bi-67 | Cu—56.6 (Mo—31.5 Ta)—10.0 Bi |
| T—Bi-68 | Cu—57.9 (Mo—44.1 Ta)—10.0 Bi |
| T—Bi-69 | Cu—64.0 (Mo—8.8 Ta)—10.0 Bi |
| T—Bi-70 | Cu—64.7 (Mo—17.0 Ta)—10.0 Bi |
| T—Bi-71 | Cu—66.1 (Mo—31.5 Ta)—10.0 Bi |
| T—Bi-72 | Cu—67.4 (Mo—44.1 Ta)—10.0 Bi |
| T—Bi-73 | Cu—44.1 (Mo—8.8 Ta)—20.0 Bi |
| T—Bi-74 | Cu—44.9 (Mo—17.0 Ta)—20.0 Bi |
| T—Bi-75 | Cu—46.5 (Mo—31.5 Ta)—20.0 Bi |
| T—Bi-76 | Cu—47.9 (Mo—44.1 Ta)—20.0 Bi |
| T—Bi-77 | Cu—54.2 (Mo—8.8 Ta)—20.0 Bi |
| T—Bi-78 | Cu—55.0 (Mo—17.0 Ta)—20.0 Bi |
| T—Bi-79 | Cu—56.6 (Mo—31.5 Ta)—20.0 Bi |
| T—Bi-80 | Cu—57.9 (Mo—44.1 Ta)—20.0 Bi |
| T—Bi-81 | Cu—64.0 (Mo—8.8 Ta)—20.0 Bi |
| T—Bi-82 | Cu—64.7 (Mo—17.0 Ta)—20.0 Bi |
| T—Bi-83 | Cu—66.1 (Mo—31.5 Ta)—20.0 Bi |
| T—Bi-84 | Cu—67.4 (Mo—44.1 Ta)—20.0 Bi |

| Sample No. | Composition |
|---|---|
| T—Bi-85 | Cu—25.0 (Mo—8.8 Ta)—0.1 Bi |
| T—Bi-86 | Cu—25.0 (Mo—17.0 Ta)—0.1 Bi |
| T—Bi-87 | Cu—25.0 (Mo—31.5 Ta)—0.1 Bi |
| T—Bi-88 | Cu—25.0 (Mo—44.1 Ta)—0.1 Bi |
| T—Bi-89 | Cu—40.0 (Mo—8.8 Ta)—0.1 Bi |
| T—Bi-90 | Cu—40.0 (Mo—17.0 Ta)—0.1 Bi |
| T—Bi-91 | Cu—40.0 (Mo—31.5 Ta)—0.1 Bi |
| T—Bi-92 | Cu—40.0 (Mo—44.1 Ta)—0.1 Bi |
| T—Bi-93 | Cu—25.0 (Mo—8.8 Ta)—0.5 Bi |
| T—Bi-94 | Cu—25.0 (Mo—17.0 Ta)—0.5 Bi |
| T—Bi-95 | Cu—25.0 (Mo—31.5 Ta)—0.5 Bi |
| T—Bi-96 | Cu—25.0 (Mo—44.1 Ta)—0.5 Bi |
| T—Bi-97 | Cu—40.0 (Mo—8.8 Ta)—0.5 Bi |
| T—Bi-98 | Cu—40.0 (Mo—17.0 Ta)—0.5 Bi |
| T—Bi-99 | Cu—40.0 (Mo—31.5 Ta)—0.5 Bi |
| T—Bi-100 | Cu—40.0 (Mo—44.1 Ta)—0.5 Bi |
| T—Bi-101 | Cu—25.0 (Mo—8.8 Ta)—1.0 Bi |
| T—Bi-102 | Cu—25.0 (Mo—17.0 Ta)—1.0 Bi |
| T—Bi-103 | Cu—25.0 (Mo—31.5 Ta)—1.0 Bi |
| T—Bi-104 | Cu—25.0 (Mo—44.1 Ta)—1.0 Bi |
| T—Bi-105 | Cu—40.0 (Mo—8.8 Ta)—1.0 Bi |
| T—Bi-106 | Cu—40.0 (Mo—17.0 Ta)—1.0 Bi |
| T—Bi-107 | Cu—40.0 (Mo—31.5 Ta)—1.0 Bi |
| T—Bi-108 | Cu—40.0 (Mo—44.1 Ta)—1.0 Bi |
| T—Bi-109 | Cu—25.0 (Mo—8.8 Ta)—5.0 Bi |
| T—Bi-110 | Cu—25.0 (Mo—17.0 Ta)—5.0 Bi |
| T—Bi-111 | Cu—25.0 (Mo—31.5 Ta)—5.0 Bi |
| T—Bi-112 | Cu—25.0 (Mo—44.1 Ta)—5.0 Bi |
| T—Bi-113 | Cu—40.0 (Mo—8.8 Ta)—5.0 Bi |
| T—Bi-114 | Cu—40.0 (Mo—17.0 Ta)—5.0 Bi |
| T—Bi-115 | Cu—40.0 (Mo—31.5 Ta)—5.0 Bi |
| T—Bi-116 | Cu—40.0 (Mo—44.1 Ta)—5.0Bi |

| Sample No. | Composition |
|---|---|
| T-Bi-117 | Cu-25.0 (Mo-8.8 Ta)-10.0 Bi |
| T-Bi-118 | Cu-25.0 (Mo-17.0 Ta)-10.0 Bi |
| T-Bi-119 | Cu-25.0 (Mo-31.5 Ta)-10.0 Bi |
| T-Bi-120 | Cu-25.0 (Mo-44.1 Ta)-10.0 Bi |
| T-Bi-121 | Cu-40.0 (Mo-8.8 Ta)-10.0 Bi |
| T-Bi-122 | Cu-40.0 (Mo-17.0 Ta)-10.0 Bi |
| T-Bi-123 | Cu-40.0 (Mo-31.5 Ta)-10.0 Bi |
| T-Bi-124 | Cu-40.0 (Mo-44.1 Ta)-10.0 Bi |
| T-Bi-125 | Cu-25.0 (Mo-8.8 Ta)-20.0 Bi |
| T-Bi-126 | Cu-25.0 (Mo-17.0 Ta)-20.0 Bi |
| T-Bi-127 | Cu-25.0 (Mo-31.5 Ta)-20.0 Bi |
| T-Bi-128 | Cu-25.0 (Mo-44.1 Ta)-20.0 Bi |
| T-Bi-129 | Cu-40.0 (Mo-8.8 Ta)-20.0 Bi |
| T-Bi-130 | Cu-40.0 (Mo-17.0 Ta)-20.0 Bi |
| T-Bi-131 | Cu-40.0 (Mo-31.5 Ta)-20.0 Bi |
| T-Bi-132 | Cu-40.0 (Mo-44.1 Ta)-20.0 Bi |

TABLE 11

| Sample No. | Composition |
|---|---|
| T-Bi-133 | Cu-25.0 (Mo-8.8 Ta)-0.1 Bi |
| T-Bi-134 | Cu-25.0 (Mo-17.0 Ta)-0.1 Bi |
| T-Bi-135 | Cu-25.0 (Mo-31.5 Ta)-0.1 Bi |
| T-Bi-136 | Cu-25.0 (Mo-44.1 Ta)-0.1 Bi |
| T-Bi-137 | Cu-40.0 (Mo-8.8 Ta)-0.1 Bi |
| T-Bi-138 | Cu-40.0 (Mo-17.0 Ta)-0.1 Bi |
| T-Bi-139 | Cu-40.0 (Mo-31.5 Ta)-0.1 Bi |
| T-Bi-140 | Cu-40.0 (Mo-44.1 Ta)-0.1 Bi |
| T-Bi-141 | Cu-25.0 (Mo-8.8 Ta)-0.5 Bi |
| T-Bi-142 | Cu-25.0 (Mo-17.0 Ta)-0.5 Bi |
| T-Bi-143 | Cu-25.0 (Mo-31.5 Ta)-0.5 Bi |
| T-Bi-144 | Cu-25.0 (Mo-44.1 Ta)-0.5 Bi |
| T-Bi-145 | Cu-40.0 (Mo-8.8 Ta)-0.5 Bi |
| T-Bi-146 | Cu-40.0 (Mo-17.0 Ta)-0.5 Bi |
| T-Bi-147 | Cu-40.0 (Mo-31.5 Ta)-0.5 Bi |
| T-Bi-148 | Cu-40.0 (Mo-44.1 Ta)-0.5 Bi |
| T-Bi-149 | Cu-25.0 (Mo-8.8 Ta)-1.0 Bi |
| T-Bi-150 | Cu-25.0 (Mo-17.0 Ta)-1.0 Bi |
| T-Bi-151 | Cu-25.0 (Mo-31.5 Ta)-1.0 Bi |
| T-Bi-152 | Cu-25.0 (Mo-44.1 Ta)-1.0 Bi |
| T-Bi-153 | Cu-40.0 (Mo-8.8 Ta)-1.0 Bi |
| T-Bi-154 | Cu-40.0 (Mo-17.0 Ta)-1.0 Bi |

TABLE 11-continued

| Sample No. | Composition |
|---|---|
| T-Bi-155 | Cu-40.0 (Mo-31.5 Ta)-1.0 Bi |
| T-Bi-156 | Cu-40.0 (Mo-44.1 Ta)-1.0 Bi |
| T-Bi-157 | Cu-25.0 (Mo-8.8 Ta)-5.0 Bi |
| T-Bi-158 | Cu-25.0 (Mo-17.0 Ta)-5.0 Bi |
| T-Bi-159 | Cu-25.0 (Mo-31.5 Ta)-5.0 Bi |
| T-Bi-160 | Cu-25.0 (Mo-44.1 Ta)-5.0 Bi |
| T-Bi-161 | Cu-40.0 (Mo-8.8 Ta)-5.0 Bi |
| T-Bi-162 | Cu-40.0 (Mo-17.0 Ta)-5.0 Bi |
| T-Bi-163 | Cu-40.0 (Mo-31.5 Ta)-5.0 Bi |
| T-Bi-164 | Cu-40.0 (Mo-44.1 Ta)-5.0 Bi |
| T-Bi-165 | Cu-25.0 (Mo-8.8 Ta)-10.0 Bi |
| T-Bi-166 | Cu-25.0 (Mo-17.0 Ta)-10.0 Bi |
| T-Bi-167 | Cu-25.0 (Mo-31.5 Ta)-10.0 Bi |

TABLE 11-continued

| Sample No. | Composition |
|---|---|
| T-Bi-168 | Cu-25.0 (Mo-44.1 Ta)-10.0 Bi |
| T-Bi-169 | Cu-40.0 (Mo-8.8 Ta)-10.0 Bi |
| T-Bi-170 | Cu-40.0 (Mo-17.0 Ta)-10.0 Bi |
| T-Bi-171 | Cu-40.0 (Mo-31.5 Ta)-10.0 Bi |
| T-Bi-172 | Cu-40.0 (Mo-44.1 Ta)-10.0 Bi |
| T-Bi-173 | Cu-25.0 (Mo-8.8 Ta)-20.0 Bi |
| T-Bi-174 | Cu-25.0 (Mo-17.0 Ta)-20.0 Bi |
| T-Bi-175 | Cu-25.0 (Mo-31.5 Ta)-20.0 Bi |
| T-Bi-176 | Cu-25.0 (Mo-44.1 Ta)-20.0 Bi |
| T-Bi-177 | Cu-40.0 (Mo-8.8 Ta)-20.0 Bi |
| T-Bi-178 | Cu-40.0 (Mo-17.0 Ta)-20.0 Bi |
| T-Bi-179 | Cu-40.0 (Mo-31.5 Ta)-20.0 Bi |
| T-Bi-180 | Cu-40.0 (Mo-44.1 Ta)-20.0 Bi |

TABLE 12

| Sample No. | Current breaking property (ratio to Cu-25 Cr) | Voltage withstand capability (ratio to Cu-25 Cr) | Chopping current value (ratio to Cu-25 Cr) | Melt-adhesion & peel force (ratio to Cu-25 Cr) | Power consumption at contact points (ratio to Cu-25 Cr) |
|---|---|---|---|---|---|
| T-Bi-1 | 1.06 | 1.18 | 0.9~1.1 | 0.3~0.4 | 0.2~0.3 |
| T-Bi-2 | 1.68 | 1.23 | | | |
| T-Bi-3 | 2.04 | 1.25 | | | |
| T-Bi-4 | 2.14 | 1.25 | | | |
| T-Bi-5 | 2.04 | 1.30 | | | |
| T-Bi-6 | 2.24 | 1.40 | | | |
| T-Bi-7 | 2.28 | 1.45 | | | |
| T-Bi-8 | 2.30 | 1.48 | | | |
| T-Bi-9 | 1.56 | 1.13 | | | |
| T-Bi-10 | 2.20 | 1.20 | | | |
| T-Bi-11 | 2.24 | 1.20 | | | |
| T-Bi-12 | 2.26 | 1.20 | | | |
| T-Bi-13 | 1.04 | 0.97 | 0.9~1.1 | (0)~0.2 | 0.2~0.3 |
| T-Bi-14 | 1.68 | 1.06 | | | |
| T-Bi-15 | 2.03 | 1.14 | | | |
| T-Bi-16 | 2.12 | 1.16 | | | |
| T-Bi-17 | 2.03 | 1.11 | | | |
| T-Bi-18 | 2.22 | 1.26 | | | |
| T-Bi-19 | 2.29 | 1.34 | | | |
| T-Bi-20 | 2.32 | 1.39 | | | |
| T-Bi-21 | 1.56 | 0.92 | | | |
| T-Bi-22 | 2.18 | 1.03 | | | |
| T-Bi-23 | 2.24 | 1.08 | | | |
| T-Bi-24 | 2.26 | 1.09 | | | |
| T-Bi-25 | 1.05 | 0.83 | 0.9~1.1 | (0) | 0.2~0.3 |
| T-Bi-26 | 1.67 | 0.95 | | | |
| T-Bi-27 | 2.05 | 1.05 | | | |
| T-Bi-28 | 2.14 | 1.09 | | | |
| T-Bi-29 | 2.04 | 0.96 | | | |
| T-Bi-30 | 2.23 | 1.15 | | | |
| T-Bi-31 | 2.28 | 1.25 | | | |
| T-Bi-32 | 2.31 | 1.32 | | | |
| T-Bi-33 | 1.57 | 0.77 | | | |
| T-Bi-34 | 2.19 | 0.92 | | | |
| T-Bi-35 | 2.25 | 0.97 | | | |
| T-Bi-36 | 2.26 | 1.01 | | | |
| T-Bi-37 | 1.05 | 0.64 | 0.7~0.9 | (0) | 0.2~0.3 |
| T-Bi-38 | 1.67 | 0.78 | | | |
| T-Bi-39 | 2.04 | 0.95 | | | |
| T-Bi-40 | 2.13 | 1.03 | | | |
| T-Bi-41 | 2.04 | 0.79 | | | |
| T-Bi-42 | 2.24 | 0.99 | | | |
| T-Bi-43 | 2.28 | 1.16 | | | |
| T-Bi-44 | 2.30 | 1.25 | | | |
| T-Bi-45 | 1.56 | 0.59 | | | |
| T-Bi-46 | 2.20 | 0.76 | 0.7~0.9 | (0) | 0.2~0.3 |
| T-Bi-47 | 2.24 | 0.85 | | | |
| T-Bi-48 | 2.26 | 0.92 | | | |
| T-Bi-49 | 1.01 | 0.52 | 0.4~0.6 | (0) | 0.2~0.3 |
| T-Bi-50 | 1.64 | 0.70 | | | |
| T-Bi-51 | 2.00 | 0.87 | | | |
| T-Bi-52 | 2.11 | 0.96 | | | |
| T-Bi-53 | 1.96 | 0.70 | | | |
| T-Bi-54 | 2.19 | 0.94 | | | |
| T-Bi-55 | 2.26 | 1.07 | | | |
| T-Bi-56 | 2.28 | 1.16 | | | |

TABLE 12-continued

| Sample No. | Current breaking property (ratio to Cu-25 Cr) | Voltage withstand capability (ratio to Cu-25 Cr) | Chopping current value (ratio to Cu-25 Cr) | Melt-adhesion & peel force (ratio to Cu-25 Cr) | Power consumption at contact points (ratio to Cu-25 Cr) |
|---|---|---|---|---|---|
| T-Bi-57 | 1.53 | 0.50 | | | |
| T-Bi-58 | 2.18 | 0.70 | | | |
| T-Bi-59 | 2.23 | 0.74 | | | |
| T-Bi-60 | 2.25 | 0.85 | | | |
| T-Bi-61 | 0.90 | 0.44 | 0.3~0.5 | (0) | 0.2~0.3 |
| T-Bi-62 | 1.50 | 0.63 | | | |
| T-Bi-63 | 1.92 | 0.80 | | | |
| T-Bi-64 | 2.02 | 0.90 | | | |
| T-Bi-65 | 1.80 | 0.60 | | | |
| T-Bi-66 | 2.10 | 0.87 | | | |
| T-Bi-67 | 2.20 | 1.00 | | | |
| T-Bi-68 | 2.22 | 1.09 | | | |
| T-Bi-69 | 1.44 | 0.40 | | | |
| T-Bi-70 | 2.12 | 0.64 | 0.3~0.5 | (0) | 0.2~0.3 |
| T-Bi-71 | 2.19 | 0.70 | | | |
| T-Bi-72 | 2.22 | 0.78 | | | |
| T-Bi-73 | 0.60 | 0.38 | 0.2~0.3 | (0) | 0.2~0.3 |
| T-Bi-74 | 1.28 | 0.55 | | | |
| T-Bi-75 | 1.64 | 0.74 | | | |
| T-Bi-76 | 1.77 | 0.83 | | | |
| T-Bi-77 | 1.51 | 0.55 | | | |
| T-Bi-78 | 1.83 | 0.80 | | | |
| T-Bi-79 | 1.97 | 0.90 | | | |
| T-Bi-80 | 2.02 | 1.02 | | | |
| T-Bi-81 | 1.22 | 0.35 | | | |
| T-Bi-82 | 1.95 | 0.58 | | | |
| T-Bi-83 | 2.04 | 0.65 | | | |
| T-Bi-84 | 2.08 | 0.70 | | | |
| T-Bi-85 | 1.96 | 1.05 | 0.9~1.1 | 0.3~0.4 | 0.5~0.7 |
| T-Bi-86 | 2.05 | 1.15 | | | |
| T-Bi-87 | 2.13 | 1.18 | | | |
| T-Bi-88 | 2.15 | 1.16 | | | |
| T-Bi-89 | 1.83 | 1.22 | | | 0.2~0.3 |
| T-Bi-90 | 2.09 | 1.27 | | | |
| T-Bi-91 | 2.22 | 1.30 | 0.9~1.1 | 0.3~0.4 | 0.2~0.3 |
| T-Bi-92 | 2.26 | 1.28 | | | |
| T-Bi-93 | 1.95 | 0.64 | 0.9~1.1 | (0) | 0.5~0.7 |
| T-Bi-94 | 2.05 | 0.77 | | | |
| T-Bi-95 | 2.12 | 0.88 | | | |
| T-Bi-96 | 2.15 | 0.91 | | | |
| T-Bi-97 | 1.83 | 0.84 | | | 0.2~0.3 |
| T-Bi-98 | 2.10 | 1.00 | | | |
| T-Bi-99 | 2.21 | 1.12 | | | |
| T-Bi-100 | 2.26 | 1.15 | | | |
| T-Bi-101 | 1.95 | 0.42 | 0.7~0.9 | (0) | 0.5~0.7 |
| T-Bi-102 | 2.05 | 0.56 | | | |
| T-Bi-103 | 2.12 | 0.68 | | | |
| T-Bi-104 | 2.15 | 0.75 | | | |
| T-Bi-105 | 1.82 | 0.61 | | | 0.2~0.3 |
| T-Bi-106 | 2.09 | 0.84 | | | |
| T-Bi-107 | 2.21 | 1.01 | | | |
| T-Bi-108 | 2.25 | 1.06 | | | |
| T-Bi-109 | 1.85 | 0.35 | 0.4~0.6 | (0) | 0.5~0.7 |
| T-Bi-110 | 1.96 | 0.46 | | | |
| T-Bi-111 | 2.05 | 0.60 | | | |
| T-Bi-112 | 2.06 | 0.70 | | | |
| T-Bi-113 | 1.75 | 0.53 | | | 0.2~0.3 |
| T-Bi-114 | 1.99 | 0.75 | 0.4~0.6 | (0) | 0.2~0.3 |
| T-Bi-115 | 2.14 | 0.89 | | | |
| T-Bi-116 | 2.23 | 0.98 | | | |
| T-Bi-117 | 1.66 | 0.29 | 0.3~0.5 | (0) | 0.5~0.7 |
| T-Bi-118 | 1.80 | 0.39 | | | |
| T-Bi-119 | 1.93 | 0.51 | | | |
| T-Bi-120 | 1.95 | 0.64 | | | |
| T-Bi-121 | 1.63 | 0.45 | | | 0.2~0.3 |
| T-Bi-122 | 1.89 | 0.68 | | | |
| T-Bi-123 | 2.08 | 0.80 | | | |
| T-Bi-124 | 2.16 | 0.92 | | | |
| T-Bi-125 | 1.27 | 0.24 | 0.2~0.3 | (0) | 0.5~0.7 |
| T-Bi-126 | 1.43 | 0.34 | | | |
| T-Bi-127 | 1.60 | 0.45 | | | |
| T-Bi-128 | 1.68 | 0.57 | | | |
| T-Bi-129 | 1.35 | 0.37 | | | 0.2~0.3 |
| T-Bi-130 | 1.66 | 0.59 | | | |
| T-Bi-131 | 1.81 | 0.72 | | | |

TABLE 12-continued

| Sample No. | Current breaking property (ratio to Cu-25 Cr) | Voltage withstand capability (ratio to Cu-25 Cr) | Chopping current value (ratio to Cu-25 Cr) | Melt-adhesion & peel force (ratio to Cu-25 Cr) | Power consumption at contact points (ratio to Cu-25 Cr) |
|---|---|---|---|---|---|
| T-Bi-132 | 1.95 | 0.86 | | | |
| T-Bi-133 | 2.04 | 1.08 | 0.9~1.1 | 0.3~0.4 | 0.5~0.7 |
| T-Bi-134 | 2.15 | 1.20 | | | |
| T-Bi-135 | 2.21 | 1.20 | | | |
| T-Bi-136 | 2.22 | 1.15 | 0.9~1.1 | 0.3~0.4 | 0.5~0.7 |
| T-Bi-137 | 2.29 | 1.28 | | | 0.2~0.3 |
| T-Bi-138 | 2.35 | 1.30 | | | |
| T-Bi-139 | 2.39 | 1.35 | | | |
| T-Bi-140 | 2.40 | 1.35 | | | |
| T-Bi-141 | 2.03 | 0.67 | 0.9~1.1 | (0) | 0.5~0.7 |
| T-Bi-142 | 2.15 | 0.84 | | | |
| T-Bi-143 | 2.20 | 0.88 | | | |
| T-Bi-144 | 2.22 | 0.91 | | | |
| T-Bi-145 | 2.28 | 0.90 | | | 0.2~0.3 |
| T-Bi-146 | 2.35 | 1.02 | | | |
| T-Bi-147 | 2.38 | 1.18 | | | |
| T-Bi-148 | 2.40 | 1.22 | | | |
| T-Bi-149 | 2.03 | 0.48 | 0.7~0.9 | (0) | 0.5~0.7 |
| T-Bi-150 | 2.14 | 0.63 | | | |
| T-Bi-151 | 2.20 | 0.70 | | | |
| T-Bi-152 | 2.22 | 0.75 | | | |
| T-Bi-153 | 2.28 | 0.70 | | | 0.2~0.3 |
| T-Bi-154 | 2.35 | 0.86 | | | |
| T-Bi-155 | 2.38 | 1.06 | | | |
| T-Bi-156 | 2.40 | 1.13 | | | |
| T-Bi-157 | 1.97 | 0.39 | 0.4~0.6 | (0) | 0.5~0.7 |
| T-Bi-158 | 2.07 | 0.54 | | | |
| T-Bi-159 | 2.14 | 0.61 | 0.4~0.6 | (0) | 0.5~0.7 |
| T-Bi-160 | 2.18 | 0.69 | | | |
| T-Bi-161 | 2.22 | 0.59 | | | |
| T-Bi-162 | 2.30 | 0.77 | | | 0.2~0.3 |
| T-Bi-163 | 2.33 | 0.95 | | | |
| T-Bi-164 | 2.38 | 1.04 | | | |
| T-Bi-165 | 1.81 | 0.31 | 0.3~0.5 | (0) | 0.5~0.7 |
| T-Bi-166 | 1.94 | 0.45 | | | |
| T-Bi-167 | 1.99 | 0.52 | | | |
| T-Bi-168 | 2.08 | 0.64 | | | |
| T-Bi-169 | 2.10 | 0.52 | | | 0.2~0.3 |
| T-Bi-170 | 2.20 | 0.70 | | | |
| T-Bi-171 | 2.24 | 0.85 | | | |
| T-Bi-172 | 2.32 | 0.97 | | | |
| T-Bi-173 | 1.44 | 0.26 | 0.2~0.3 | (0) | 0.5~0.7 |
| T-Bi-174 | 1.63 | 0.38 | | | |
| T-Bi-175 | 1.69 | 0.45 | | | |
| T-Bi-176 | 1.77 | 0.58 | | | |
| T-Bi-177 | 1.85 | 0.44 | | | 0.2~0.3 |
| T-Bi-178 | 1.97 | 0.60 | | | |
| T-Bi-179 | 2.03 | 0.76 | | | |
| T-Bi-180 | 2.14 | 0.90 | | | |

TABLE 15

| Sample No. | Composition |
|---|---|
| T-Te-1 | Cu-54.2(Mo-8.8 Ta)-0.1 Te |
| T-Te-2 | Cu-54.2(Mo-8.8 Ta)-20.0 Te |
| T-Te-3 | Cu-57.9(Mo-44.1 Ta)-20.0 Te |
| T-Te-4 | Cu-25.0(Mo-8.8 Ta)-0.1 Te |
| T-Te-5 | Cu-40.0(Mo-8.8 Ta)-20.0 Te |
| T-Te-6 | Cu-25.0(Mo-8.8 Ta)-0.1 Te |
| T-Te-7 | Cu-40.0(Mo-8.8 Ta)-20.0 Te |
| T-Sb-1 | Cu-54.2(Mo-8.8 Ta)-0.1 Sb |
| T-Sb-2 | Cu-54.2(Mo-8.8 Ta)-20.0 Sb |
| T-Sb-3 | Cu-57.9(Mo-44.1 Ta)-20.0 Sb |
| T-Sb-4 | Cu-25.0(Mo-8.8 Ta)-0.1 Sb |
| T-Sb-5 | Cu-40.0(Mo-8.8 Ta)-20.0 Sb |
| T-Sb-6 | Cu-25.0(Mo-8.8 Ta)-0.1 Sb |
| T-Sb-7 | Cu-40.0(Mo-8.8 Ta)-20.0 Sb |
| T-Tl-1 | Cu-54.2(Mo-8.8 Ta)-0.1 Tl |
| T-Tl-2 | Cu-54.2(Mo-8.8 Ta)-20.0 Tl |
| T-Tl-3 | Cu-57.9(Mo-44.1 Ta)-20.0 Tl |
| T-Tl-4 | Cu-25.0(Mo-8.8 Ta)-0.1 Tl |

TABLE 15-continued

| Sample No. | Composition |
|---|---|
| T-Tl-5 | Cu-40.0(Mo-8.8 Ta)-20.0 Tl |
| T-Tl-6 | Cu-25.0(Mo-8.8 Ta)-0.1 Tl |
| T-Tl-7 | Cu-40.0(Mo-8.8 Ta)-20.0 Tl |
| T-Pb-1 | Cu-54.2(Mo-8.8 Ta)-0.1 Pb |
| T-Pb-2 | Cu-54.2(Mo-8.8 Ta)-20.0 Pb |
| T-Pb-3 | Cu-57.9(Mo-44.1 Ta)-20.0 Pb |
| T-Pb-4 | Cu-25.0(Mo-8.8 Ta)-0.1 Pb |
| T-Pb-5 | Cu-40.0(Mo-8.8 Ta)-20.0 Pb |
| T-Pb-6 | Cu-25.0(Mo-8.8 Ta)-0.1 Pb |
| T-Pb-7 | Cu-40.0(Mo-8.8 Ta)-20.0 Pb |
| T-BT-1 | Cu-54.2(Mo-8.8 Ta)-0.1 Bi-0.1 Te |
| T-BT-2 | Cu-54.2(Mo-8.8 Ta)-10.0 Bi-10.0 Te |
| T-BT-3 | Cu-57.9(Mo-44.1 Ta)-10.0 Bi-10.0 Te |
| T-BT-4 | Cu-25.0(Mo-8.8 Ta)-0.1 Bi-0.1 Te |
| T-BT-5 | Cu-40.0(Mo-8.8 Ta)-10.0 Bi-10.0 Te |
| T-BT-6 | Cu-25.0(Mo-8.8 Ta)-0.1 Bi-0.1 Te |
| T-BT-7 | Cu-40.0(Mo-8.8 Ta)-10.0 Bi-10.0 Te |

TABLE 16

| Sample No. | Current breaking property (ratio to Cu-25 Cr) | Voltage withstand capability (ratio to Cu-25 Cr) | Chopping current value (ratio to Cu-25 Cr) | Melt-adhesion & peel force (ratio to Cu-25 Cr) | Power consumption at contact points (ratio to Cu-25 Cr) |
|---|---|---|---|---|---|
| T-Te-1 | 2.04 | 1.30 | 0.9~1.1 | 0.3~0.4 | 0.2~0.3 |
| T-Te-2 | 1.46 | 0.57 | 0.2~0.3 | (0) | 0.2~0.3 |
| T-Te-3 | 2.01 | 1.12 | 0.2~0.3 | (0) | 0.2~0.3 |
| T-Te-4 | 1.94 | 1.04 | 0.9~1.1 | 0.3~0.4 | 0.5~0.7 |
| T-Te-5 | 1.25 | 0.35 | 0.2~0.3 | (0) | 0.2~0.3 |
| T-Te-6 | 2.05 | 1.07 | 0.9~1.1 | 0.3~0.4 | 0.5~0.7 |
| T-Te-7 | 1.80 | 0.42 | 0.2~0.3 | (0) | 0.2~0.3 |
| T-Sb-1 | 2.03 | 1.28 | 0.9~1.1 | 0.3~0.4 | 0.2~0.3 |
| T-Sb-2 | 1.47 | 0.52 | 0.2~0.3 | (0) | 0.2~0.3 |
| T-Sb-3 | 1.95 | 1.03 | 0.2~0.3 | (0) | 0.2~0.3 |
| T-Sb-4 | 1.92 | 1.01 | 0.9~1.1 | 0.3~0.4 | 0.5~0.7 |
| T-Sb-5 | 1.15 | 0.38 | 0.2~0.3 | (0) | 0.2~0.3 |
| T-Sb-6 | 2.00 | 1.08 | 0.9~1.1 | 0.3~0.4 | 0.5~0.7 |
| T-Sb-7 | 1.80 | 0.44 | 0.2~0.3 | (0) | 0.2~0.3 |
| T-Tl-1 | 2.02 | 1.29 | 0.9~1.1 | 0.3–0.4 | 0.2~0.3 |
| T-Tl-2 | 1.40 | 0.50 | 0.2~0.3 | (0) | 0.2~0.3 |
| T-Tl-3 | 1.98 | 0.98 | 0.2~0.3 | (0) | 0.2~0.3 |
| T-Tl-4 | 1.93 | 0.97 | 0.9~1.1 | 0.3~0.4 | 0.5~0.7 |
| T-Tl-5 | 1.14 | 0.34 | 0.2~0.3 | (0) | 0.2~0.3 |
| T-Tl-6 | 2.02 | 1.05 | 0.9~1.1 | 0.3~0.4 | 0.5~0.7 |
| T-Tl-7 | 1.78 | 0.41 | 0.2~0.3 | (0) | 0.2~0.3 |
| T-Pb-1 | 1.98 | 1.26 | 0.9~1.1 | 0.3~0.4 | 0.2~0.3 |
| T-Pb-2 | 1.30 | 0.51 | 0.2~0.3 | (0) | 0.2~0.3 |
| T-Pb-3 | 1.92 | 0.95 | 0.2~0.3 | (0) | 0.2~0.3 |
| T-Pb-4 | 1.85 | 0.80 | 0.9~1.1 | 0.3~0.4 | 0.5~0.7 |
| T-Pb-5 | 1.02 | 0.31 | 0.2~0.3 | (0) | 0.2~0.3 |
| T-Pb-6 | 1.98 | 0.99 | 0.9~1.1 | 0.3~0.4 | 0.5~0.7 |
| T-Pb-7 | 1.65 | 0.39 | 0.2~0.3 | (0) | 0.2~0.3 |
| T-BT-1 | 2.03 | 1.20 | 0.9~1.1 | (0)~0.1 | 0.2~0.3 |
| T-BT-2 | 1.52 | 0.62 | 0.2~0.3 | (0) | 0.2~0.3 |
| T-BT-3 | 2.12 | 1.21 | 0.2~0.3 | (0) | 0.2~0.3 |
| T-BT-4 | 1.98 | 1.13 | 0.9~1.1 | (0)~0.1 | 0.5~0.7 |
| T-BT-5 | 1.23 | 0.40 | 0.2~0.3 | (0) | 0.2~0.3 |
| T-BT-6 | 2.11 | 1.22 | 0.9~1.1 | (0)~0.1 | 0.5~0.7 |
| T-BT-7 | 1.85 | 0.46 | 0.2~0.3 | (0) | 0.2~0.3 |

We claim:

1. A contact material for a vacuum circuit breaker, characterized in that it consists essentially of copper, molybdenum, niobium, and one or more kinds of low melting point materials selected from the group consisting of bismuth, tellurium, antimony, lead and thallium.

2. The contact material for a vacuum circuit breaker according, to claim 1, characterized in that the copper present is in a range of from 30 wt. % to 80 wt. %, the molybdenum present, is in a range of from 13 wt. % to 68.6 wt. %, the niobium present is in a range of from 0.4 wt. % to 24.5 wt. % and the present one or more kinds of the low melting point materials is in a range of from 0.05 wt. % to 25 wt. %.

3. The contact material for a vacuum circuit breaker according to claim 1, characterized in that the copper present is in a range of from 40 wt. % to 75 wt. %, the molybdenum present is in a range of from 17.9 wt. % to 57.2 wt. %, the niobium present is in a range of from 1.1 wt. % to 17.1 wt. %, and the present one or more kinds of the low melting point materials is present in a range of from 0.1 wt. % to 20 wt. %.

4. The contact material for a vacuum circuit breaker according of claim 1, characterized in that the copper present is in a range of from 40 wt. % to 60 wt. %, the molybdenum present is in a range of from 28.6 wt. % to 57.2 wt. % the niobium present is in a range of from 1.9 wt. % to 17.1 wt. %, and the present one or more kinds of low melting point materials is present in a range of from 0.1 wt. % to 20 wt. %, and that said contact material is produced by infiltration method.

5. The contact material for a vacuum circuit breaker according to claim 1, characterized in that the copper present in a range of from 60 wt. % to 75 wt. %, the molybdenum present is in a range of from 17.9 wt. % to 38.1 wt. %, the niobium present is in a range of from 1.1 wt. % to 11.4 wt. %, and the present of one or more kinds of the low melting point materials is present in a range of from 0.1 wt. % to 20 wt. %, and that, said contact material is produced by the powder sintering method.

6. The contact material for a vacuum circuit breaker according to claim 1, characterized in that the copper present is in a range of from 60 wt. % to 75 wt. %, the molybdenum present, is in a range of from 17.9 wt. % to 38.1 wt. %, the niobium present is in a range of from 1.1 wt. % to 11.4 wt. %, and the present one or more kinds of the low melting point material is present in a range of from 0.1 wt. % to 20 wt. %, and that said contact material is produced by vacuum hot press method.

7. A contact material for a vacuum circuit breaker, characterized in that it consists essentially of copper, molybdenum, tantalum, and one or more kinds of low melting point materials selected from the group consisting of bismuth, tellurium, antimony, lead and thallium.

8. The contact material for a vacuum circuit breaker according to claim 7, characterized in that the copper present is in a range of from 30 wt. % to 80 wt. %, the molybdenum present is in a range of from 9 wt. % to 68.6 wt. %, the tantalum present is in a range of from 0.4 wt. % to 38.5 wt. %, and the present one or more kinds of the low melting point materials is present in a range of from 0.05 wt. % to 25 wt. %.

9. The contact material for a vacuum circuit breaker according, to claim 7, characterized in that the copper present is in a range of from 32.6 wt. % to 75 wt. %, the molybdenum content is in a range of from 14 wt. % to 61.5 wt. %, the tantalum present is in a range of from 2.2 wt. % to 29.7 wt. %, and the present one or more kinds of the low melting point materials is present in a range of from 0.1 wt. % to 20 wt. %.

10. The contact material for a vacuum circuit breaker according to claim 7, characterized in that the copper present is in a range of from 32.6 wt. % to 65.9 wt. %, the molybdenum present is in a range of from 26.8 wt. % to 61.5 wt. %, the tantalum present is in a range of from 3.9 wt. % to 29.7 wt. %, and the present one or more kinds of the low melting point materials is present in a range of from 0.1 wt. % to 20 wt. %, and that said contact material is produced by an infiltration method.

11. The contact material for a vacuum circuit breaker according to claim 7, characterized in that the copper present is in a range of from 60 wt. % to 75 wt. %, the molybdenum present is in a range of from 14 wt. % to 36.5 wt. %, the tantalum present is in a range of from 2.2 wt. % to 17.6 wt. %, and the present one or more kinds of the low melting point materials is present in a range of from 0.1 wt. % to 20 wt. %, and that said contact material is produced by a powder sintering method.

12. The contact material for a vacuum circuit breaker according to claim 7, characterized in that the copper present is in a range of from 60 wt. % to 75 wt. %, the molybdenum present is in a range of from 14 wt. % to 36.5 wt. %, the tantalum present is in a range of from 2.2 wt. % to 17.6 wt. %, and the present one or more kinds of the low melting point material is present in a range of from 0.1 wt. % to 20 wt. %, and that said contact material is produced by a vacuum hot press method.

* * * * *